US012703552B1

(12) United States Patent
Steinbauer et al.

(10) Patent No.: US 12,703,552 B1
(45) Date of Patent: Aug. 11, 2026

(54) APPARATUS AND METHOD FOR A CHILD-RESISTANT ORAL NICOTINE CAN

(71) Applicant: SkyX IP Holdings I LLC, New York, NY (US)

(72) Inventors: Martin Steinbauer, New York, NY (US); Jeffrey Chagnon, Somerville, MA (US)

(73) Assignee: SkyX IP Holdings I LLC, New York, NY (US)

( * ) Notice: Subject to any disclaimer, the term of this patent is extended or adjusted under 35 U.S.C. 154(b) by 0 days.

(21) Appl. No.: 19/328,723

(22) Filed: Sep. 15, 2025

Related U.S. Application Data

(60) Provisional application No. 63/871,952, filed on Aug. 28, 2025.

(51) Int. Cl.
*B65D 50/06* (2006.01)
*B65D 43/02* (2006.01)

(52) U.S. Cl.
CPC ..... *B65D 50/061* (2013.01); *B65D 43/0212* (2013.01); *B65D 2215/04* (2013.01); *B65D 2543/00537* (2013.01)

(58) Field of Classification Search
CPC ..... B65D 50/061; B65D 43/0212; B65D 2215/04; B65D 2543/00537
USPC ..... 215/223
See application file for complete search history.

(56) References Cited

U.S. PATENT DOCUMENTS 334,865 A * 1/1886 Howell ..... B65D 50/06 215/208
1,636,323 A 7/1927 Rand
2,987,207 A * 6/1961 Stevoff ..... B65D 50/061 215/208
3,212,662 A * 10/1965 Webb ..... B65D 50/061 215/208
3,497,096 A * 2/1970 Smith ..... B65D 50/061 215/217
3,749,270 A * 7/1973 Affleck ..... B65D 41/06 215/222
3,828,957 A * 8/1974 Marchant ..... B65D 50/043 215/222
4,071,156 A 1/1978 Lowe
4,376,493 A 3/1983 Gall
4,548,331 A 10/1985 Montgomery
4,732,288 A 3/1988 Morris, Sr.
4,747,518 A 5/1988 Laauwe
(Continued)

FOREIGN PATENT DOCUMENTS

KR 20230007871 A * 1/2023 ..... B65D 50/045
KR 102656433 B1 * 4/2024 ..... A45D 40/22
WO 2019136506 A1 7/2019

OTHER PUBLICATIONS

Office Action for U.S. Appl. No. 19/328,823, dated Jan. 5, 2026, 14 pages.

(Continued)

*Primary Examiner* — Orlando E Aviles
*Assistant Examiner* — Niki M Eloshway
(74) *Attorney, Agent, or Firm* — POLSINELLI PC

(57) ABSTRACT

Provided herein is a child-resistant can including a base and a lid. The base may include a bottom plate, a base circumferential wall, and an interior surface defined by the bottom plate and base circumferential wall. The lid may be configured to enclose the interior surface.

19 Claims, 47 Drawing Sheets

(56) References Cited

U.S. PATENT DOCUMENTS

| | | | | |
|---|---|---|---|---|
| 4,753,189 | A | 6/1988 | Mastman et al. | |
| 5,083,671 | A | 1/1992 | Hayes | |
| 5,317,796 | A * | 6/1994 | Hunter | B65D 50/061 29/434 |
| 5,476,181 | A * | 12/1995 | Seidler | G01F 11/286 215/208 |
| 5,686,700 | A | 11/1997 | Carpinella | |
| 5,816,422 | A | 10/1998 | Roig | |
| 5,967,352 | A | 10/1999 | Repp | |
| 6,105,803 | A | 8/2000 | Standish | |
| 6,772,902 | B1 | 8/2004 | White | |
| 7,040,499 | B1 | 5/2006 | Reif | |
| 7,404,495 | B2 | 7/2008 | Keung | |
| 8,113,366 | B2 * | 2/2012 | House | B65D 50/061 215/208 |
| 8,292,110 | B2 | 10/2012 | Rutter et al. | |
| 8,689,995 | B2 | 4/2014 | Letica, II et al. | |
| 9,016,491 | B2 | 4/2015 | Blum | |
| 9,033,172 | B2 | 5/2015 | Thati | |
| 9,950,844 | B2 | 4/2018 | Barber et al. | |
| 9,968,516 | B2 | 5/2018 | Rogers et al. | |
| 10,118,742 | B2 | 11/2018 | Paul | |
| 11,089,635 | B1 | 8/2021 | Wei | |
| 11,767,150 | B2 | 9/2023 | Darst | |
| 2001/0047976 | A1 * | 12/2001 | Frank | B65D 50/061 215/208 |
| 2006/0169603 | A1 | 8/2006 | Lancesseur et al. | |
| 2006/0186080 | A1 | 8/2006 | Chae | |
| 2006/0278600 | A1 | 12/2006 | Zavala | |
| 2007/0039914 | A1 * | 2/2007 | Buono | B65D 50/046 215/331 |
| 2009/0194500 | A1 * | 8/2009 | House | B65D 50/061 215/223 |
| 2011/0303659 | A1 | 12/2011 | Perlman | |
| 2012/0248106 | A1 | 10/2012 | Marta | |
| 2013/0062347 | A1 | 3/2013 | Webster | |
| 2013/0214004 | A1 * | 8/2013 | Dejonge | B65D 50/061 220/345.3 |
| 2015/0321804 | A1 | 11/2015 | Koller et al. | |
| 2016/0074280 | A1 | 3/2016 | Miceli | |
| 2017/0113851 | A1 | 4/2017 | Martin et al. | |
| 2020/0039708 | A1 | 2/2020 | Twist | |
| 2021/0122533 | A1 | 4/2021 | Kittmann | |
| 2022/0055805 | A1 * | 2/2022 | Goldberg | B65D 50/04 |
| 2022/0194054 | A1 | 6/2022 | Hession | |
| 2023/0194054 | A1 | 6/2023 | Maitre | |
| 2023/0211928 | A1 * | 7/2023 | Sanchez | B65D 50/04 215/217 |

OTHER PUBLICATIONS

Office Action for U.S. Appl. No. 19/329,239, dated Jan. 5, 2026, 12 pages.

Office Action for U.S. Appl. No. 19/329,266, dated Jan. 5, 2026, 10 pages.

Non-Final Office Action for U.S. Appl. No. 19/328,797, dated Feb. 19, 2026, 18 pages.

Notice of Allowance for U.S. Appl. No. 19/328,823, dated Mar. 9, 2026, 5 pages.

Notice of Allowance for U.S. Appl. No. 19/334,867, dated Apr. 15, 2026, 8 pages.

Final Office Action for U.S. Appl. No. 19/329,266, date Apr. 29, 2026, 10 pages.

Final Office Action for U.S. Appl. No. 19/329,239, date Apr. 29, 2026, 8 pages.

Final Office Action for U.S. Appl. No. 19/329,266, dated May 26, 2026, 11 pages.

Notice of Allowance for U.S. Appl. No. 19/334,868, dated May 15, 2026, 8 pages.

* cited by examiner

APPARATUS AND METHOD FOR A CHILD-RESISTANT ORAL NICOTINE CAN

CROSS-REFERENCE TO RELATED APPLICATIONS

This application claims the benefit of U.S. Provisional Patent Application Ser. No. 63/871,952, filed on Aug. 28, 2025, and titled "APPARATUS AND METHOD FOR A CHILD-PROOF ORAL NICOTINE CAN," which is incorporated by reference herein in its entirety.

BACKGROUND

In recent years, the consumption of oral nicotine products has increased significantly, leading to heightened concerns regarding the safety of these products, particularly in households with children. Oral nicotine products, such as lozenges, gum, and pouches, often contain concentrated levels of nicotine, which pose a substantial risk of poisoning if ingested by children. Furthermore, the increased market presence of these products, often flavored to resemble candies, exacerbates the risk of accidental ingestion by making them visually appealing to children.

Additionally, regulatory organizations may mandate child-resistant packaging for products containing hazardous substances. Oral nicotine products must comply with these regulations to ensure the safety of consumers and to prevent incidents of accidental poisoning. There are various guidelines for making cans child-resistant such as ISO8317 and 16 CFR 1700. Child-resistance refers to children up to a certain age not being able to open the product, while adults generally can do so. More specifically, most standards require that young children aged 42-51 months cannot open the product. For ISO 8317, within 5 minutes, at least 85% of children must not be able to open the package within 5 minutes. Secondarily, even after demonstrating to these children how to open the package, at least 80% of children cannot do so in the following 5 minute test. At the same time, at least 90% of adults (aged 50-70) must be able to open and close the packaging successfully within 5 minutes. For 16 CFR 1700, the requirement is that 80% or more of the test children fail to open the package within the 10-minute period, meaning no more than 20% of the children were successful in opening it. For senior adult effectiveness, at least 90% of seniors must be able to successfully open and reclose the can.

At the same time, it is important to maintain low-barrier access to oral nicotine products, such as pouches and lozenges, for adult consumer, as these products play a significant role in tobacco harm reduction strategies by offering adult users a means to consume nicotine without the detrimental effects associated with smoking combustible tobacco products. Even cans which comply with various guidelines, they may not be entirely child-resistant or conversely, they may be so difficult to open that they pose barriers to adult consumers. Additionally, in some instances, solutions which require significant alterations to existing cans and/or addition of complex systems or additional materials may present a cost or reliability barrier. Accordingly, solutions are needed for these issues, in order to provide child-resistant cans which are accessible to adult consumers and economical to produce.

BRIEF SUMMARY

Disclosed herein is a child-resistant can including a base with a bottom plate and a circumferential wall extending from the bottom plate, defining interior and exterior surfaces, and a lid. The lid may have a top plate and a circumferential wall designed to enclose the base's interior or exterior surface.

According to some aspects, the base circumferential wall may feature a groove on the exterior comprising interconnected portions at specified angles. The lid's wall may include a projection to fit within the groove, allowing lid removal by guiding the projection through the groove's portions.

According to some embodiments, the groove may include first and second angles within ranging from 80 to 100 degrees, with a common value being 90 degrees. The groove's portions have specific spatial orientations. According to some embodiments, the first and third extend may horizontally, while the second may extend vertically along the exterior wall. An inlet may guide the lid's projection into the groove with a snap-fit mechanism to prevent projection removal, extending vertically and possibly featuring a chamfered surface for guidance.

Similarly, according to some aspects, an outlet portion may allow for projection disengagement for lid separation, usually extending vertically with a chamfered surface to assist removal while blocking re-entry. The first groove portion might include a lip to resist projection translation. The groove's depth and width may range between about 0.8 to 5 mm, with common dimensions being 1 to 3 mm for depth and 2 to 3 mm for width. The can's diameter may span 50 to 100 mm, and its height ranges from 10 to 30 mm.

Methods to interact with the can include a closing method involving lid alignment and projection insertion, and an opening method involving guided projection movement for lid removal. The can might provide sensory feedback during engagement and may comprise or consist of materials like aluminum, plant-based, or petroleum-based plastics, with biodegradability as an option.

Some embodiments involve a base with projections, snap-fit connectors including an actuator portion and an upper portion, and a corresponding lid featuring indents and projections, wherein engagement requires snap-fit connector rotation upon application of pressure by a user to the actuator portion. According to some embodiments, snap-fit connectors may allow for sensory feedback, and their spacing may be uniform. The can may maintain similar dimensions as in other embodiments and might contain features like radially disposed cavities for actuator portions.

According to some embodiments, a child-resistant can may include a base including a bottom plate, a base circumferential wall extending from the bottom plate, the bottom plate and the base circumferential wall defining an interior surface and an opposing exterior surface, the base circumferential wall may include a groove in the exterior surface, the groove may include a vertical locking portion including a snap-fit connector, a horizontal portion, and a vertical inlet/outlet portion, and a lid configured to enclose the interior surface, the lid may include a top plate, and a lid circumferential wall extending from the top plate and configured to abut against the exterior surface of the base circumferential wall, the lid circumferential wall may include a projection configured to be received within the groove and be engaged by the snap-fit connector.

According to some embodiments, a child-resistant can may include a base includes a bottom plate. The child-resistant may include a base includes a base circumferential wall extending from the bottom plate, the bottom plate and the base circumferential wall defining an interior surface and an opposing exterior surface, the base circumferential wall includes a indent. The child-resistant can may include a base includes a base top plate extending from the base circumferential wall, the base top plate includes a base opening. The child-resistant can may include a lid configured to enclose the interior surface, the lid includes a lid top plate configured to enclose the base opening, the lid top plate may include a lid opening, a top surface, an opposing bottom surface, and a moveable switch disposed in the lid top plate, the moveable switch may include a slider exposed on the top surface and a projection extending from the bottom surface, the slider configured to control motion of the projection, and the projection configured to engage with the indent. The child-resistant can may include a base includes a lid circumferential wall extending from the bottom surface and configured to abut against the exterior surface of the base circumferential wall, where the slider is movable such that the projection may be disengaged from the indent.

According to some embodiments, a child-resistant can may include a base including a bottom plate, a base circumferential wall extending from the bottom plate, the bottom plate and the base circumferential wall defining an interior surface and an opposing exterior surface, the base circumferential wall may include an indent and a groove includes a horizontal portion and a vertical inlet/outlet portion, and a lid configured to enclose the interior surface, the lid may include a top plate, a lid circumferential wall extending from the top plate and configured to abut against the exterior surface of the base circumferential wall, the lid circumferential wall may include a wall projection configured to be received within the groove, and a moveable switch may include a slider disposed on a top surface of the top plate and a switch projection extending along and/or within the lid circumferential wall, the switch projection configured to be received within the indent, where the slider is movable such that the projection may be disengaged from the indent, thereby allowing the wall projection to translate within the groove towards the vertical inlet/outlet portion.

Some embodiments may provide cans with a spiral groove on the base's circumferential wall, a shell featuring a projection for groove engagement, and a bistable cap with flexing arms that may fit within a gap formed between the base and shell, enabling secure engagement or removal through rotation and pressure application. Material composition may include metals like aluminum or chromed steel.

Terms and Definitions

As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, "active ingredient" refers to a chemical component that is biologically active and is responsible for the intended therapeutic effects or desired outcomes of a formulation, such as a pharmaceutical product, agricultural product, personal care item, or stimulant product. As used herein, the "active ingredient" may comprise or consist of nicotine. As used herein, "excipient" refers to refers to an inactive substance formulated alongside the active ingredient, serving as the vehicle or medium for active ingredient delivery. Excipients may help to stabilize, preserve, or enhance the absorption of the active ingredient, and can also improve product characteristics like taste, appearance, and consistency.

As used herein, "horizontal" refers to a direction parallel to the bottom plate of the base of the disclosed cans, whiled "vertical" refers to a direction perpendicular to the bottom plate of the disclosed cans. "Upwards" refers to a direction perpendicular to the bottom plate of the disclosed cans, generally moving away from the bottom plate and in the opposite direction from gravity, when the can is resting on a surface on its bottom plate. "Downwards" refers to the opposite direction from upwards.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

A persistent issue with child-proofing cans or making cans child-resistant is structurally configuring cans such that the cans are not easily openable by children, but are intuitively easy for adults to open.

Child-resistant cans may include numerous design considerations. For example, design considerations may include how a safety mechanism is deactivated, how the can is opened, how the can is closed, if the can safety mechanism needs to be reset, and if the can provides any feedback related to reactivation of the safety mechanism. Deactivating a safety mechanism may include embodiments where the safety mechanism must be held to deactivate it or where the safety mechanism does not need to be held to deactivate it. Closing the can may include reversing an opening motion or an alternative motion. Resetting the safety mechanism may include automatic resets or manually resets. Feedback for reactivation of the safety mechanism may include continuous indications of reset, an indication at the time of reset, or no indication of reset. In some examples, indicators for confirming that the safety mechanism is reactivated may include visual, audible, and/or tactile indicators. Visual indicates may include aligned features, position changes, visible/hidden features, and/or an indicator color or window. Audible indicators may include clicks, ratchet noises, dings, rattles, scraping noises, and/or grinding noises. Tactile indicators may include clicks, ratchets, spring forces, friction forces, pressure, and/or indents.

FIG. 1A to FIG. 1D illustrate can shapes suitable for child-resistant cans. For example, the can may include a disc shape 100, a box shape 102, a dowel shape 104, and/or a pouch shape 106. In some examples, other shapes may be used. For example, the can may have an irregular shape such as an ellipse shape, a tear drop shape, a triangular shape, a pentagonal shape, a hexagonal shape, or other shapes.

Figure 1A:
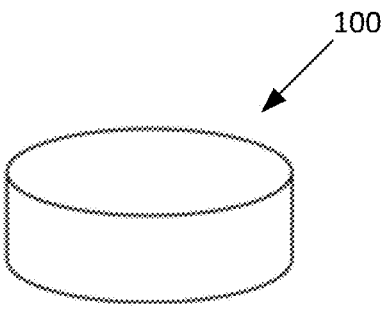
FIG. 1A illustrates a can in accordance with one embodiment.
Figure 1B:
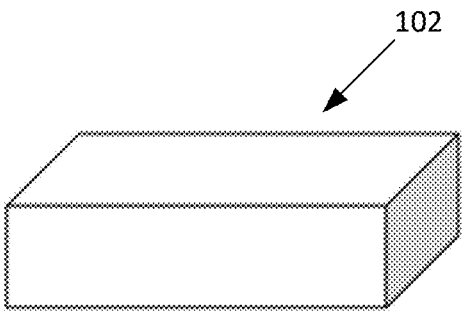
FIG. 1B illustrates a can in accordance with one embodiment.
Figure 1C:
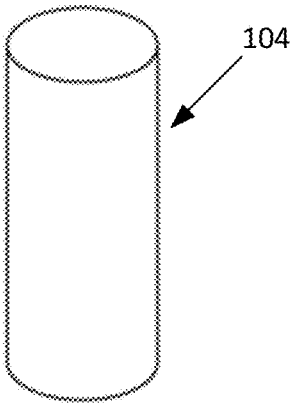
FIG. 1C illustrates a can in accordance with one embodiment.
Figure 1D:
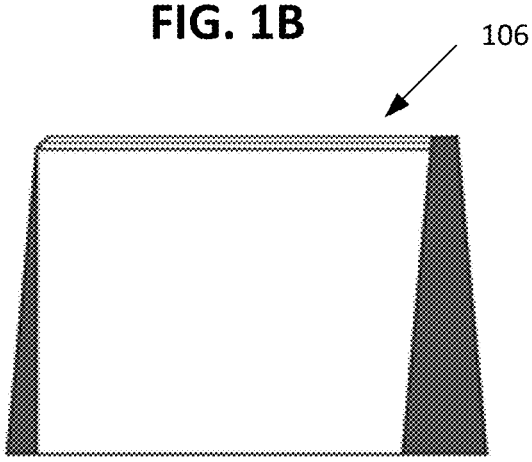
FIG. 1D illustrates a can in accordance with one embodiment.
Figure 2:
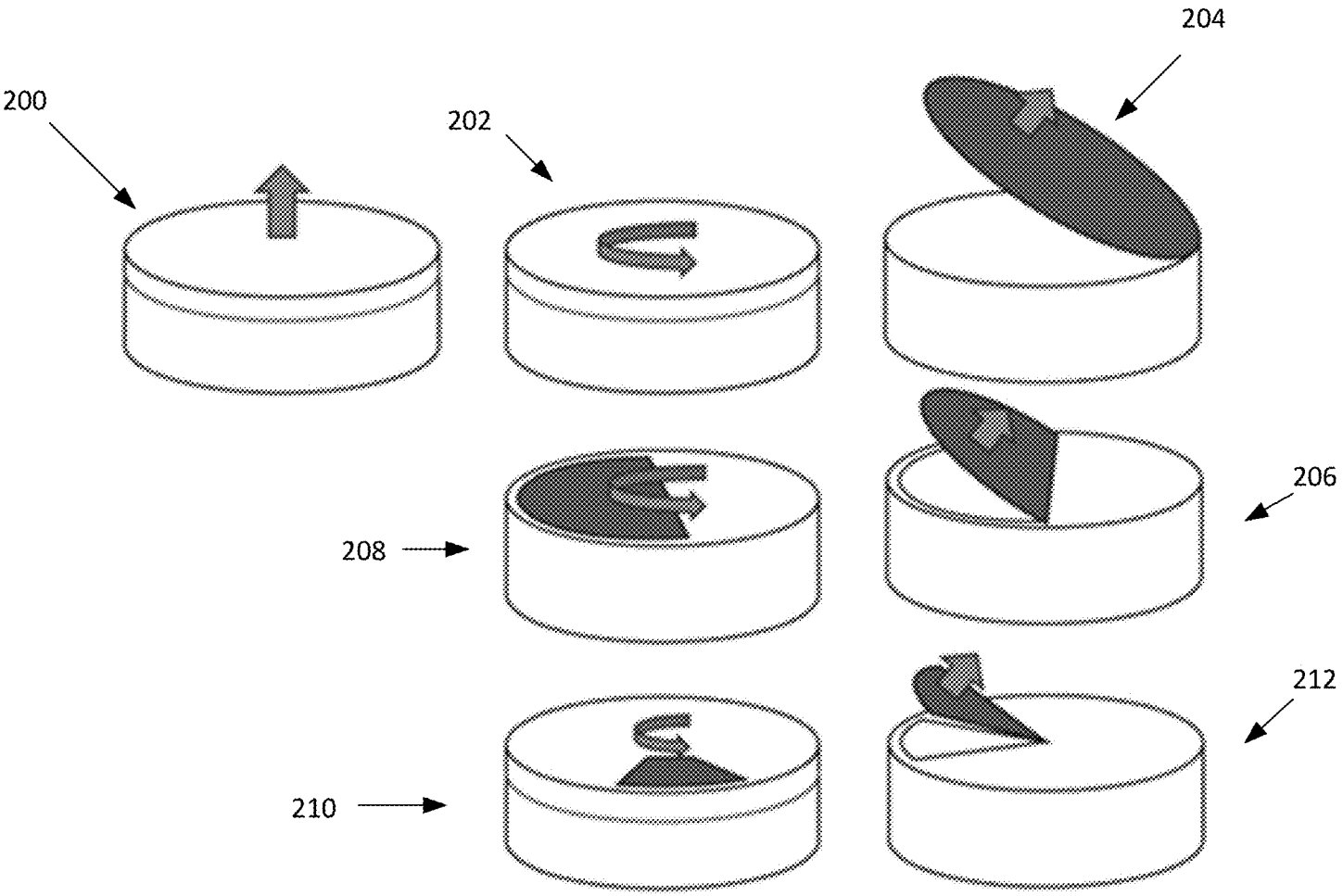
FIG. 2 illustrates various can opening methods in accordance with one embodiment.

FIG. 2 illustrates various methods for opening a can having a disc shape 100. For example, methods for opening a can having a disc shape 100 may include a pop-off top 200, a twist off top 202, a twist to open a large opening 208, a twist to open a small opening 210, a flip off large top 204, a flip off half top 206, and/or a flip off small top 212.

Figure 3:
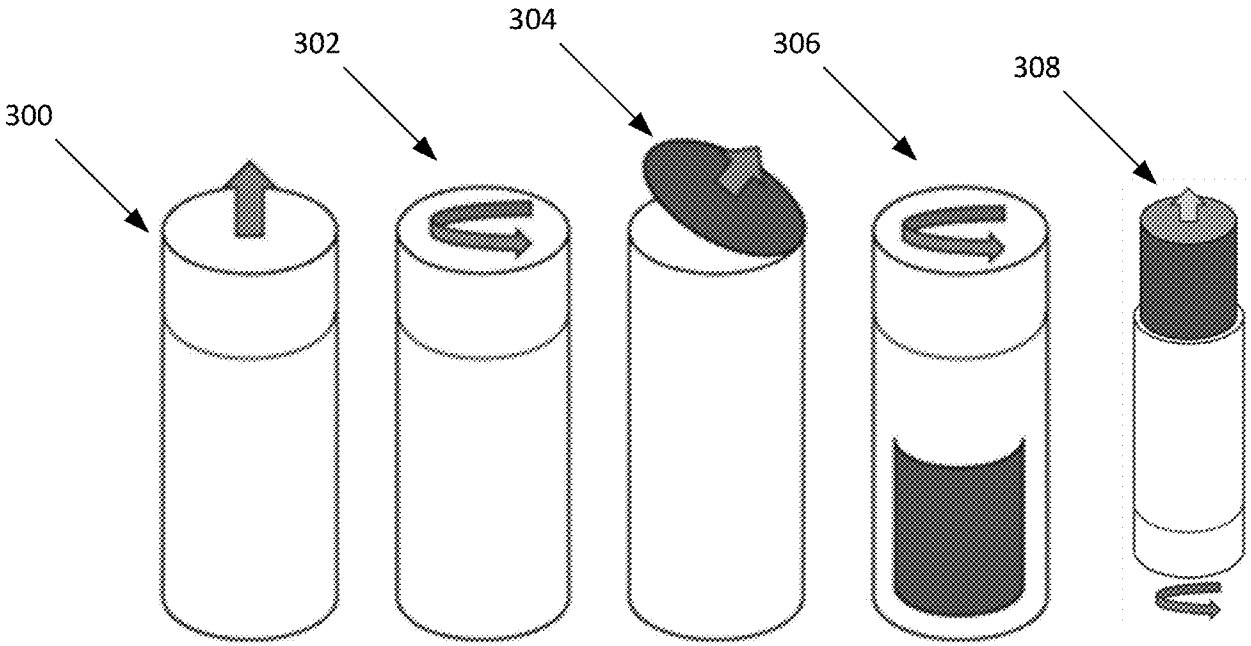
FIG. 3 illustrates various can opening methods in accordance with one embodiment.

FIG. 3 illustrates various methods for opening a can have a dowel shape 104. For example methods for opening a can having a dowel shape 104 may include a pop off tube top 300, a twist off tube top 302, a flip off tube top 304, a twist to open a side port 306, and/or a twist tube bottom to extend an opening 308.

Figure 4:
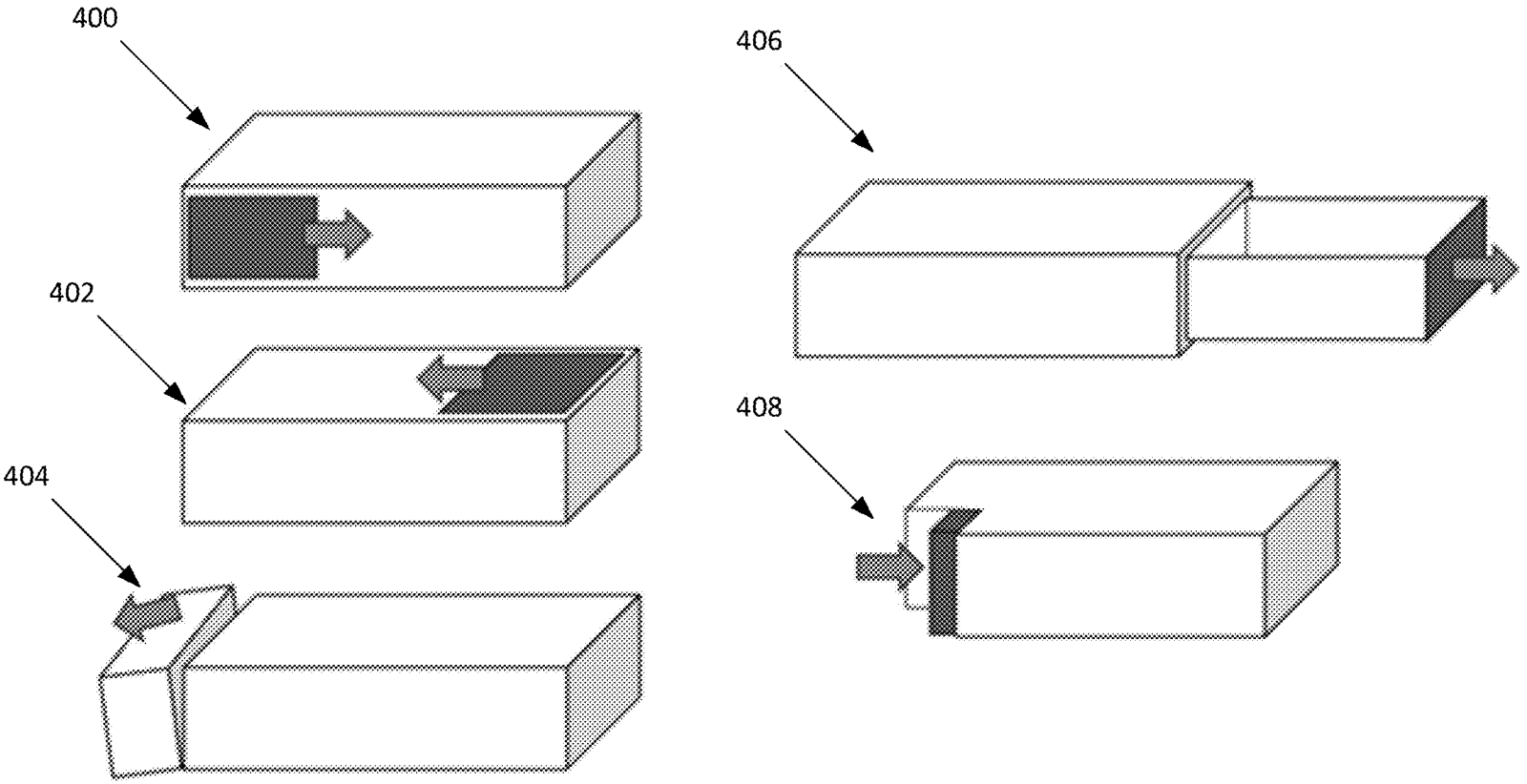
FIG. 4 illustrates various can opening methods in accordance with one embodiment.

FIG. 4 illustrates various methods for opening a can having a box shape 102. For example, methods for opening a can having a box shape 102 may include a box slider side open 400, a box slider top open 402, a box side breaks open 404, a box side extends open 406, and/or a box corner opens 406.

Figure 5:
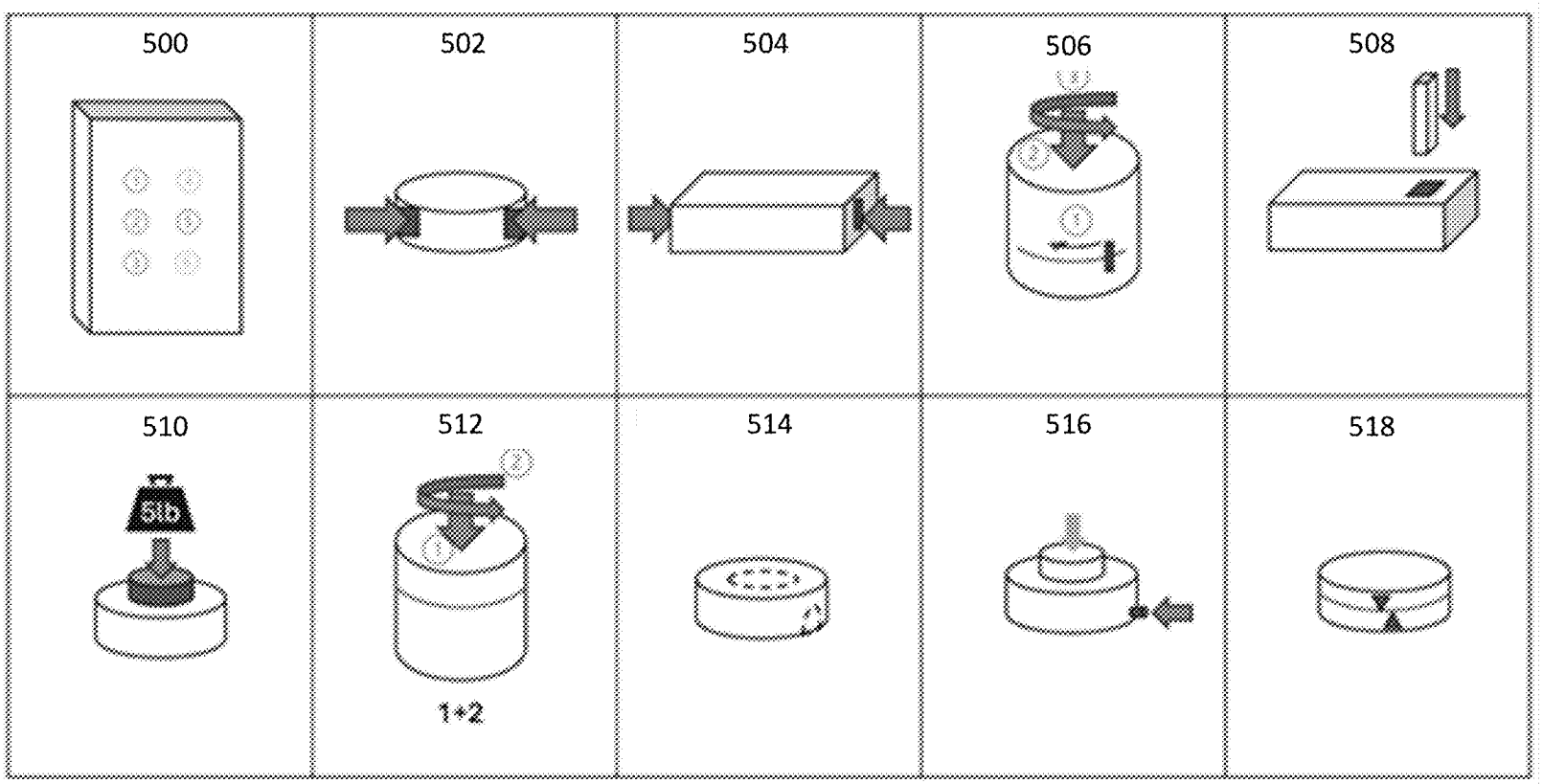
FIG. 5 illustrates various child-proofing and/or child-resistance methods in accordance with one embodiment.

FIG. 5 illustrates various methods for child-proofing a can or making it child-resistant. For example, a combination method 500 for childproofing (or child-resistance) may include requiring a user to press buttons or features in order for the can to open. In some examples, the combination method 500 may require a sequential order of pressed buttons or features to open a can. The correct combination of pressed buttons or features may release an opening mechanism. Another method for childproofing (or child-resistance) includes a dexterity/coordination method 502. The dexterity/coordination method 502 may include requiring a user to coordinate the pressing of buttons or features at various parts of the can. Dexterity and coordination may be required to actuate multiple mechanisms simultaneously. Another method for childproofing (or child-resistance) includes a hand size method 504. The hand size method 504 may require a user to have large enough hands to simultaneously press features at opposite ends of a can. The hand size method 504 requires large physiology to operate. Another method for childproofing (or child-resistance) includes a multi-step method 506. The multi-step method 506 may require a user to complete a variety of steps to open a can, such as a combination of a twist, press, and slider action in sequence. Another method for childproofing (or child-resistance) includes a tool/key method 508. The tool/key method 508 may required a user to use a tool or key to access the product. For example, the tool or key may be part of the can to be taken off by the user after purchase, or hang from the can to open the can. Another method for childproofing (or child-resistance) includes a strength method 510. The strength method 510 may require a user to exert enough force on a feature to open it, such that it would be unlikely for a child to be able to do the same. Another method for childproofing (or child-resistance) includes a complex motion method 512. The complex motion method 512 may require a user to press and twist the can in order to open the container. In some examples, the complex motion method 512 may require multiple steps occurring simultaneously requiring knowledge, strength, and dexterity. Another method for childproofing (or child-resistance) may include a hidden pressure points method 514. The hidden pressure points method 514 may require a user to read instructions on the can to determine how to open the can. The feature required to open the can may be hidden to the naked eye. The hidden feature may enable release or safety features and only be operable by knowledge gathering. Another method for childproofing (or child-resistance) may include a distraction method 516. The distraction method 516 may require a user to read instructions to actively ignore a feature that seems as if it would open the can, but actually actuate another feature to open the can. The distraction method 516 may include a hidden mechanism paired with a red herring mechanism, and be operable only be knowledge gathering. Another method for childproofing (or child-resistance) may include an alignment method 518. The alignment method 518 may require a user to align top and bottom pieces of a can in a certain way to open the can.

It will be appreciated that one or more of the childproofing (or child-resistance) methods illustrated in FIG. 5 may be used in the child-resistant cans described herein.

Provided herein are child-resistant cans. The child-resistant cans may be configured to contain one or more products. In some examples, the one or more products may include products that children should not have access to. For example, the one or more products may include dosage forms including an active ingredient. In some examples, the active ingredient may include one or more of nicotine, prescription pharmaceuticals, non-prescription pharmaceuticals, nutraceuticals, homeopathics, and/or cannabinoids.

FIG. 6A to FIG. 6M illustrate an embodiment of a child-resistant can 600. The child-resistant can 600 may include one or more safety mechanisms operable to prevent a child from opening the child-resistant can 600. For example, the child-resistant can 600 may require complex motion, a combination of motions, and/or manipulation of hidden features in order to open the child-resistant can 600. In this manner, children are prevented from opening the child-resistant can 600.

The child-resistant can 600 may include a base 602 and a lid 610. The base 602 may include a bottom plate 604 and a base circumferential wall 616. The base circumferential wall 616 may extend from the bottom plate. For example, the base circumferential wall 616 may extend outwards from the bottom plate 604. The base 602 may include an interior surface 643 defined by the base circumferential wall 616 and the bottom plate 604. In some examples, the interior surface 643 may be configured to hold one or more products 601.

The lid 610 may be configured to enclose the interior surface 643. For example, the lid 610 may enclose the interior surface 643 such that a cavity is defined by the lid 610, interior surface 643, and, optionally, the base circumferential wall 616. The cavity may be configured to contain one or more products 601.

The lid 610 may include a top plate 612 and a lid circumferential wall 614. The lid circumferential wall 614 may extend from the top plate 612. In some examples, the lid circumferential wall 614 may be configured to abut against the base circumferential wall 616. In some examples, the lid circumferential wall 614 may include a projection 628. The projection 628 may extend inward from the lid circumferential wall 614 (e.g., the projection 628 may be one the interior surface of the lid circumferential wall 614).

In some examples, the base circumferential wall 616 may include a groove 620. The groove 620 may include a cut out within the base circumferential wall 616. The groove 620 may be molded as part of the base 602. In some examples, the groove 620 may define a tortuous path having one or more portions (e.g., sections). For example, the shape of the groove 620 may define one motions necessary to remove the lid 610 from the base 602, as described further herein. In some examples, the groove 620 may have a square cross-section, a rectangular cross-section, or any other shape cross-section.

Figure 6A:
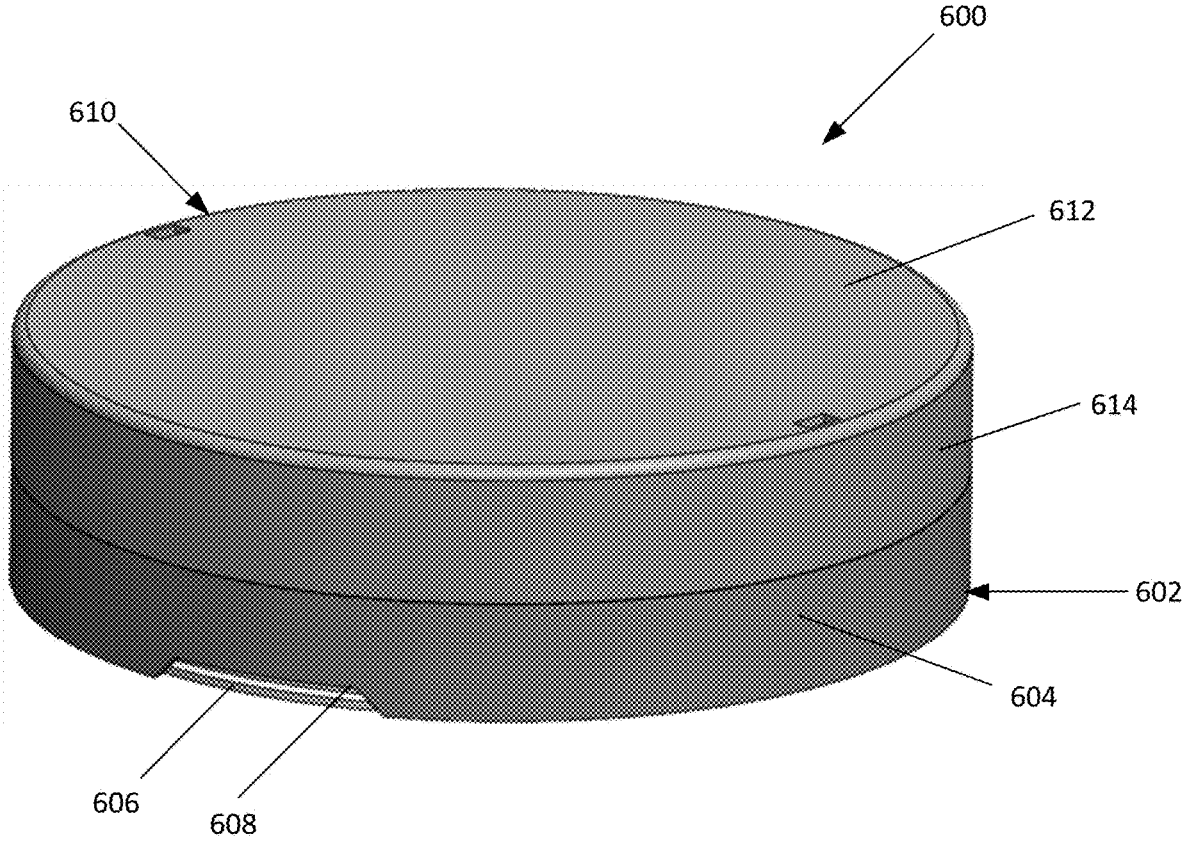
FIG. 6A illustrates a child-resistant can in accordance with one embodiment.
Figure 6B:
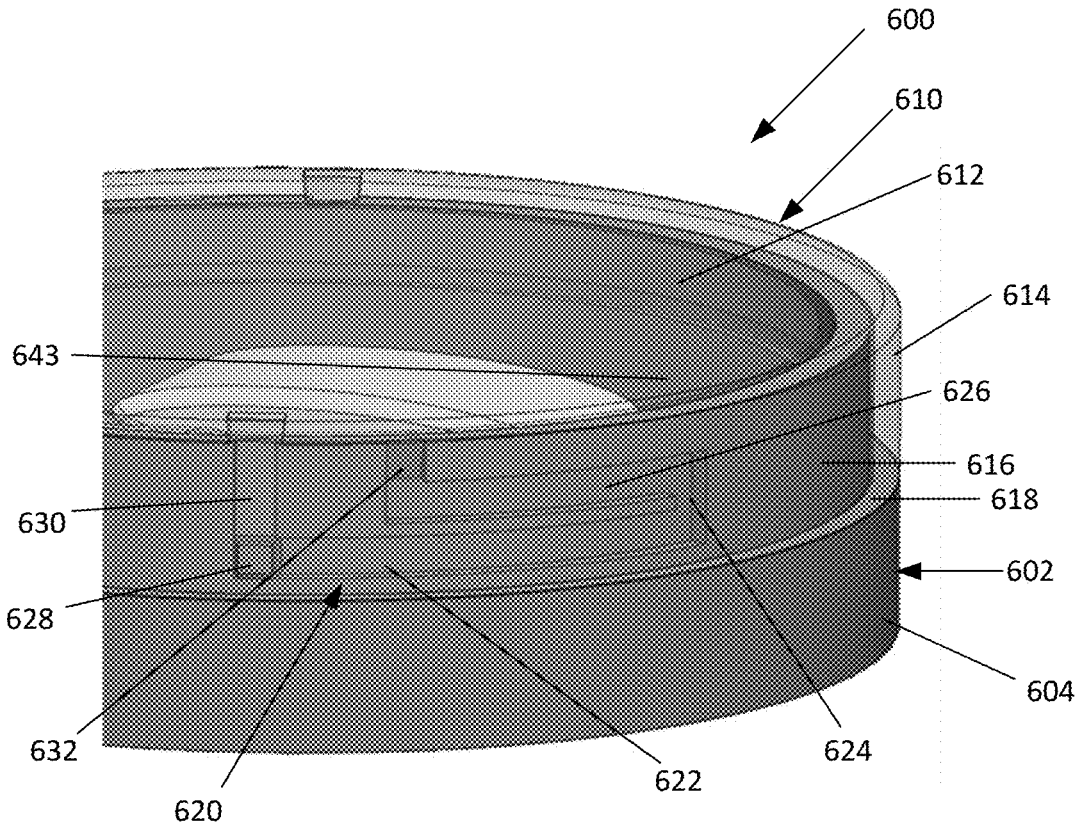
FIG. 6B illustrates a child-resistant can in accordance with one embodiment.

In some examples, as illustrated in FIG. 6B, the groove 620 may include at least a first portion 622, a second portion 624, and a third portion 626. In some examples, the first portion 622, the second portion 624, and the third portion 626 may extend from one another in different directions. For example, the first portion 622 may connect to the second portion 624 at an angle. The second portion 624 may connect to the third portion 626 at an angle. In some examples, the angles between the first portion 622 and the second portion 624 and the second portion and the third portion 626 may be about 90 degrees. In some examples, the angles may be about 10 degrees to about 20 degrees, about 20 degrees to about 30 degrees, about 30 degrees to about 40 degrees, about 40 degrees to about 50 degrees, about 50 degrees to about 60 degrees, about 60 degrees to about 70 degrees, about 70 degrees to about 80 degrees, about 80 degrees to about 90 degrees, about 90 degrees to about 100 degrees, about 100 degrees to about 110 degrees, about 110 degrees to about 120 degrees, about 120 degrees to about 130 degrees, about 130 degrees to about 140 degrees, about 140 degrees to about 150 degrees, about 150 degrees to about 160 degrees, or any combination therein. In some examples, the first portion 622 may extend horizontally along the base circumferential wall 616. In some examples, the second portion 624 may extend vertically along the base circumferential wall 616. In some examples, the third portion 626 may extend horizontally along the base circumferential wall 616. In other examples, the first portion 622, the second portion 624, and the third portion 626 may extend along the base circumferential wall 616 in other directions. While a first portion 622, a second portion 624, and a third portion 626 are described, it will be appreciated that the groove 620 may include more than three portions.

In some examples, the groove 620 may further include an inlet portion 630. In some examples, the inlet portion 630 may be connected to the first portion 622. In some examples, the inlet portion 630 may extend vertically along the base circumferential wall 616. The inlet portion 630 may extend from an upper edge (e.g., edge furthest from the bottom plate 604) to the first portion 622. In some examples, the inlet portion 630 may include a snap-fit connector 634. The snap-fit connector 634 may be configured to secure the projection 628 of the lid 610 within the first portion 622 such that the lid cannot be removed via the inlet portion 630. For example, a user may align the projection 628 with the inlet portion 630 and push the lid 610 downwards (e.g., towards the base 602) until the projection 628 is secured by the snap-fit connector 634. In some examples, when the projection 628 is secured by the snap-fit connector 634, an indication may be provided to a user. For example, the projection 628 and snap-fit connector 634 may click when the projection 628 is secured by the snap-fit connector 634, thereby providing audible and/or tactile feedback to a user.

Figure 6C:
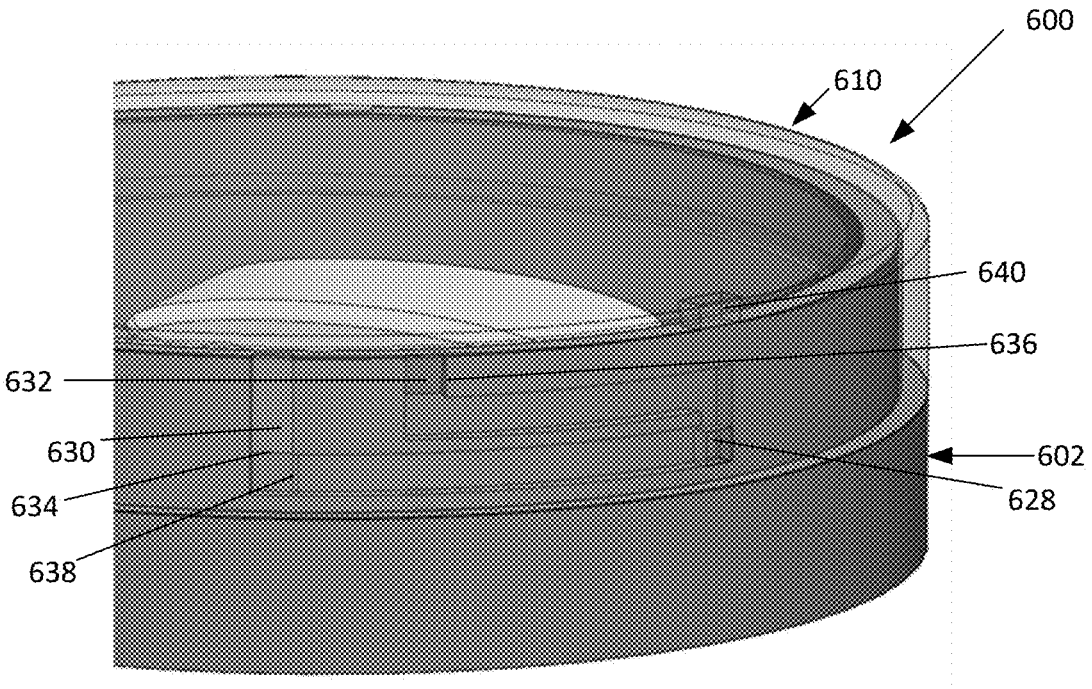
FIG. 6C illustrates a child-resistant can in accordance with one embodiment.
Figure 6D:
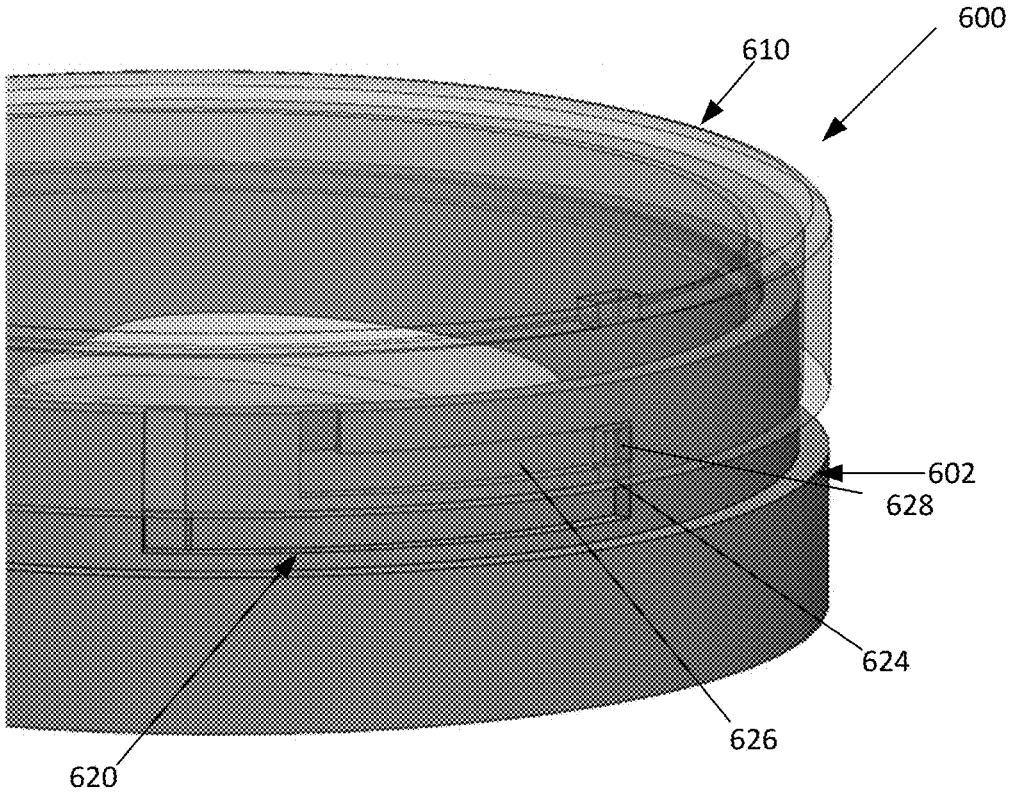
FIG. 6D illustrates a child-resistant can in accordance with one embodiment.
Figure 6E:
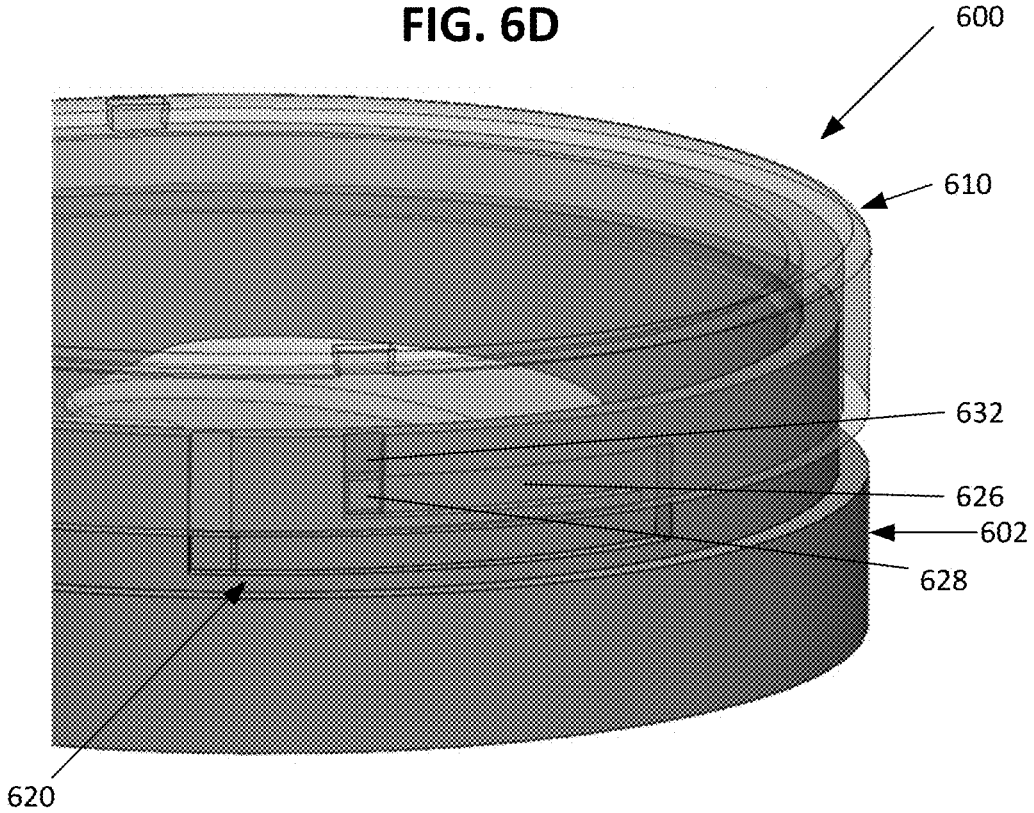
FIG. 6E illustrates a child-resistant can in accordance with one embodiment.
Figure 6F:
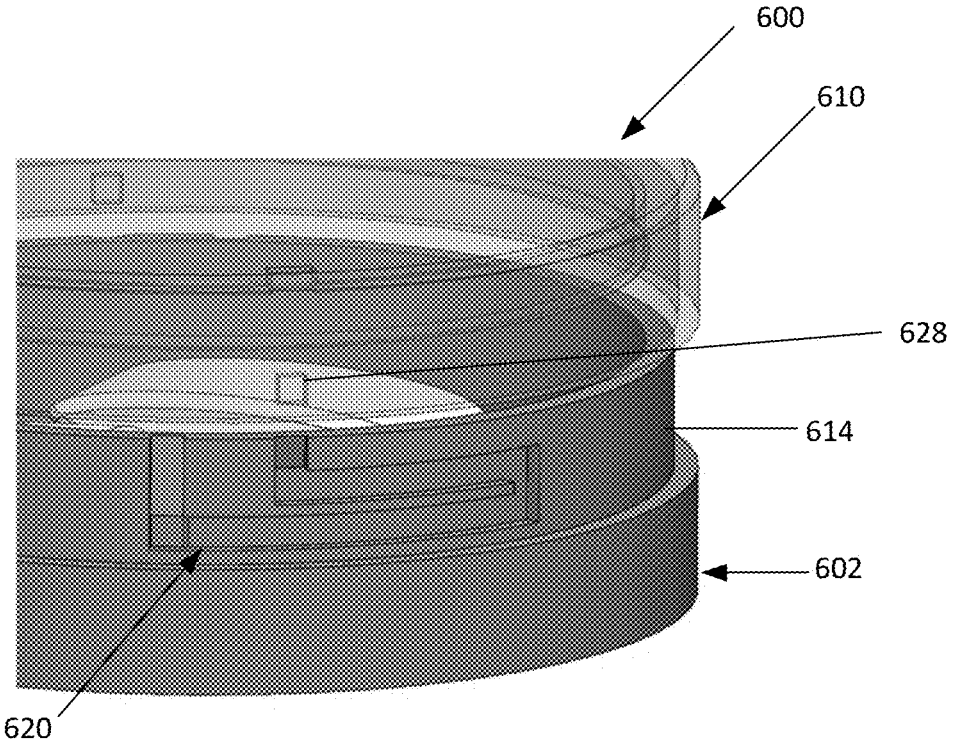
FIG. 6F illustrates a child-resistant can in accordance with one embodiment.
Figure 6G:
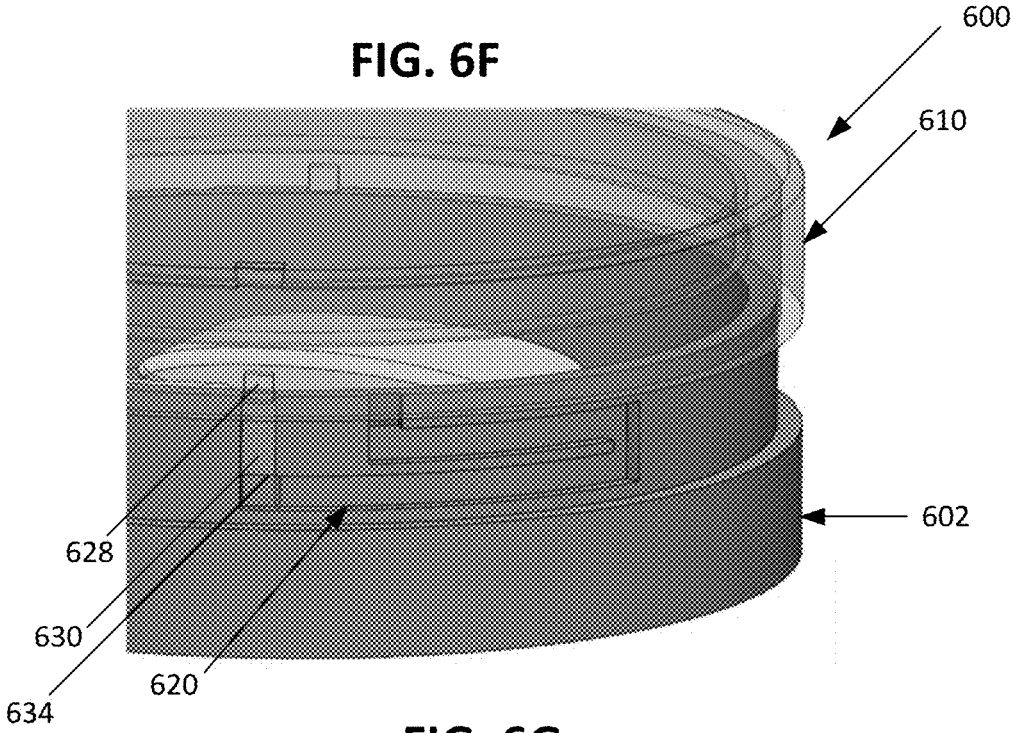
FIG. 6G illustrates a child-resistant can in accordance with one embodiment.
Figure 6H:
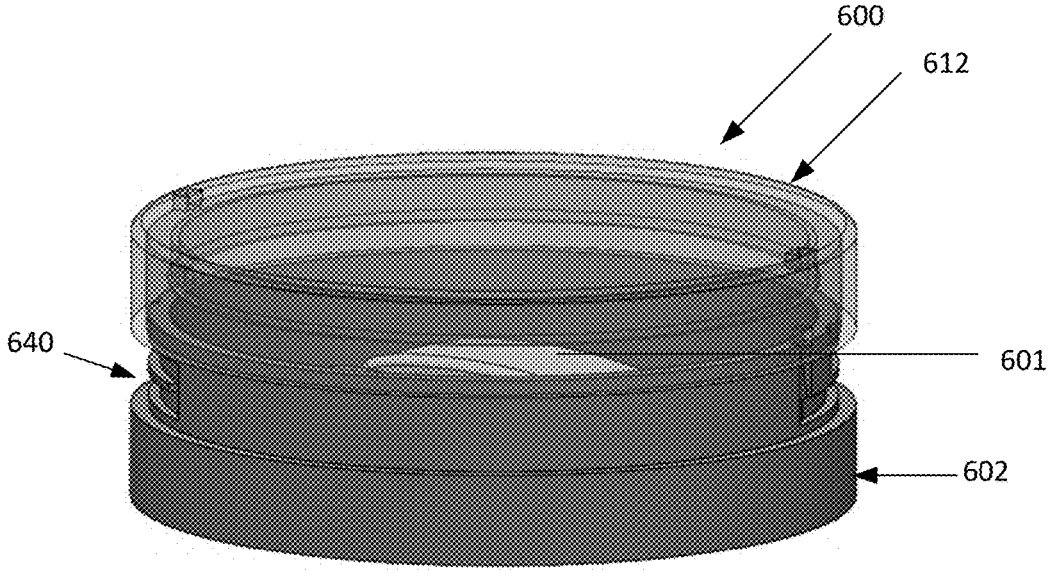
FIG. 6H illustrates a child-resistant can in accordance with one embodiment.
Figure 6I:
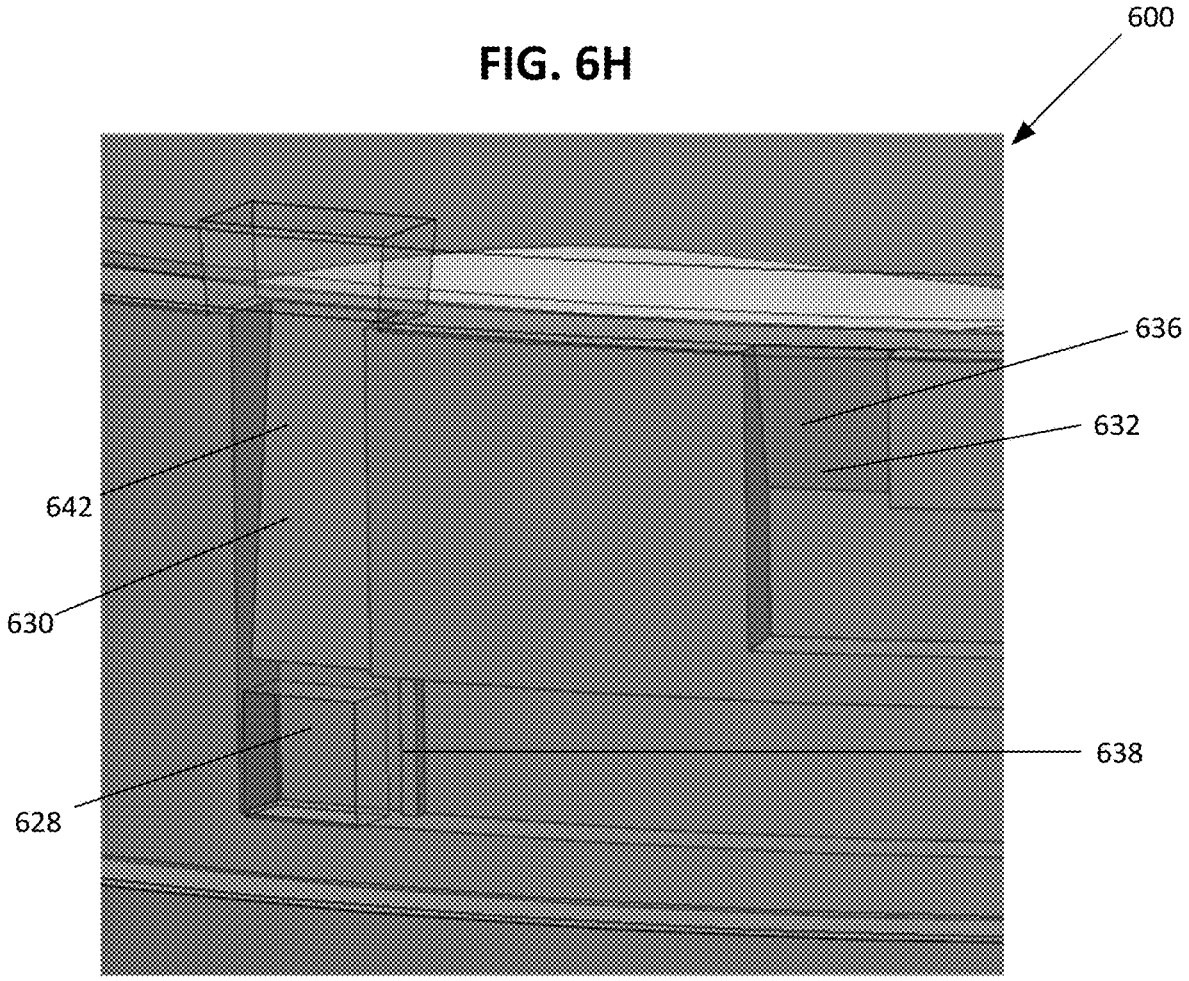
FIG. 6I illustrates a child-resistant can in accordance with one embodiment.

In some examples, the inlet portion 630 may include a chamfered surface 642, as illustrated, for example, in FIG. 6I. The chamfered surface 642 may be configured to guide the projection 628 on lid 610 to the snap-fit connector 634. For example, the chamfered surface 642 may decrease in width and/or depth from the top edge (e.g., the top edge of the base circumferential wall 616) to the bottom edge (e.g., near the snap-fit connector 634 and the first portion 622). In some examples, the chamfered surface 642 can include a depth angle (e.g., angle of depth decrease from top edge to bottom edge). In some examples, the depth angle can be about 60 degrees to about 85 degrees. In some examples, the width of the inlet portion 630 can also include a chamfered surface. For example, the width of the inlet portion 630 can decrease from the top edge (e.g., the top edge of the base circumferential wall 616) to the bottom edge (e.g., near the snap-fit connector 634 and the first portion 622). In some examples, the bottom edge (e.g., near the first portion 622) of the chamfered surface 642 can define the snap-fit connector 634 (e.g., the bottom edge of the chamfered surface 642 is raised in relation to first portion 622 such that the projection 628 snaps into the first portion 622). In some examples, the chamfered surface 642 of the inlet portion 630 prevents a user from removing the lid 610 by preventing translation of the projection 628 upward through the inlet portion 630.

In some examples, the first portion 622 may include a lip 638. The lip 638 may provide resistance to translation of the projection 628 along the first portion 622. For example, the lip 638 may provide resistance such that a child would be unable to provide sufficient force to move the projection 628 over the lip 638. In some examples, the lip 638 may extend outward from the first portion 622 at a length less than the depth of the first portion 622. For example, the lip 638 may extend outward from the first portion at a length of about 1% to about 10% of the depth of the first portion.

In some examples, the groove 620 may further include an outlet portion 632. The outlet portion 632 may be connected to the third portion 626. In some examples, the outlet portion 632 may allow a user to remove the lid 610 from the base by translating the projection through the outlet portion 632.

In some examples, the outlet portion 632 may include a chamfered surface 636, as illustrated, for example, in FIG. 6I. In some examples, the chamfered surface 636 may be configured to provide resistance to removing the lid 610 from the base 602. For example, the chamfered surface can decrease in width and/or depth from a bottom edge (e.g., nearest the third portion 626) to a top edge (e.g., edge of the base circumferential wall 616 furthest from the bottom plate 604). In some examples, the chamfered surface 636 may include a depth angle (e.g., an angle of depth decrease from the bottom edge to the top edge). In some examples, the depth angle can be about 60 degrees to about 85 degrees. In some examples, the width of the outlet portion 632 can also be chamfered. For example, the width of the outlet portion can decrease from the bottom edge of the outlet portion 632 (e.g., nearest the third portion 626) to the top edge of the outlet portion 632 (e.g., edge of the base circumferential wall furthest from the bottom plate 604). In some examples, the chamfered surface of the 636 may prevent a user from improperly inserting the projection 628 into the outlet portion 632. For example, the outlet portion 632 may have insufficient depth to receive the projection 628 at the top edge of the outlet portion 632.

In some examples, the first portion 622, the second portion 624, and the third portion 626 may have a depth. In some examples, the depth of the first portion 622, the second portion 624 and the third portion 626 may be about 0.8 millimeters (mm) to about 5 mm, about 1 mm to about 5 mm, about 2 mm to about 3 mm, or about 2 mm, or any combination therein. According to one example, as shown in FIG. 6N, the depth of the groove may be about 1.2 mm. In some examples, the first portion 622, the second portion 624, and the third portion 626 may have a width. The width of the first portion 622, the second portion 624, and the third portion 626 may be about 1 mm to about 5 mm, about 2 mm to about 3 mm, or about 2 mm, or any combination therein.

Figure 6J:
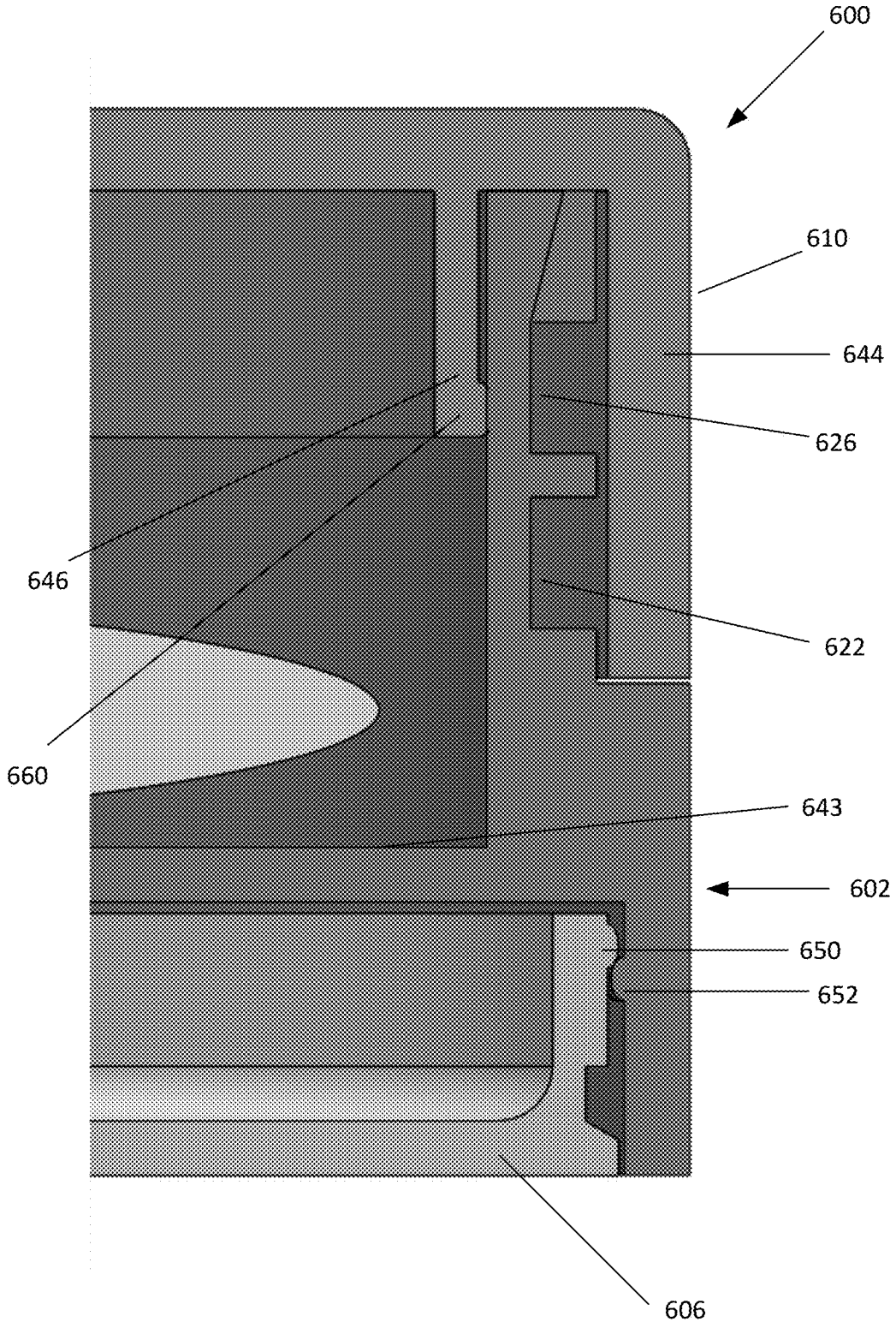
FIG. 6J illustrates a cross-section of a child-resistant can in accordance with one embodiment.
Figure 6K:
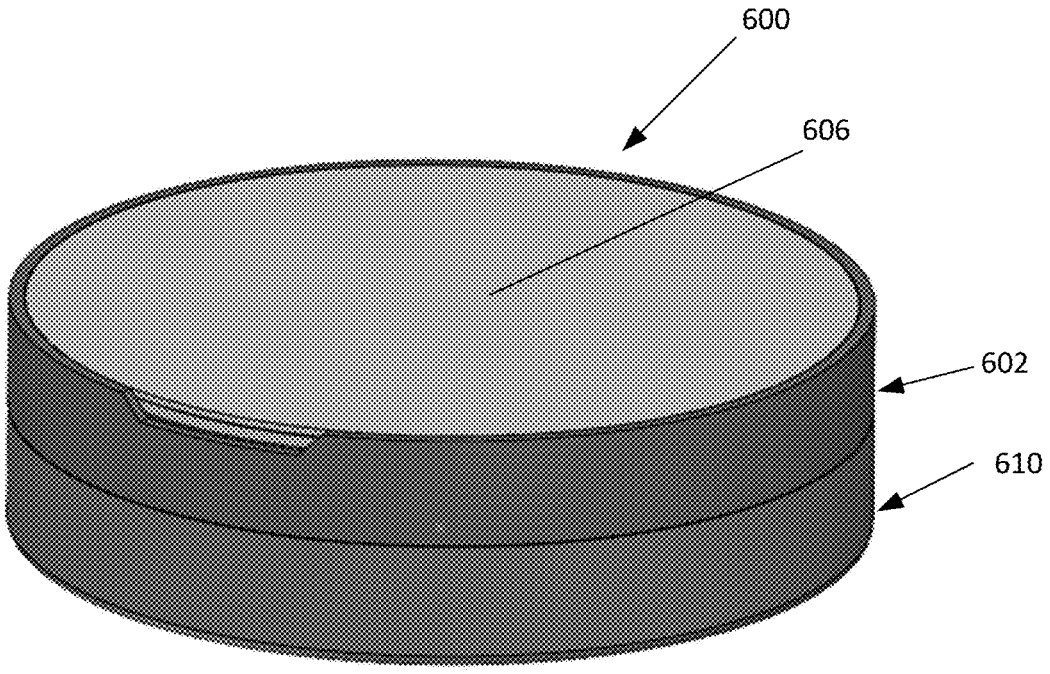
FIG. 6K illustrates a child-resistant can in accordance with one embodiment.
Figure 6L:
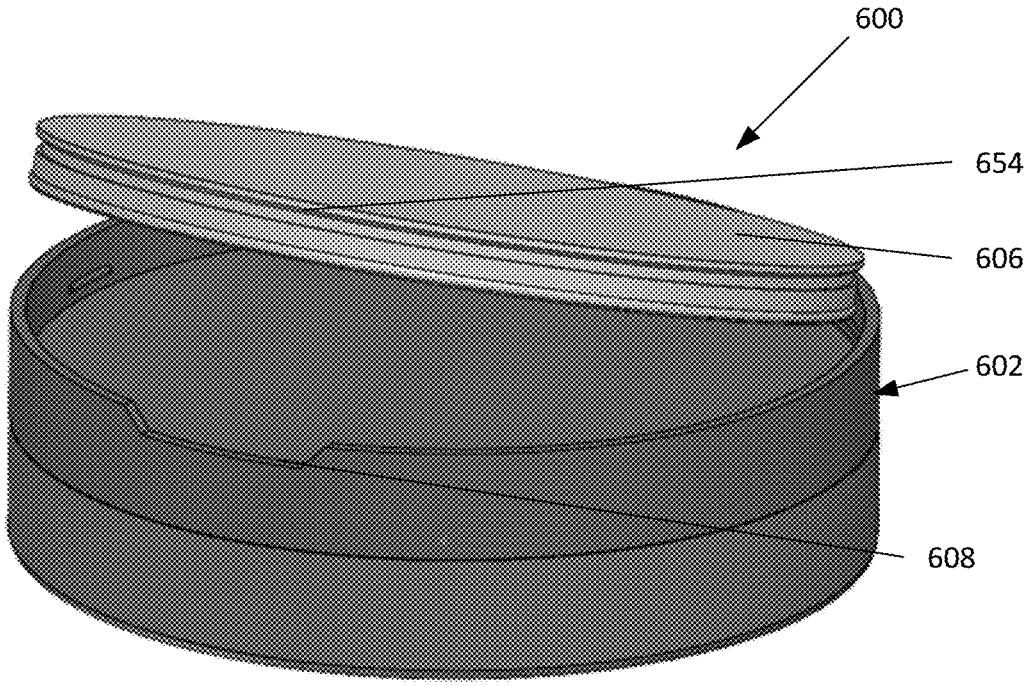
FIG. 6L illustrates a child-resistant can in accordance with one embodiment.
Figure 6M:
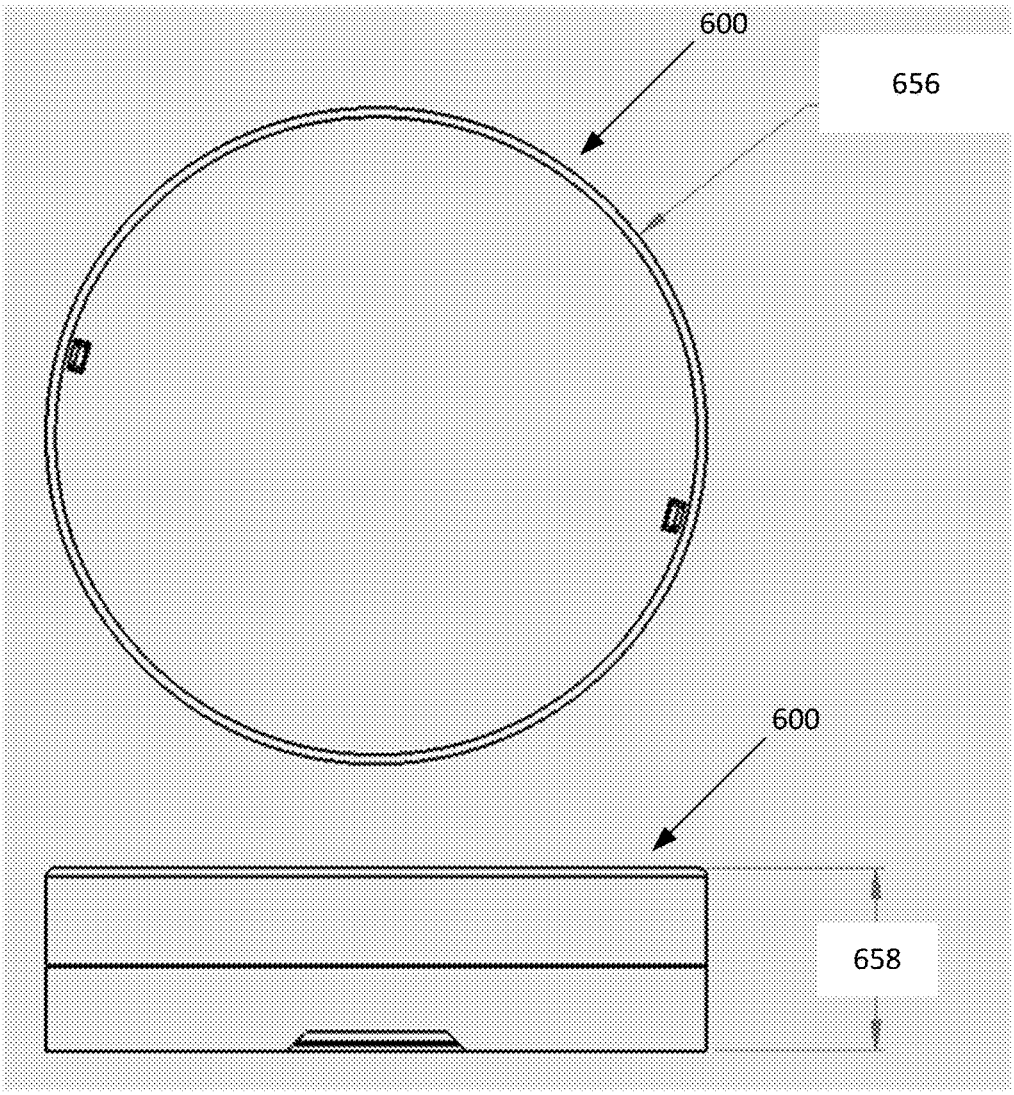
FIG. 6M illustrates a child-resistant can in accordance with one embodiment.
Figure 6N:
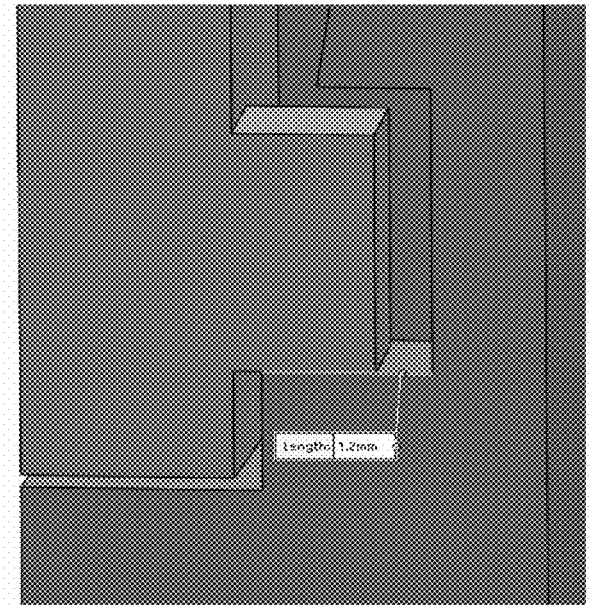
FIG. 6N illustrates a portion of a child-resistant can in accordance with one embodiment.
Figure 6O:
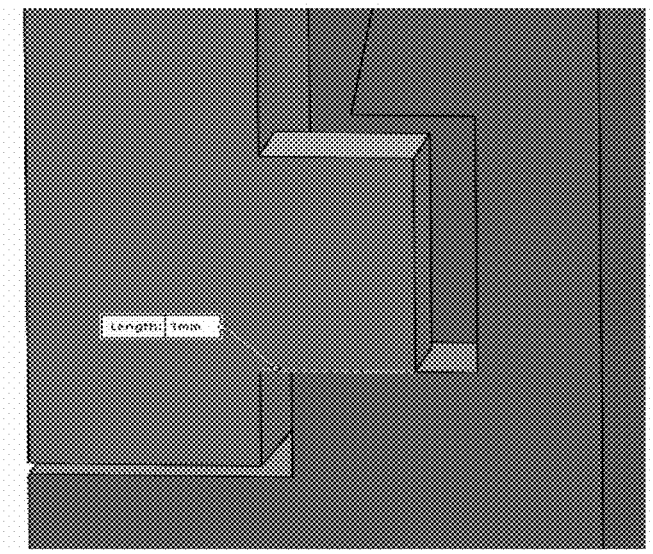
FIG. 6O illustrates a portion of a child-resistant can in accordance with one embodiment.
Figure 6P:
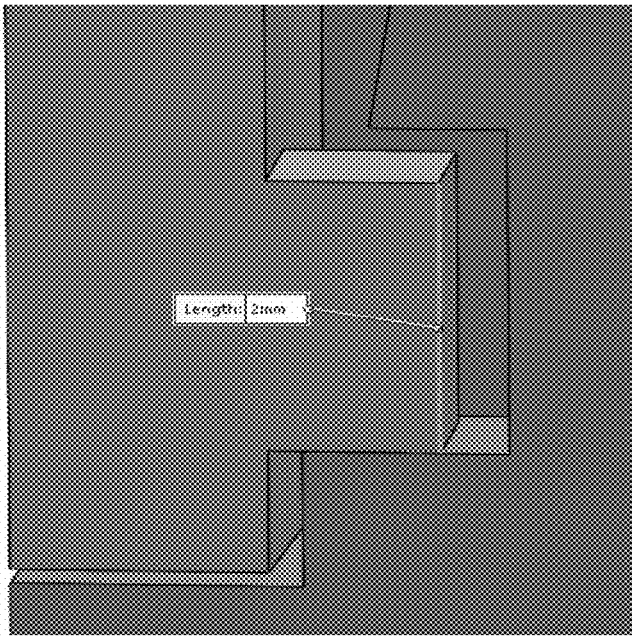
FIG. 6P illustrates a portion of a child-resistant can in accordance with one embodiment.
Figure 6Q:
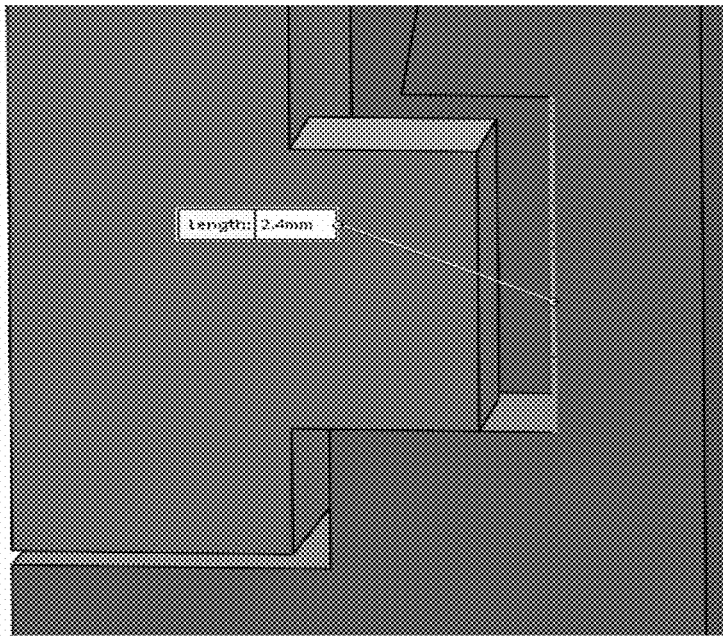
FIG. 6Q illustrates a portion of a child-resistant can in accordance with one embodiment.

According to one example, as shown in FIG. 6Q, the width of the groove may be about 2.4 mm.

As illustrated in FIG. 6N and FIG. 6O, the depth of the groove may be greater than a height of the projection. For example, the projection may have a height (i.e., the extent to which it protrudes from the lid circumferential wall 614) of 0.25 mm to 2 mm, 0.5 mm to 1.5 mm, 0.75 mm to 1.25 mm, or any combination therein. The depth of the groove may be at least 5%, at least 10%, at least 15%, or at least 20% greater than the height of the projection, and no greater than 30%, no greater than 25%, or no greater than 20% larger than the height of the projection.

As illustrated in FIG. 6P and FIG. 6Q, the width of the groove may be greater than a width of the projection. For example, the projection may have a width (i.e., the largest dimension of the face parallel to the lid circumferential wall) of 0.5 mm to 3.5 mm, 1 mm to 3 mm, 1.5 mm to 2.5 mm, about 2 mm, or any combination therein. The width of the groove may be at least 10%, at least 20%, at least 30%, or at least 40% greater than the width of the projection, and no greater than 40%, no greater than 45%, or no greater than 50% larger than the width of the projection.

FIG. 6A illustrates the child-resistant can 600 with the lid 610 secured to the base 602. FIG. 6B illustrates a first step in removing the lid 610 from the base 602. As illustrated in FIG. 6B the lid 610 is secured to the base 602 when the projection 628 is in the first portion 622 (e.g., the projection 628 is secured in position by the snap-fit connector 634 such that the projection cannot translate upward through the inlet portion 630 and is further secured by the lip 638). To begin removing the lid 610 from the base 602, a user may first rotate the lid 610 such that the projection 628 overcomes the resistance of the lip 638. FIG. 6C illustrates the child-resistant can 600 at a second step after the projection 628 the resistance of the lip 638 and the lid 610 has been rotated (e.g., counterclockwise) such that the projection is at the connection of the first portion 622 to the second portion 624. Next, a user may translate the projection 628 along the second portion 624. For example, a user may lift the lid 610 upwards, thereby translating the projection 628 along the second portion 624 and to the connection between the second portion 624 and the third portion 626. FIG. 6D illustrates the child-resistant can 600 at the connection of the second portion 624 and the third portion 626 (e.g., the user has lifted the lid 610).

A user may then rotate the lid 610 (e.g., clockwise) such that the projection 628 translates along the third portion 626. FIG. 6E illustrates the child-resistant can 600 after the projection 628 has been translated along the third portion 626. The user may then lift the lid 610 such that the projection 628 translates along the outlet portion 632. Once the projection 628 reaches the top edge of the outlet portion 632, the projection 628 is lifted out of the groove 620 and the lid is removed from the base 602.

FIG. 6G illustrates the lid 610 being recoupled to the base 602. To recouple the lid 610 to the base 602, a user may align the projection 628 with the inlet portion 630. A user may then press the lid 610 downwards towards the base 602, thereby causing the projection to translate through the inlet portion 630 until the projection snaps into the snap-fit connector 634.

While a single projection 628 and groove 620 are described, it will be appreciated that the child-resistant can 600 may include multiple projections 628 and multiple corresponding grooves 620. For example, the child-resistant can 600 may include at least two projections 628 and at least two corresponding grooves 620, 640, as illustrated, for example, in FIG. 6H. In some examples, the at least two projections 628 may be equally spaced from one another about the lid circumferential wall 614. In some examples, the at least two corresponding grooves 620 may be equally spaced from one another about the lid circumferential wall 614.

FIG. 6J illustrates a cross-section of the child-resistant can 600. As illustrated, the lid circumferential wall 614 can include two portions configured to surround the base circumferential wall 616. For example, the lid circumferential wall 614 may include an outer wall 644 and an inner wall 646. In some examples, the inner wall 646 may include a sealing ring 660. The sealing ring 660 may be operable to abut against an interior surface of the base circumferential wall 616. In some examples, the sealing ring 660 may be operable to seal the cavity defined by the lid 610, the interior surface 643, and the base circumferential wall 616 such that the one or more products 601 contained within the cavity remain fresh, minimize air and bacterial ingress, by maintaining a vapor moisture barrier.

The child-resistant can 600 may further include a catch lid 606, as illustrated, for example, in FIG. 6J to FIG. 6L. In some examples, the catch lid 606 may be secured to a bottom of the base 602 (e.g., secured to an opposite side of the base from the lid 610). In some examples, the catch lid 606 may include a projection 650 configured to interface with a projection 652 of the base 602 to secure the catch lid 606 to the base 602, as illustrated, for example, in FIG. 6J. In some examples, a cavity may be defined between the catch lid 606 and the bottom of the base 602. The cavity may be operable to hold objects (e.g., used products). In some examples, the catch lid 606 may include a lip 654. The base 602 may include an opening 608. In some examples, a user may remove the catch lid 606 from the base 602 by pulling the lip 654 out of the opening 608.

In some examples, as illustrated in FIG. 6M, the child-resistant can 600 may have a diameter 656. In some examples, the diameter 656 may be about 50 mm to about 100 mm. In some examples, the diameter 656 may be about 50 mm to about 60 mm, about 60 mm to about 70 mm, about 70 mm to about 80 mm, about 80 mm to about 90 mm, or about 90 mm to about 100 mm. In some examples, the child-resistant can 600 may include a height 658. In some examples, the height 658 may be about 10 mm to about 30 mm. In some examples, the height 658 may be about 10 mm to about 15 mm, about 15 mm to about 20 mm, about 20 mm to about 25 mm, or about 25 mm to about 30 mm.

FIG. 7A to FIG. 7I illustrate an embodiment of a child-resistant can 700. The child-resistant can 700. The child-resistant can 700 may include one or more safety mechanisms operable to prevent a child from opening the child-resistant can 700. For example, the child-resistant can 700 may include a dexterity and coordination safety mechanism. In this manner, children are prevented from opening the child-resistant can 700.

Figure 7A:
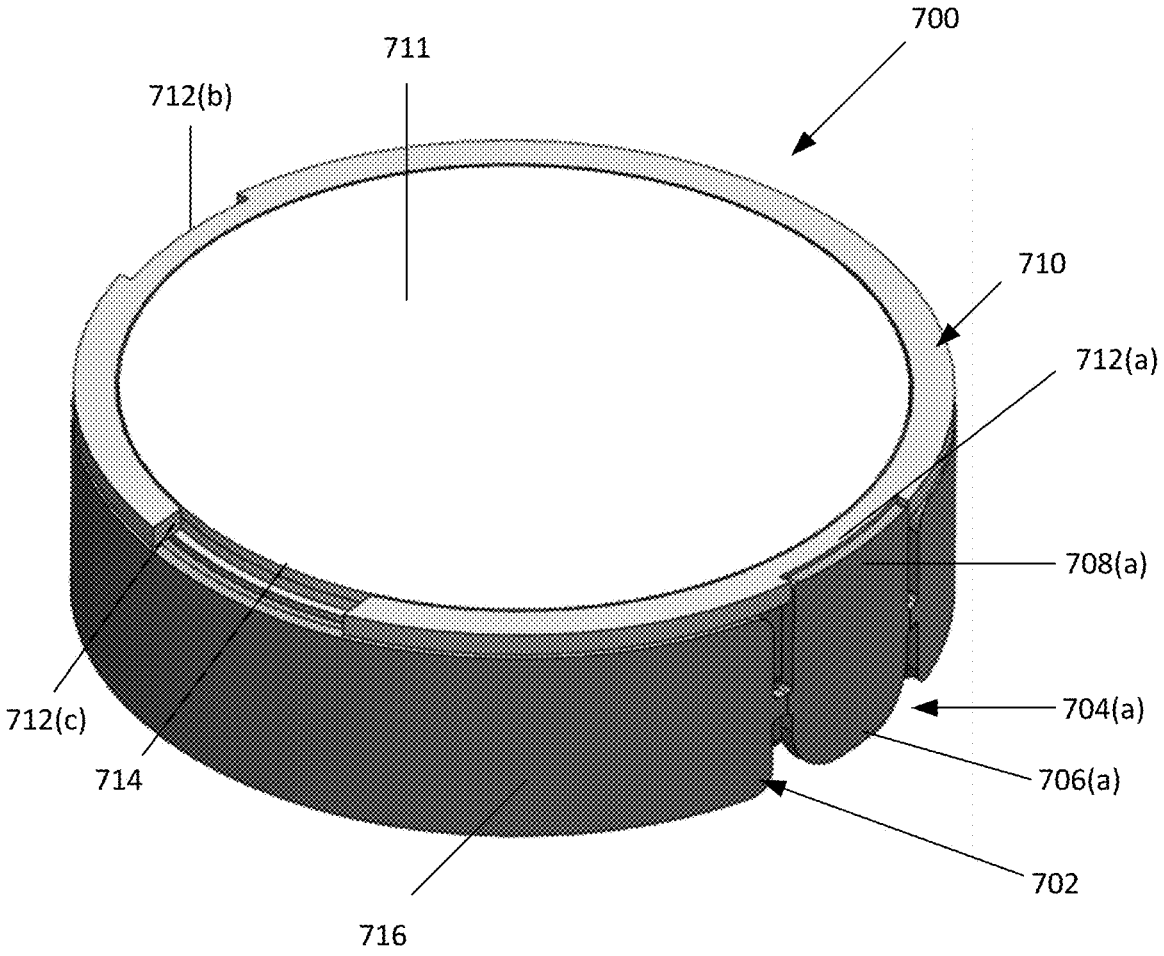
FIG. 7A illustrates a child-resistant can in accordance with one embodiment.
Figure 7B:
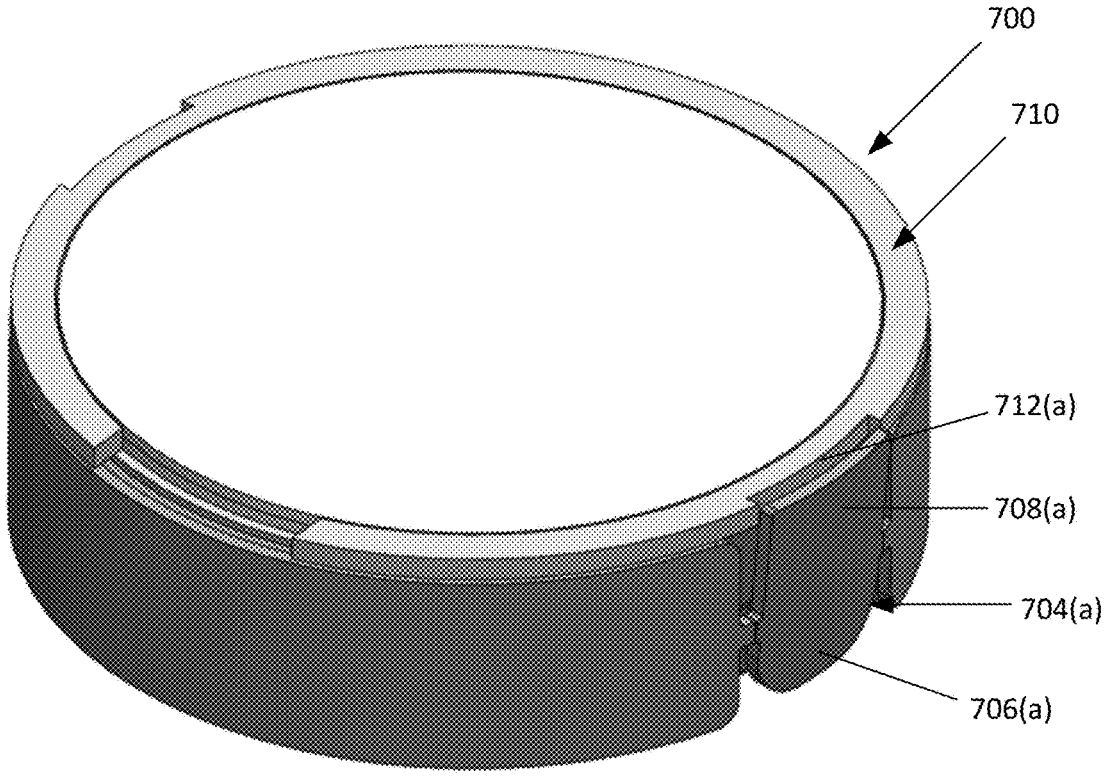
FIG. 7B illustrates a child-resistant can in accordance with one embodiment.
Figure 7C:
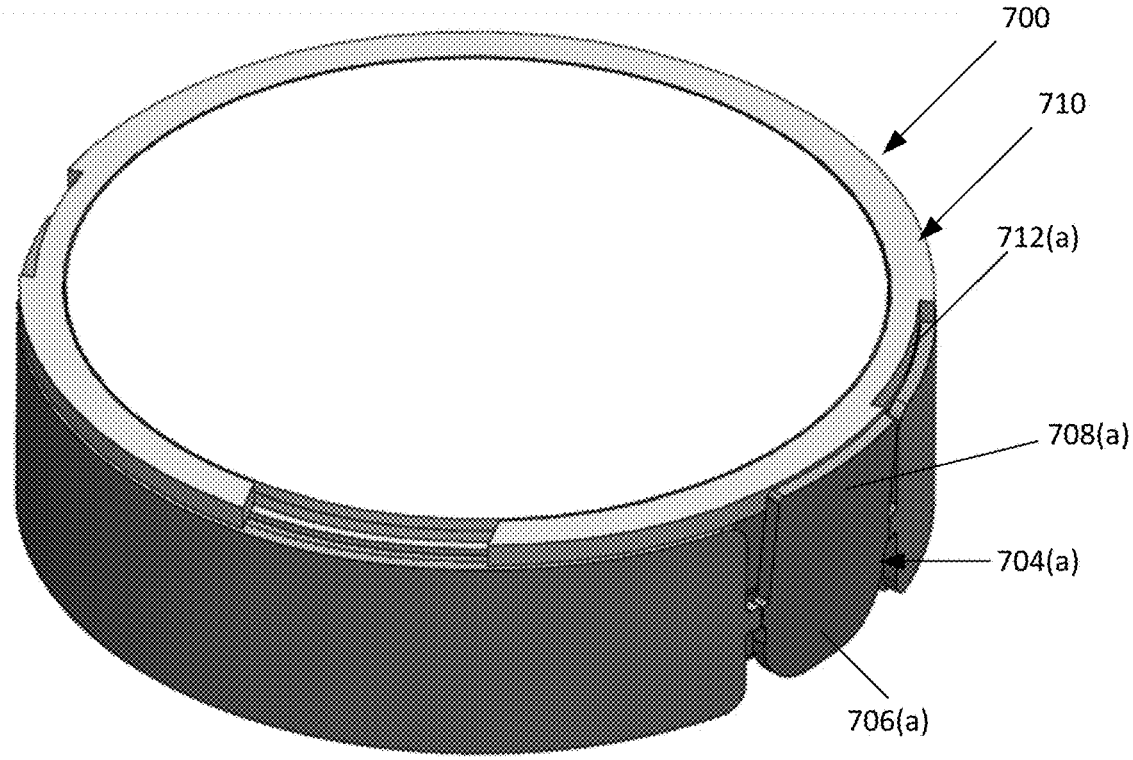
FIG. 7C illustrates a child-resistant can in accordance with one embodiment.
Figure 7D:
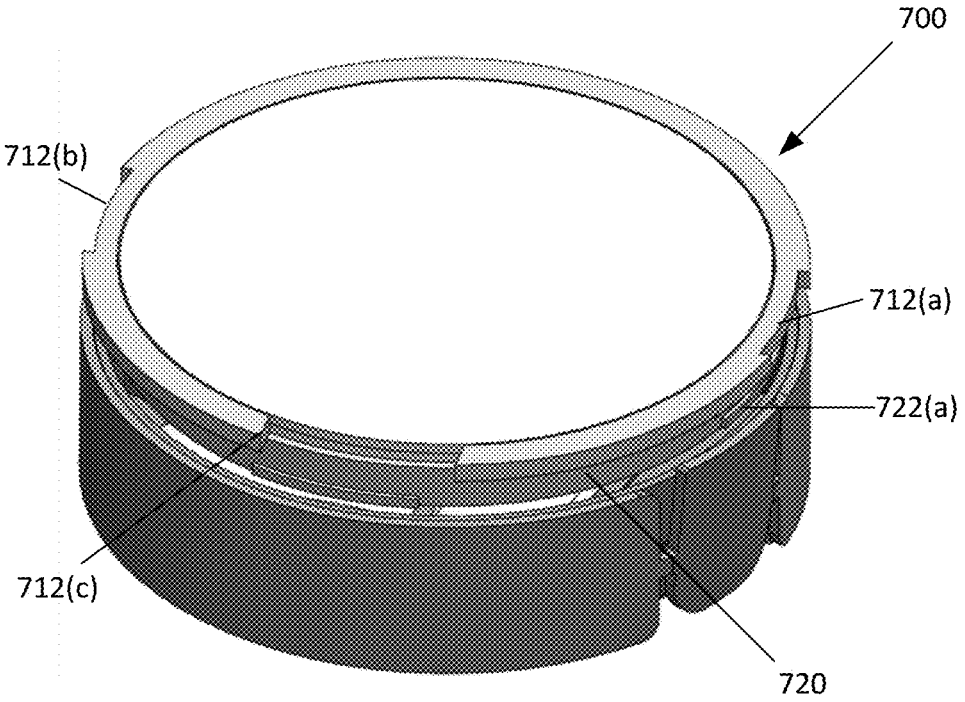
FIG. 7D illustrates a child-resistant can in accordance with one embodiment.

The child-resistant can 700 may include a base 702 and a lid 710. The base 702 may include a bottom plate 730 and a base circumferential wall 716. In some instances, the base circumferential wall 716 may include an inner wall 716(*a*) and an outer wall 716(*b*), as illustrated in FIG. 7H. The base circumferential wall 716 may extend from the bottom plate 730. In some examples, the base circumferential wall 716 and the bottom plate may define an interior surface 728. The interior surface 728 may be operable to receive one or more objects (e.g., products described herein). In some examples, when the lid 710 is coupled to the base 702, a cavity for containing one or more objects may be defined by the lid 710, the interior surface 728, and the base circumferential wall 716.

The lid 710 may include a top plate 701 and a lid circumferential wall 720. The lid 710 may be operable to enclose the interior surface 728. The lid circumferential wall 720 may extend from the top plate 701. In some examples, the lid circumferential wall 720 may extend in two directions (e.g., upwards and downwards) from the top plate 701. The lid circumferential wall 720 may be configured to abut against the base circumferential wall 716. In some examples, the lid circumferential wall 720 may include at least two indents 712(*a*), 712(*b*), such as at least 3 indents, at least 4 indents, and no more than 6 indents, no more than 5 indents, etc. In some examples, the lid circumferential wall 720 may include at least two lid projections 722(*a*) (one bottom projection not shown). In some examples, the at least two lid projections 722(*a*) may be vertically aligned with the at least two indents 712(*a*), 712(*b*).

In some examples, the base circumferential wall 716 include at least two snap-fit connectors 704(*a*), 704(*b*). In some instance, the snap-fit connectors may be included in the outer wall 716(*b*). The at least two snap-fit connectors 704(*a*), 704(*b*) may each include a lower actuator portion 706(*a*), 706(*b*) and an upper portion 708(*a*), 708(*b*), with a horizontal rotational axis being disposed between the actuator portion and the upper portion. The upper portion 708(*a*), 708(*b*) may be operable to couple to or engage with (e.g., snap in place into) the at least two indents 712(*a*), 712(*b*). The lower actuator portion 706(*a*), 706(*b*) may be operable to be pushed inward towards a respective cavity 726(*a*), 726(*b*). According to some embodiments, the cavity 726(*a*), 726(*b*) may be included in the inner wall 716(*a*). When the lower actuator portion 706(*a*), 706(*b*) is pushed inward, the actuator portion and the upper portion may rotate around the rotational axis such that the upper portion 708(*a*), 708(*b*) may disengage from the indents 712(*a*), 712(*b*) of the lid 710. According to some embodiments, the rotational axis may be formed continuously with the actuator portion and the upper portion and/or may be formed of the same material. In some embodiments, the rotational axis may be formed of a different material (i.e., that is either more pliable or more rigid) than the actuator portion and/or the upper portion. In some embodiments, rotation axis may include a pin, rod, or hinge around which the upper portion and the actuator portion may rotate. In some instances, the pin or rod may be disposed within a channel running horizontally between the actuator portion and the upper portion, where the actuator portion and the upper portion are formed as a continuous piece.

Figure 7E:
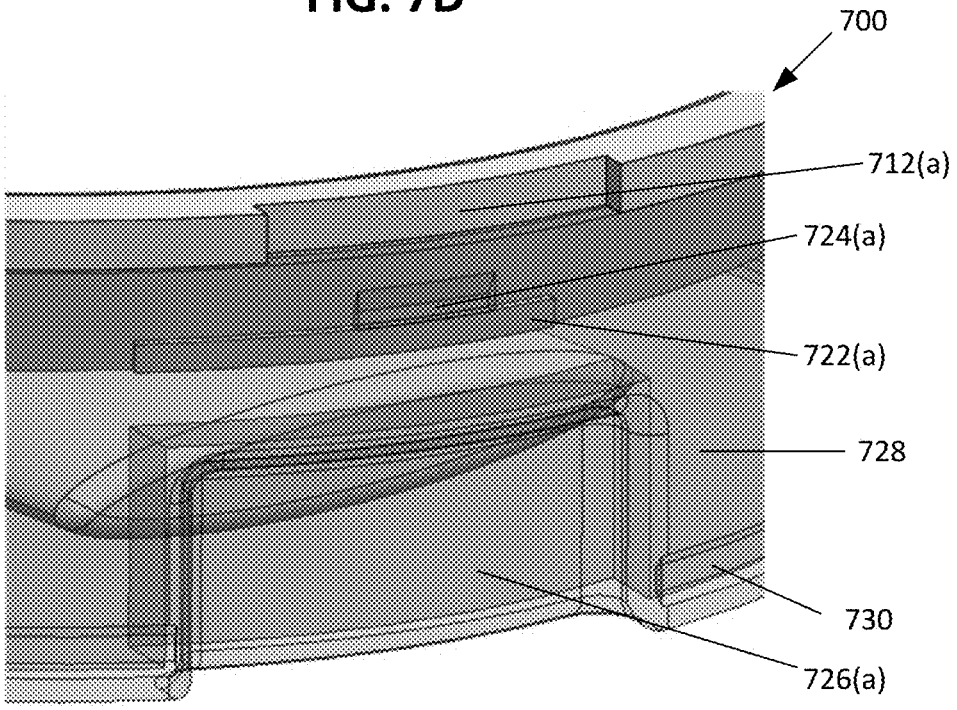
FIG. 7E illustrates a portion of a child-resistant can in accordance with one embodiment.
Figure 7F:
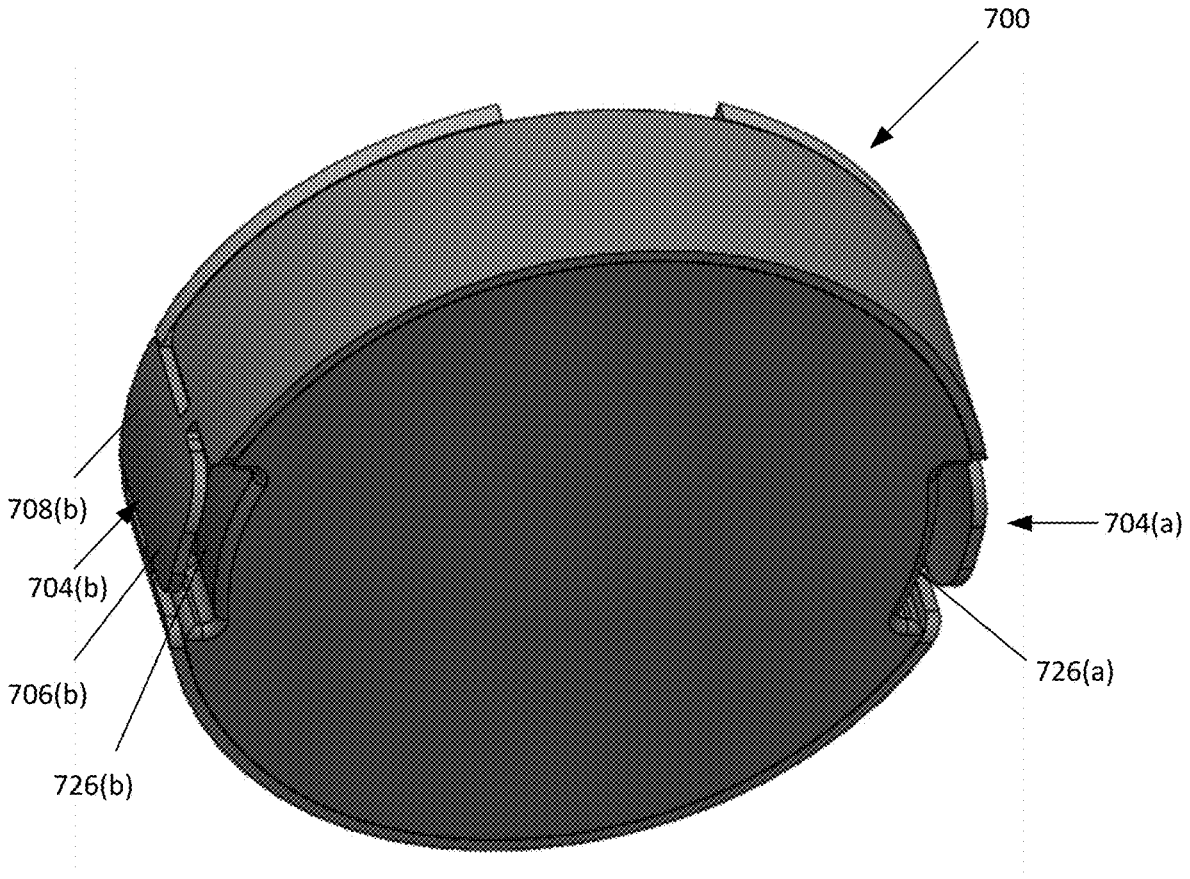
FIG. 7F illustrates a child-resistant can in accordance with one embodiment.
Figure 7G:
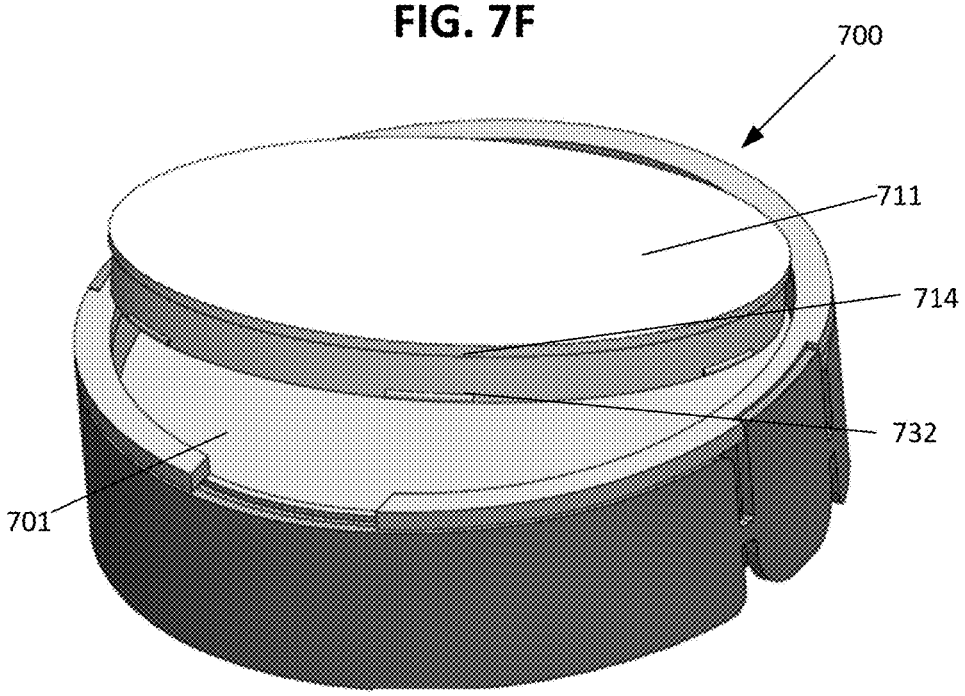
FIG. 7G illustrates a child-resistant can in accordance with one embodiment.
Figure 7H:
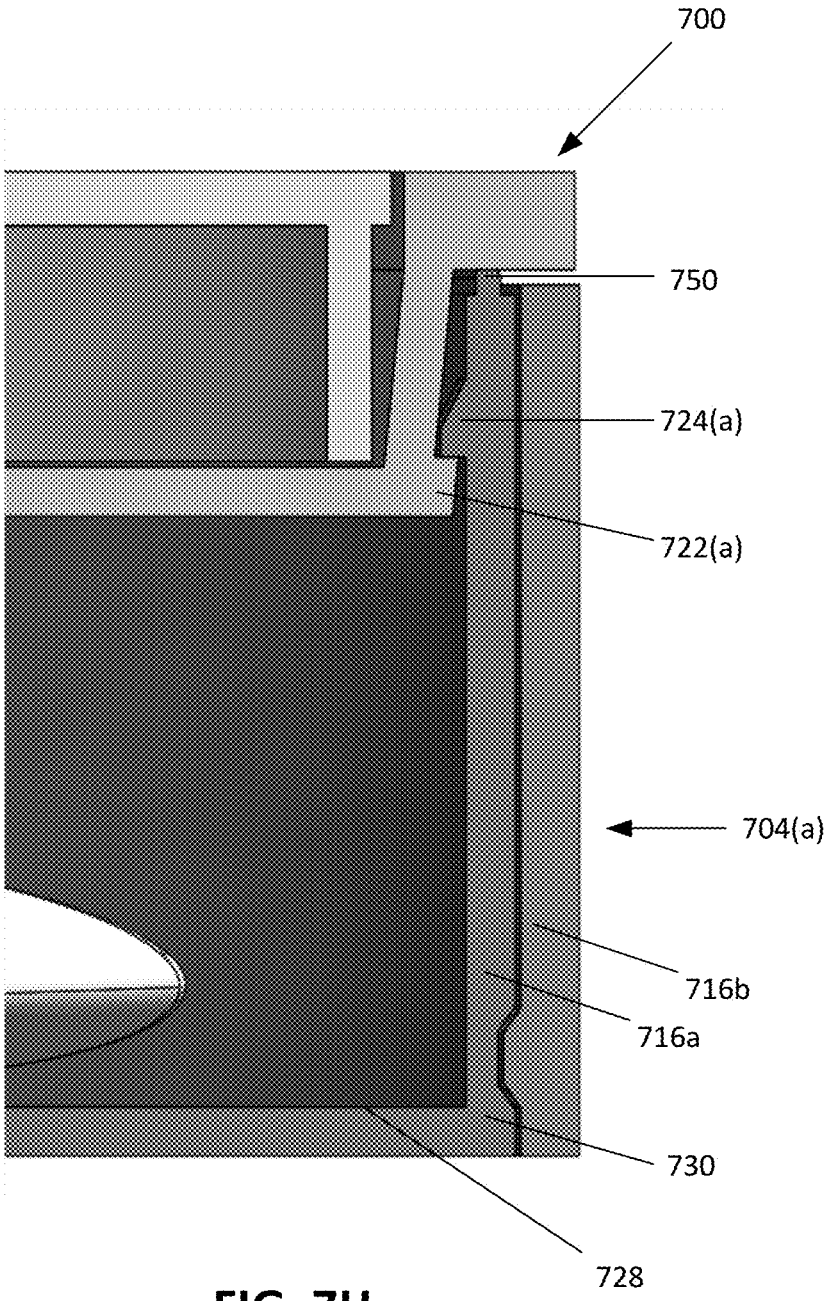
FIG. 7H illustrates a child-resistant can in accordance with one embodiment.
Figure 7I:
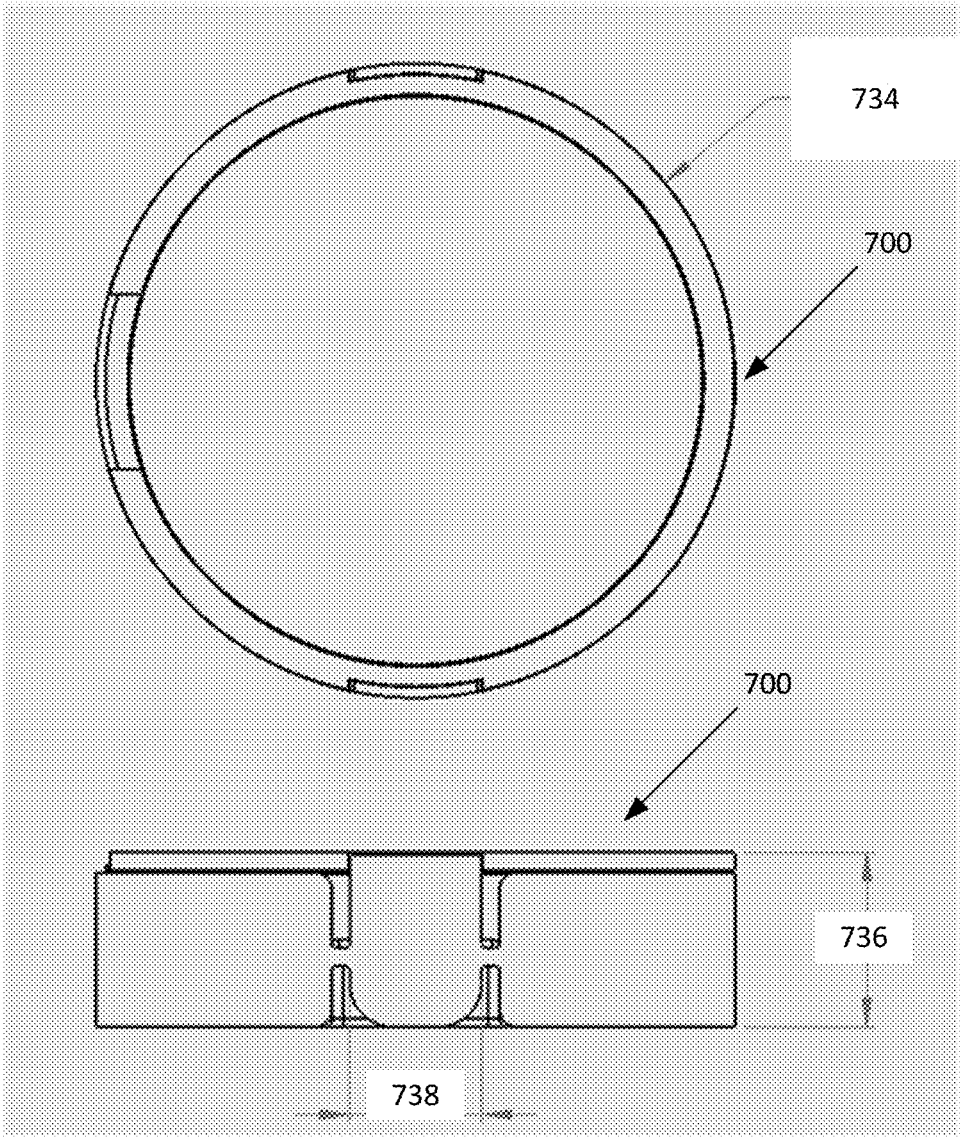
FIG. 7I illustrates a child-resistant can in accordance with one embodiment.

The base circumferential wall 716 may include an inner wall 716*a* and an outer wall 716*b*, and at least two base projections 724(*a*) (one projection not shown), as illustrated in FIG. 7E and FIG. 7H. The at least two base projections 724(*a*) may be operable to abut against an upper surface of the at least two lid projections 722(*a*). The at least two base projections 724(*a*) may be configured to prevent the lid from simply lifting up and off of the base 702 when the upper portions 708(*a*), 708(*b*) are disengaged from the indents 712(*a*), 712(*b*). For example, the lid 710 may not be removed from the base 702 until the upper portions 708(*a*), 708(*b*) are disengaged from the indents 712(*a*), 712(*b*) and the lid 710 is rotated such that the at least two base projections 724(*a*) are no longer in contact with the at least two lid projections 722(*a*).

FIG. 7A illustrates the lid 710 coupled to the base 702. As illustrated, the upper portions 708(*a*), 708(*b*) are engaged with the indents 712(*a*), 712(*b*). To remove the lid 710 from the base 702, a user may first press in on the lower actuator 706(*a*), 706(*b*) of the at least two snap-fit connectors 704(*a*), 704(*b*), as illustrated in FIG. 7B. When the lower actuator 706(*a*), 706(*b*) of the at least two snap-fit connectors 704(*a*), 704(*b*) are pressed inward, the upper portion 708(*a*), 708(*b*) of the at least two snap-fit connectors 704(*a*), 704(*b*) are disengaged from the at least two indents 712(*a*), 712(*b*). The lid 710 may then be rotated, as illustrated in FIG. 7C, by a user to disengage the at least two base projections 724(*a*) from the at least two lid projections 722(*a*). Once the at least two base projections 724(*a*) are disengaged from the at least two lid projections 722(*a*), the lid may be lifted away from the base 702, thereby opening the child-resistant can 700, as illustrated in FIG. 7D.

To recouple the lid 710 to the base 702, a user may first actuate the lower actuator 706(*a*), 706(*b*) of the at least two snap-fit connectors 704(*a*), 704(*b*). The user may then insert the lid 710 into the base with the indents 712(*a*), 712(*b*) misaligned (e.g., offset from) the upper portion 708(*a*), 708(*b*) of the at least two snap-fit connectors 704(*a*), 704(*b*). The user may then rotate the lid 710 such that the at least two base projections 724(*a*) engages the at least two lid projections 722(*a*). The upper portions 708(*a*), 708(*b*) may then snap in place and engage the indents 712(*a*), 712(*b*). When the upper portions 708(*a*), 708(*b*) snap in place and engage the indents 712(*a*), 712(*b*), audible, visual, and/or tactile feedback may be provided to a user (e.g., a clicking noise, a vibration, and/or visual confirmation that the upper portions 708(*a*), 708(*b*) are within the indents 712(*a*), 712(*b*)).

In some examples, the at least two snap-fit connectors 704(*a*), 704(*b*) may be equally spaced from one another about the base circumferential wall 716. By equally spacing the at least two snap-fit connectors 704(*a*), 704(*b*) about the base circumferential wall 716, it can be ensured that one side of the lid 710 may not be disengaged on its own (e.g., the entire lid 710 must be disengaged at once due to the contact between the at least two base projections 724(*a*) and the at least two lid projections 722(*a*)).

As illustrated in FIG. 7A and FIG. 7G, the child-resistant can 700 may include a catch lid 711. The catch lid 711 may have similar functionality as the catch lid 606 of child-resistant can 600. For example, the catch lid 711 may include one or more projections 732 operable to contact and engage to corresponding projections of an interior surface of the lid circumferential wall 720. A user may remove the catch lid 711 from the lid 710 by pulling a lip 714 of the catch lid 711. The lip 714 may be exposed to the user by indent 712(*c*). In some examples, the catch lid 711 and the lid 710 may define cavity for holding one or more objects (e.g., used products).

In some examples, a top edge of the base circumferential wall 716 may include a sealing ring 750. The sealing ring 750 may be configured to seal the cavity defined by the lid 710, the interior surface 728, and the base circumferential wall 716 such that products within the cavity remain fresh.

In some examples, the child-resistant can 700 may have a diameter 734. In some examples, the diameter 734 may be about 50 mm to about 100 mm. The diameter may be about 50 mm to about 60 mm, about 60 mm to about 70 mm, about 70 mm to about 80 mm, about 80 mm to about 90 mm, or about 90 mm to about 100 mm, or any combination therein. In some examples, the diameter 734 may be large enough such that a child would not be able to compress each lower actuator portion 708(*a*), 708(*b*) at the same time to open the child-resistant can 700. In some examples, the child-resistant can 700 may have a height 736. In some examples, the height 736 may be about 10 mm to about 30 mm. In some examples, the height may be about 10 mm to about 15 mm, about 15 mm to about 20 mm, about 20 mm to about 25 mm, or about 25 mm to about 30 mm, or any combination therein. In some examples, the snap-fit connectors 704(*a*), 704(*b*) may have a width 738. The width 738 may be about 10 mm to about 20 mm, about 12 mm to about 17 mm, or about 15 mm. The width must be large enough to accommodate the thumb of most adult users, so that an adult user may press the actuator portions, e.g., using their thumb and index finger. However, the width must also be small enough such that it may be difficult for a child to reach and press the at least two actuator portions simultaneously. Accordingly, both objectives may be achieved when the width is within the disclosed ranges.

FIG. 8A to FIG. 8M illustrate an embodiment of a child-resistant can 800. The child-resistant can 800 may include one or more safety mechanisms operable to prevent a child from opening the child-resistant can 800. For example, the child-resistant can 800 may require dexterity, coordination, and manipulation of hidden features in order to open the child-resistant can 800. In this manner, children are prevented from opening the child-resistant can 800.

The child-resistant can 800 may include a base 802 and lid 810. The base 802 may include a bottom plate 801 and a base circumferential wall 806. The base circumferential wall 806 may extend from the bottom plate 801. In some examples, an interior surface 803 may be defined by the bottom plate 801 and the base circumferential wall 806. The base 802 may include a lip 808 defined by an exterior surface of the base circumferential wall 806 and the bottom plate 801.

The lid 810 may include a top plate 812 and a lid circumferential wall 804. In some examples, the lid circumferential wall 804 may extend from the top plate 812. In some examples, the lid 810 may be configured to enclose the interior surface 803 of the base 802. The lid circumferential wall 804 may be operable to abut against the base circumferential wall 806. In some examples, the lid circumferential wall 804 may include at least one projection 826(*a*), 826(*b*), 826(*c*), 826(*d*), 826(*e*) extending inward from the lid circumferential wall 804. In some examples, the lid circumferential wall 804 may include one or more guides 814(*a*), 814(*b*), 814(*c*), 814(*d*), 814(*e*). The one or more guides 814(*a*), 814(*b*), 814(*c*), 814(*d*), 814(*e*) may be operable to slide along an upper surface of the base circumferential wall 806, visually guide alignment for the user or serve a function in molding the projections.

The base circumferential wall 806 may include at least one groove 816(*a*), 816(*b*), 816(*c*), 816(*d*), 816(*e*). The at least one groove 816(*a*), 816(*b*), 816(*c*), 816(*d*), 816(*e*) may be configured to receive the at least one projection 826(*a*), 826(*b*), 826(*c*), 826(*d*), 826(*e*). The at least one groove 816(*a*), 816(*b*), 816(*c*), 816(*d*), 816(*e*) may be a cut out into the base circumferential wall 806. In some examples, the at least one groove 816(*a*), 816(*b*), 816(*c*), 816(*d*), 816(*e*) may be formed as part of a molding process of the base 802. In some examples, the groove may have a depth. In some examples, the depth of the groove may be about 1 millimeters (mm) to about 5 mm, about 2 mm to about 3 mm, or about 2 mm. In some examples, the groove may have a width. The width may be about 1 mm to about 5 mm, about 2 mm to about 3 mm, or about 2 mm.

The at least one groove may include a vertical locking portion 818(*a*), a horizontal portion 822(*a*), and a vertical inlet/outlet portion 824(*a*). It will be appreciated that while three portions of the at least one groove 816(*a*), 816(*b*), 816(*c*), 816(*d*), 816(*e*) are described, the at least one groove 816(*a*), 816(*b*), 816(*c*), 816(*d*), 816(*e*) may include more than three portions. According to some embodiments, with one example being illustrated in FIG. 8N, the vertical locking portion 818 may have a width (in the horizontal direction) of at least 2 mm, at least 4 mm, or at least 5 mm and no more than 10 mm, no more than 8 mm, or no more than 7 mm, and a height (in the vertical direction) of at least 1.5 mm, at least 2.0 mm, or at least 2.5 mm and no more than 4.5 mm, no more than 4.0 mm, no more than 3.5 mm, or no more than 3.0 mm. According to some embodiments, the horizontal portion 820 may have a width (in the horizontal direction) of at least 4 mm, at least 6 mm, or at least 7 mm and no more than 12 mm, no more than 10 mm, or no more than 9 mm, and a height (in the vertical direction) of at least 0.5 mm, at least 1.0 mm, or at least 1.3 mm and no more than 2.5 mm, no more than 2.0 mm, no more than 1.8 mm, or no more than 1.4 mm. According to some embodiments, the vertical inlet/outlet portion 824 may have a width (in the horizontal direction) of at least 2 mm, at least 4 mm, or at least 5 mm and no more than 10 mm, no more than 8 mm, or no more than 7 mm, and a height (in the vertical direction) of at least 2 mm, at least 2.5 mm, or at least 3.5 mm and no more than 6 mm, no more than 5.5 mm, no more than 5 mm, or no more than 4.5 mm. According to some embodiments, the width of the horizontal portion 822 may be greater than the width of one or more of the vertical locking portion 818 or the vertical inlet/outlet portion 824, such as at least 10% greater, at least 20% greater, or at least 30% greater and no more than 80% greater, no more than 70% greater, no more than 60% greater, no more than 50% greater, no more than 40% greater, or no more than 30% greater.

In some examples, the vertical locking portion 818(*a*) may include a snap-fit connector 820(*a*) (e.g., bayonet lock). The snap-fit connector 820(*a*) may be operable to engage the at least one projection 826(*a*), 826(*b*), 826(*c*), 826(*d*), 826(*e*) such that the lid 810 locks to the base 802. For example, when the at least one projection 826(*a*), 826(*b*), 826(*c*), 826(*d*), 826(*e*) translates to a top edge of the vertical locking portion 818(*a*), the snap-fit connector 820(*a*) may secure the at least one projection 826(*a*), 826(*b*), 826(*c*), 826(*d*), 826(*e*) within the vertical locking portion 818(*a*).

Figure 8A:
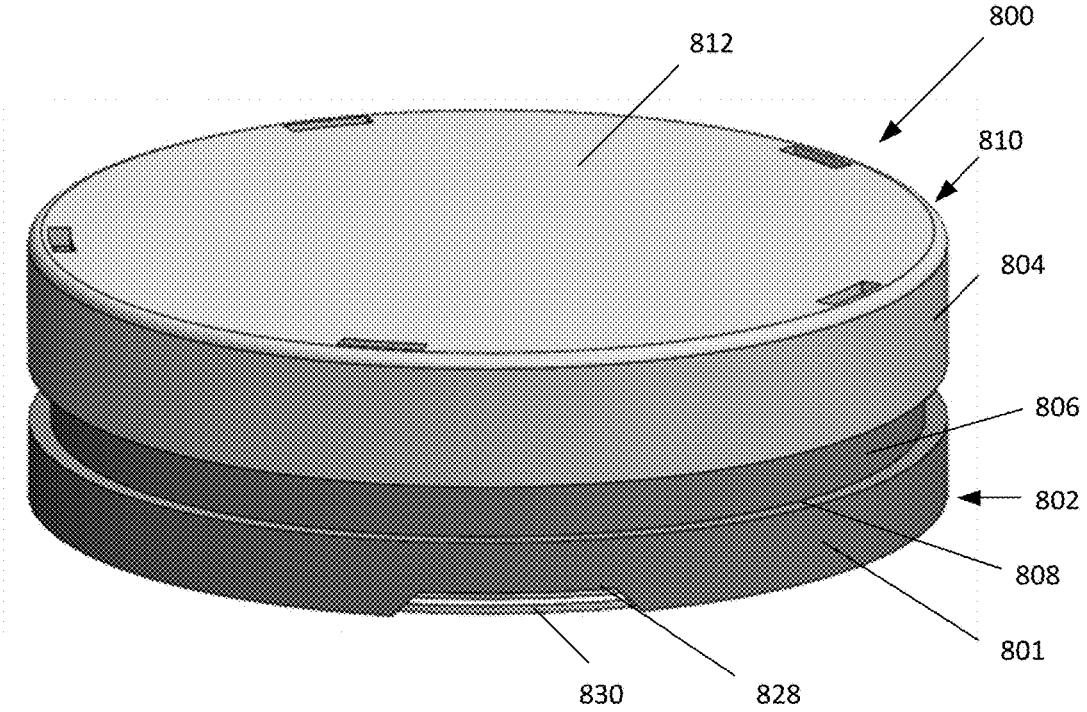
FIG. 8A illustrates a child-resistant can in accordance with one embodiment.
Figure 8B:
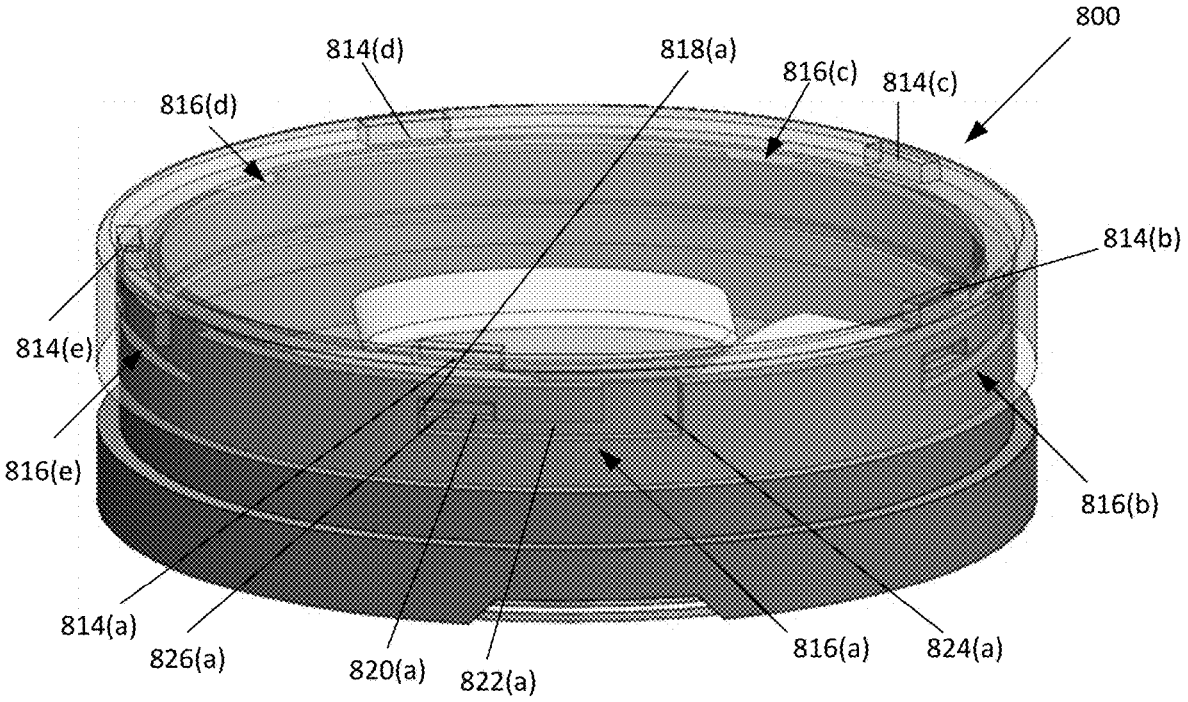
FIG. 8B illustrates a child-resistant can in accordance with one embodiment.
Figure 8C:
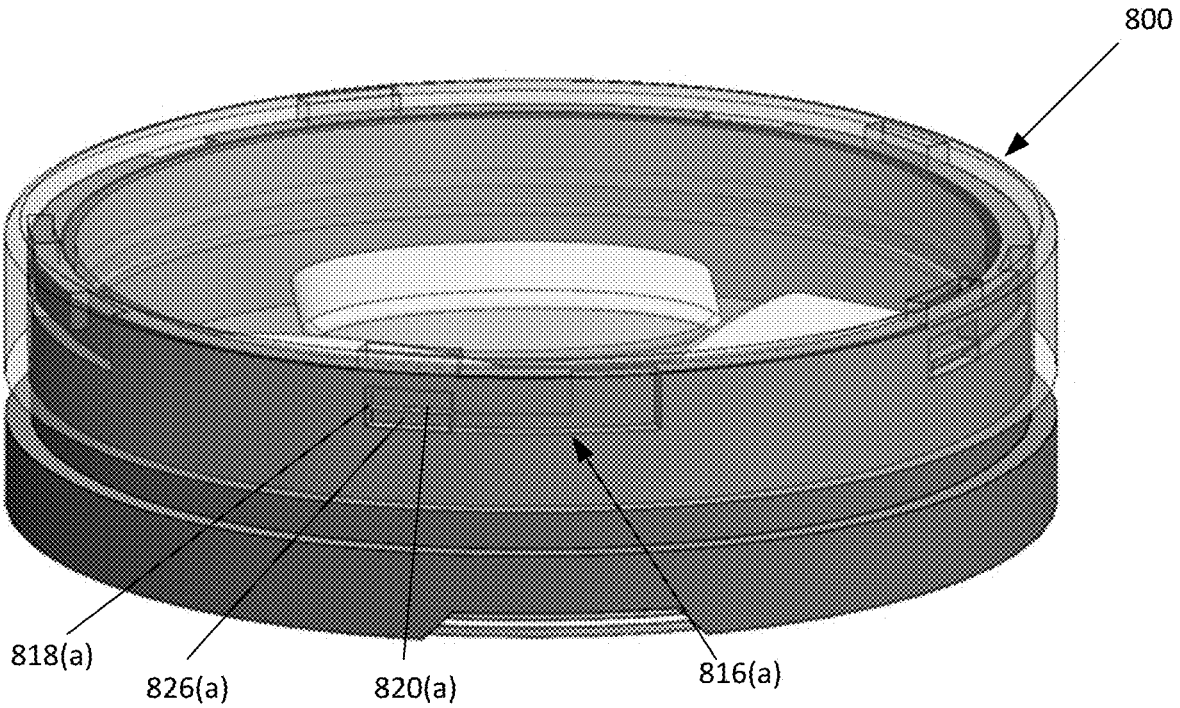
FIG. 8C illustrates a child-resistant can in accordance with one embodiment.
Figure 8D:
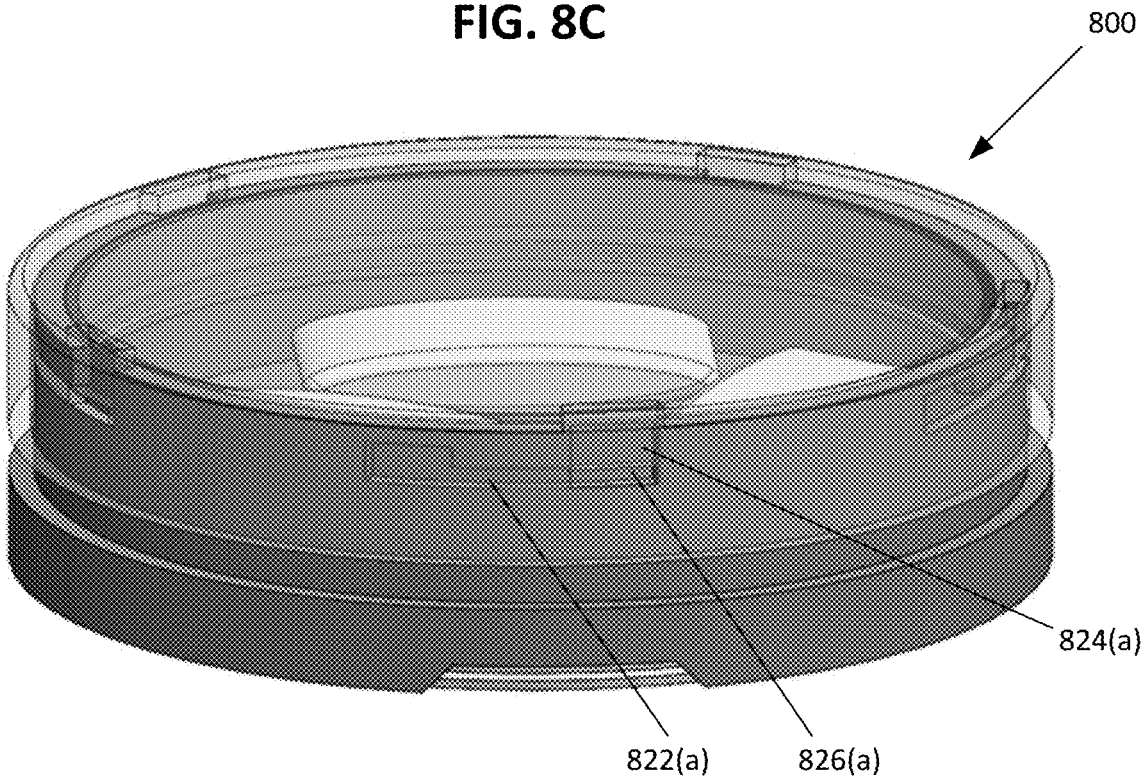
FIG. 8D illustrates a child-resistant can in accordance with one embodiment.
Figure 8E:
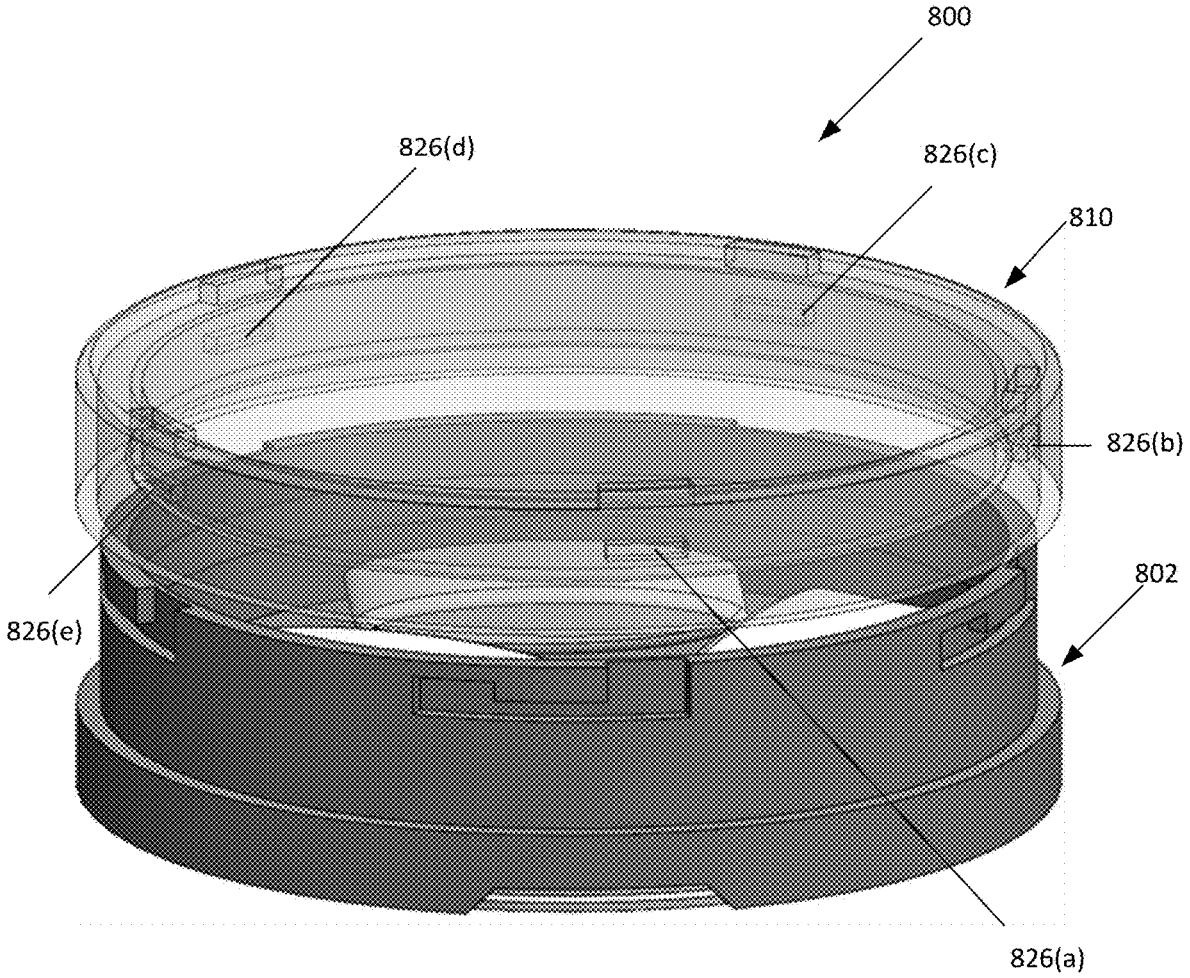
FIG. 8E illustrates a child-resistant can in accordance with one embodiment.

FIG. 8A to FIG. 8B illustrate the lid 810 coupled to the base 802. The lid 810 may be removed from the base 802 by first pressing the lid 810 downwards towards the base 802. Pressing the lid 810 downwards towards the base 802 may the at least one projection 826(*a*), 826(*b*), 826(*c*), 826(*d*), 826(*e*) from the snap-fit connector 820(*a*). FIG. 8C illustrates the lid 810 pressed downwards towards the base 802 such that the at least one projection 826(*a*), 826(*b*), 826(*c*), 826(*d*), 826(*e*) is disengaged from the snap-fit connector 820(*a*). The lid 810 is then rotated such that the at least one projection 826(*a*), 826(*b*), 826(*c*), 826(*d*), 826(*e*) translates along the horizontal portion 822(*a*), as illustrated in FIG. 8D. As illustrated in FIG. 8E, the lid 810 may then be lifted from the base 802 such that the at least one projection 826(*a*), 826(*b*), 826(*c*), 826(*d*), 826(*e*) translates along the vertical inlet/outlet portion 826(*a*). Once the at least one projection 826(*a*), 826(*b*), 826(*c*), 826(*d*), 826(*e*) reaches the end of the vertical inlet/outlet portion 826(*a*), the lid 810 may be uncoupled from the base 802.

Figure 8F:
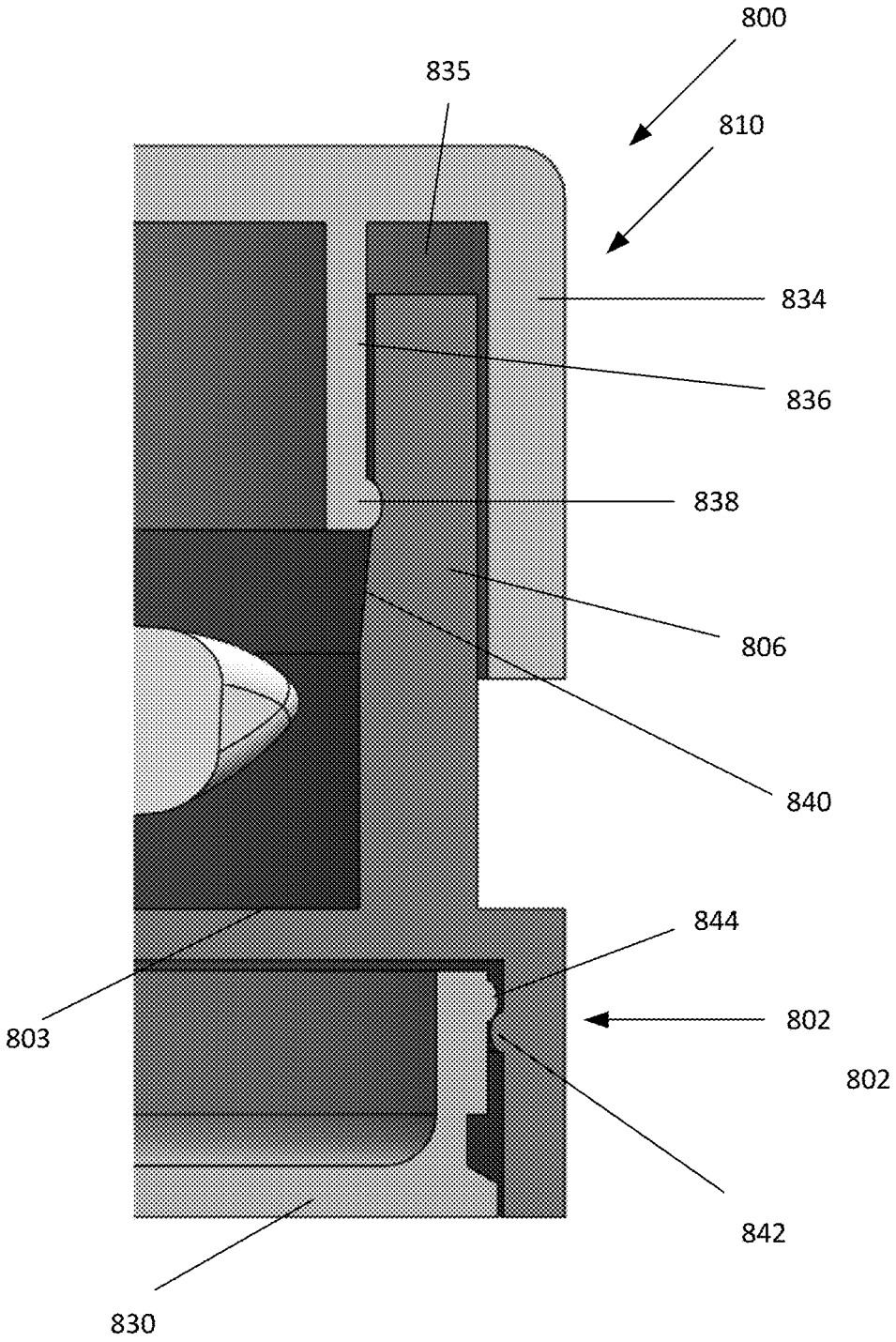
FIG. 8F illustrates a cross-section of a child-resistant can in accordance with one embodiment.

As illustrated in FIG. 8F, the lid circumferential wall 804 may include an outer wall 834 and an inner wall 836. The outer wall 834 and the inner wall 836 may define a cavity 835 therebetween. The cavity 835 may be operable to receive the base circumferential wall 806. The outer wall 834 may include the at least one projection 826(*a*), 826(*b*), 826(*c*), 826(*d*), 826(*e*). The inner wall 836 may include an outward sealing lip 838 (e.g., the outward sealing lip 838 extends towards the base circumferential wall 806).

Figure 8G:
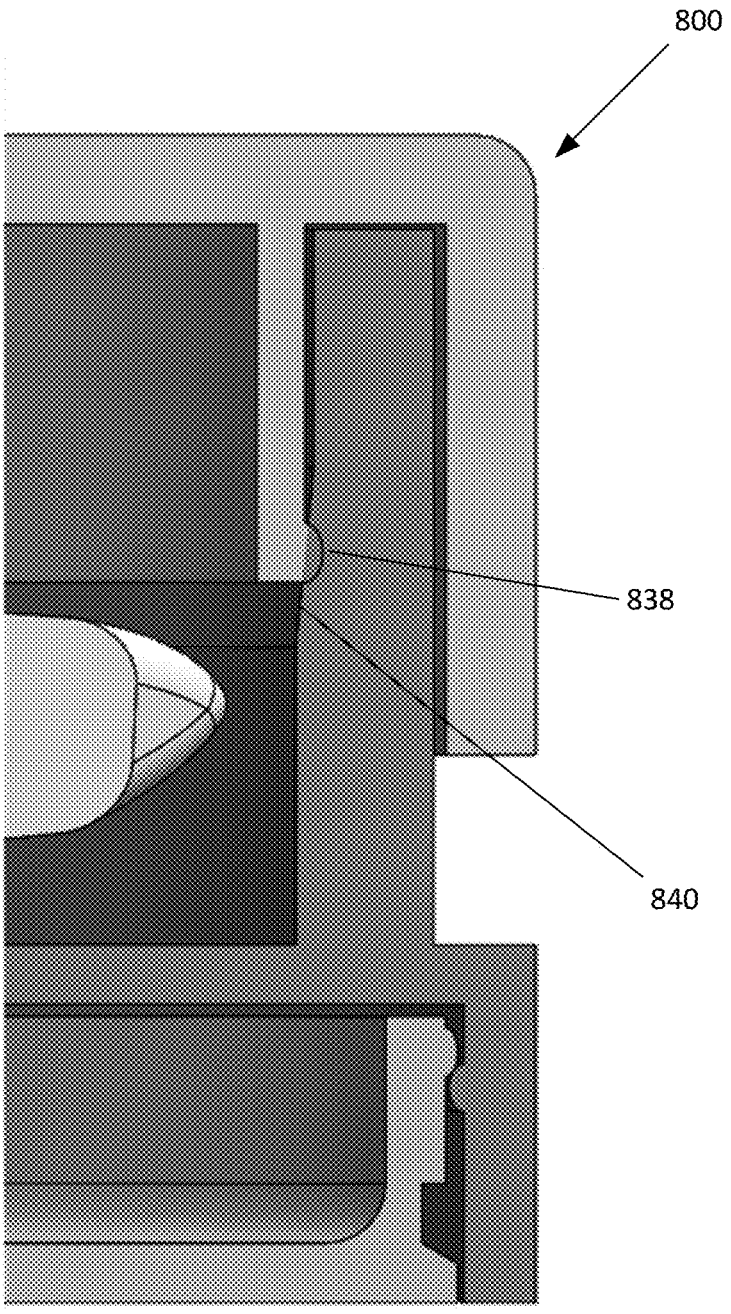
FIG. 8G illustrates a cross-section of a child-resistant can in accordance with one embodiment.

The base circumferential wall 806 may include an interior chamfered surface 840. The interior chamfered surface 840 may abut against the outward sealing lip 838. In some examples, the interior chamfered surface 840 is configured to provide a force to the outward sealing lip 838. For example, when the lid 810 is pressed downward, the interior chamfered surface 840 provides a corresponding force to the outward sealing lip 838. For example, FIG. 8G illustrates the interior chamfered surface 840 proving a force to the outward sealing lip 838 as the lid 810 is pressed downward. When the force on the lid 810 is removed, the interior chamfered surface 840 automatically biases the outward sealing lip 838 upwards towards a resting position (e.g., where there is no force on the outward sealing lip 838 and/or the outward sealing lip rests against the base circumferential wall 806), as illustrated in FIG. 8F. In some examples, the interior chamfered surface 840 may bias the outward sealing lip 838 upwards until the at least one projection 826(*a*), 826(*b*), 826(*c*), 826(*d*), 826(*e*) engages with the snap-fit connector 820(*a*). In some examples, the interior chamfered surface 840 is operable to bias the outward sealing lip 838 upwards at all times and the lid 810 only stops moving upwards when the at least one projection is abutting against another surface (e.g., vertical locking portion 818(*a*), horizontal portion 822(*a*)).

In some examples, the outward sealing lip 838 may seal the cavity defined by the lid 810, the base circumferential wall 806, and the interior surface 803. In this manner, the outward sealing lip 838 may provide a seal to the cavity such that any products contained therein remain fresh.

When as user desires to recouple the lid 810 to the base 802, the user may insert the at least on projection 826(*a*), 826(*b*), 826(*c*), 826(*d*), 826(*e*) into the vertical inlet/outlet portion 824(*a*) and rotate the lid 810 such that the at least one projection 826(*a*), 826(*b*), 826(*c*), 826(*d*), 826(*e*) translates along the horizontal portion 822(*a*). The return force provided by the interior chamfered surface 840 may then cause the at least one projection 826(*a*), 826(*b*), 826(*c*), 826(*d*), 826(*e*) to translate upwards within the vertical locking portion 818(*a*) such that the snap-fit connector 820(*a*) secures the at least one projection 826(*a*), 826(*b*), 826(*c*), 826(*d*), 826(*e*) therein, thereby recoupling the lid 810 to the base 802.

Figure 8H:
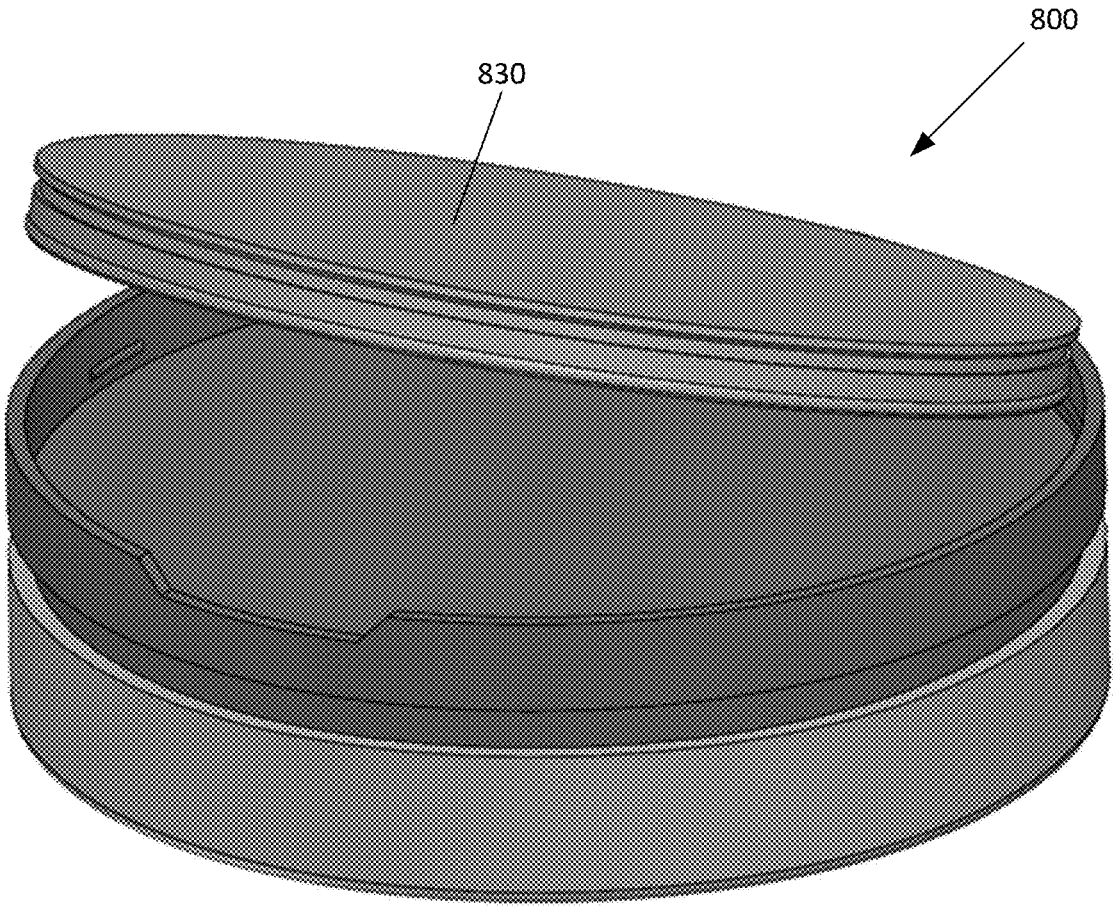
FIG. 8H illustrates a child-resistant can in accordance with one embodiment.

In some examples, the child-resistant can 800 may include a catch lid 830. The catch lid 830 may have similar functionality as catch lid 606 and catch lid 711. In some examples, the catch lid 830 may include a projection 844 configured to engage with a corresponding projection 842 of the base 802, as illustrated in FIG. 8F. The projection 844 and corresponding projection 842 may engage such that the catch lid 830 is coupled to the base 802. As illustrated in FIG. 8A, the base may include an opening 828 operable to expose the catch lid 830. A user may uncouple the catch lid 830 from the base by pulling on the catch lid 830 such that the projection 844 translates over the corresponding projection 842 and disengages therefrom. FIG. 8H illustrates the catch lid 830 disengaged from the base 802.

Figure 8I:
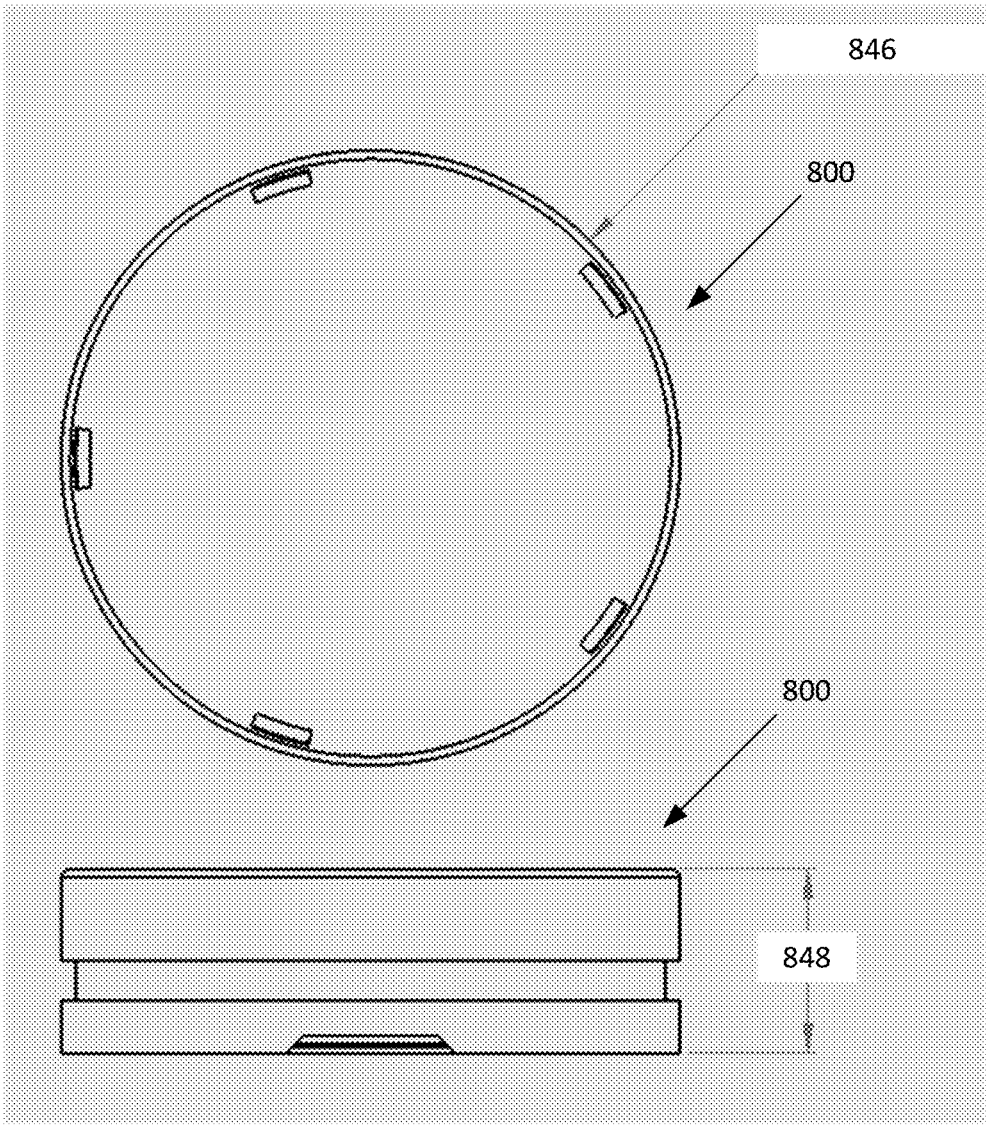
FIG. 8I illustrates a child-resistant can in accordance with one embodiment.
Figure 8J:
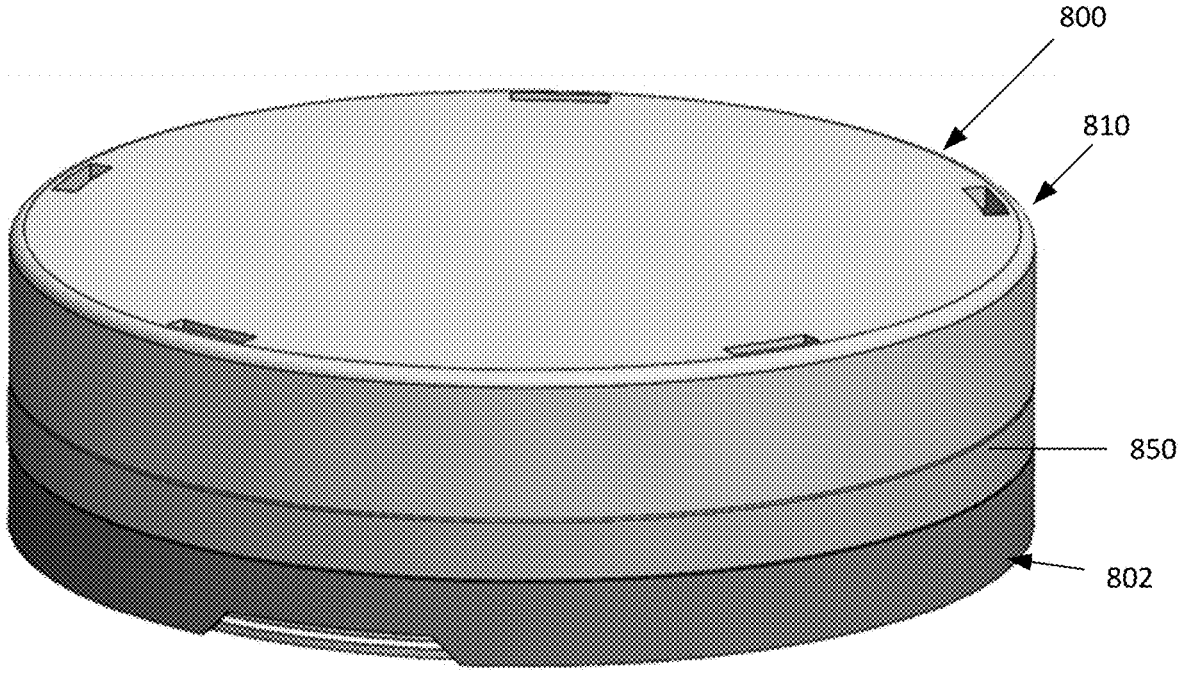
FIG. 8J illustrates a child-resistant can in accordance with one embodiment.
Figure 8K:
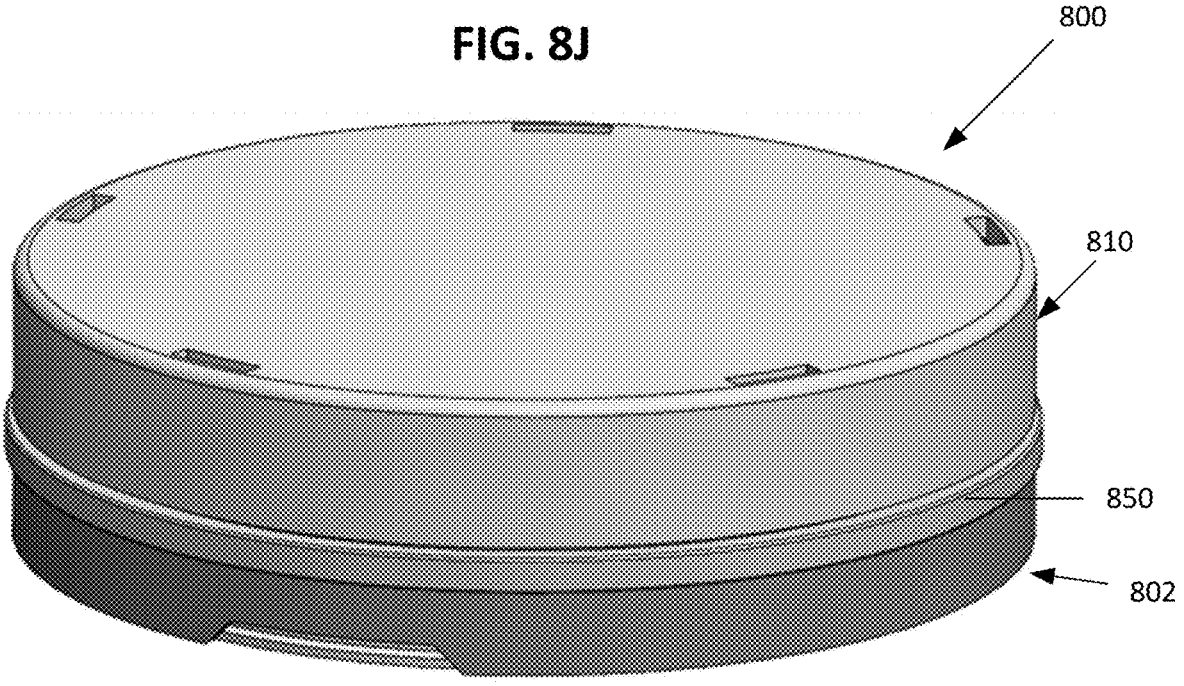
FIG. 8K illustrates a child-resistant can in accordance with one embodiment.

As illustrated in FIG. 8I, the child-resistant can 800 can have a diameter 846. The diameter 846 may be about 50 mm to about 100 mm. The diameter 846 may be about 50 mm to about 60 mm, about 60 mm to about 70 mm, about 70 mm to about 80 mm, about 80 mm to about 90 mm, or about 90 mm to about 100 mm. The child-resistant can 800 may have a height 848. The height 848 may be about 10 mm to about 30 mm. The height 848 may be about 10 mm to about 15 mm, about 15 mm to about 20 mm, about 20 mm to about 25 mm, or about 25 mm to about 30 mm.

FIG. 8J to FIG. 8M illustrate a sealing ring 850 which may be used with the child-resistant can 800. In some examples, the sealing ring 850 may be used as an alternative to, or in conjunction with, the interior chamfered surface 840. For example, the sealing ring 850 may provide similar functionality to the interior chamfered surface 840 and the outward sealing lip 838.

Figure 8L:
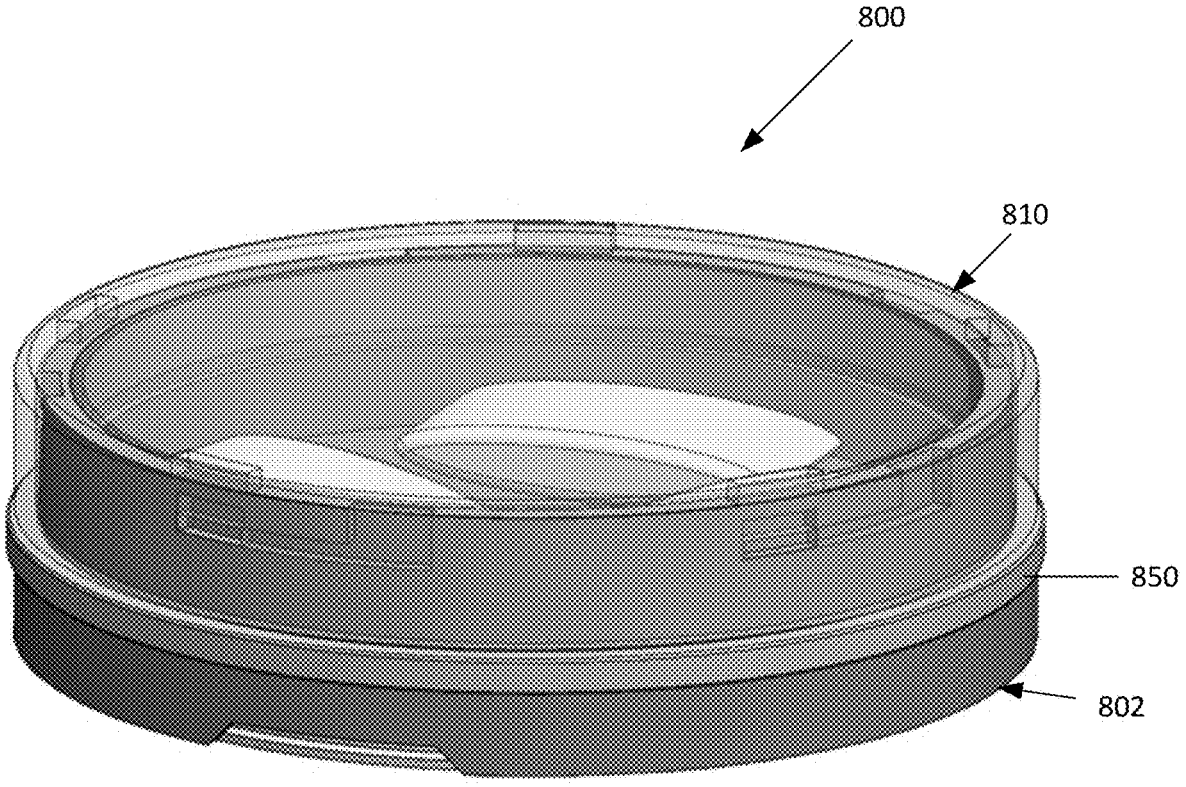
FIG. 8L illustrates a child-resistant can in accordance with one embodiment.
Figure 8M:
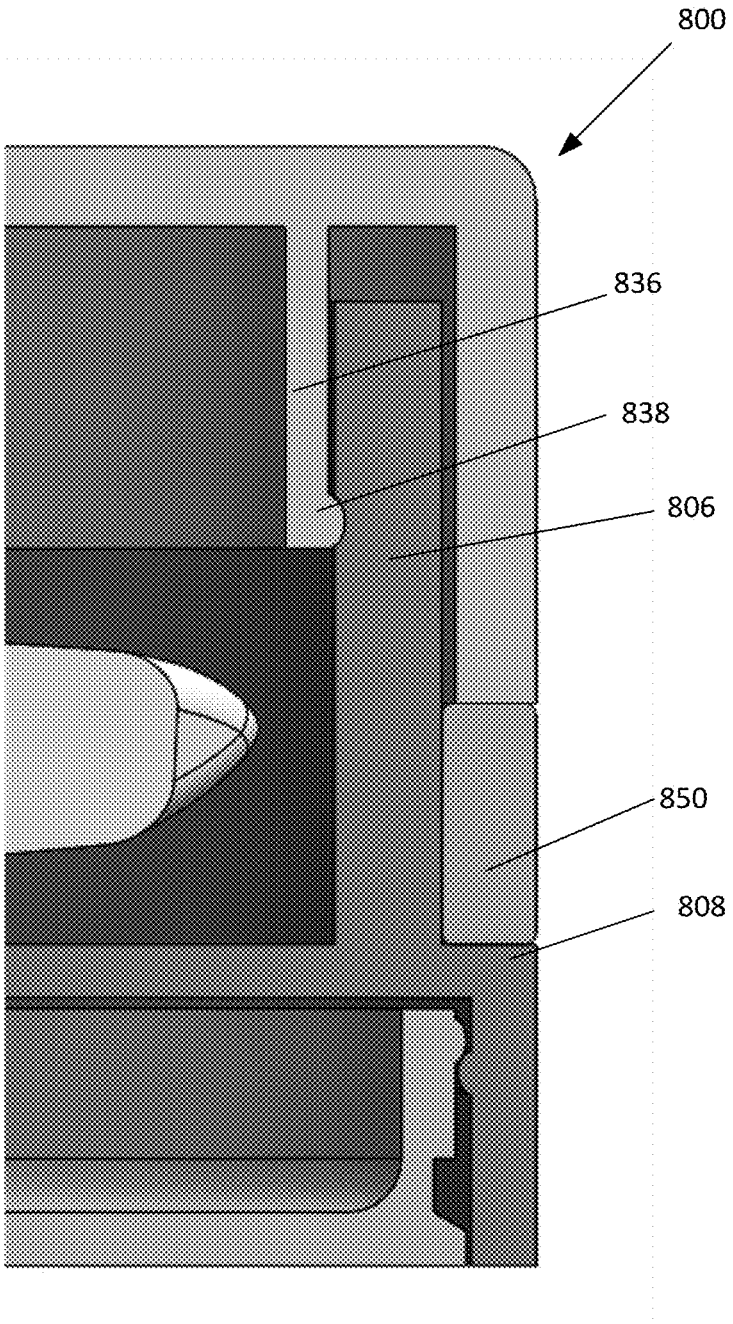
FIG. 8M illustrates a child-resistant can in accordance with one embodiment.
Figure 8N:
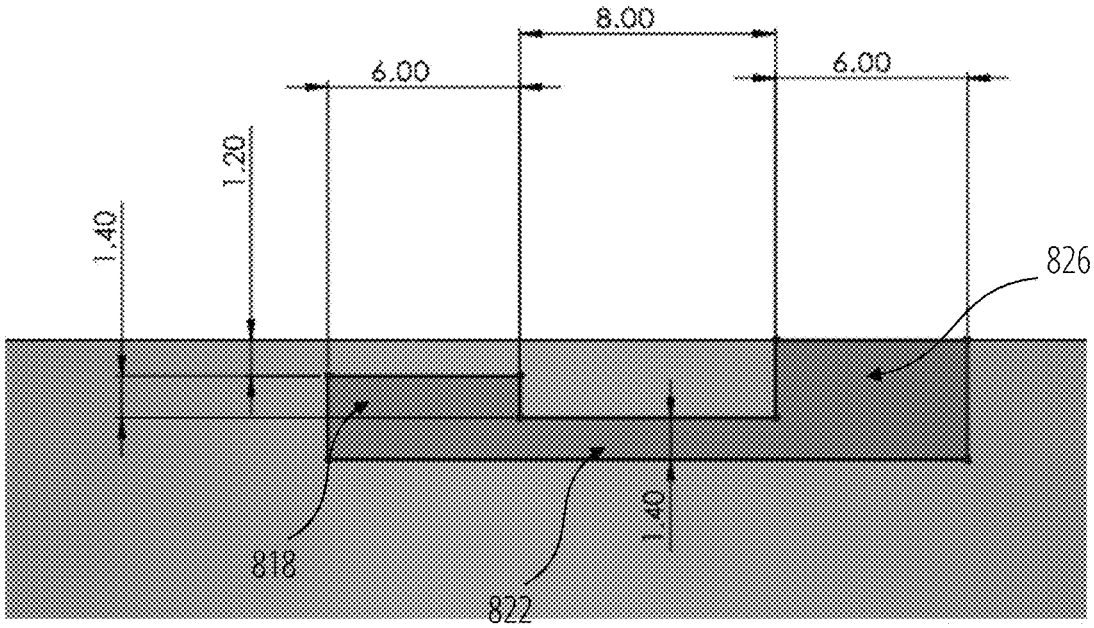
FIG. 8N illustrates a child-resistant can in accordance with one embodiment.
Figure 9A:
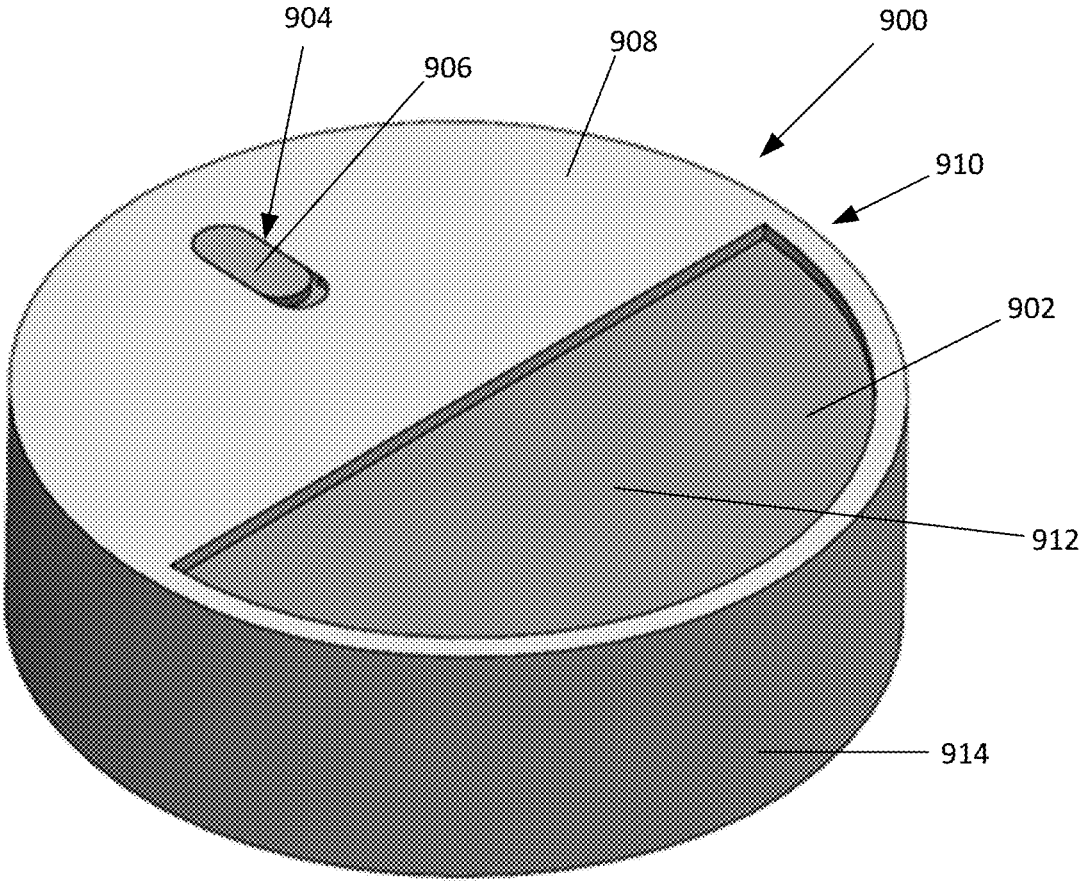
FIG. 9A illustrates a child-resistant can in accordance with one embodiment.
Figure 9B:
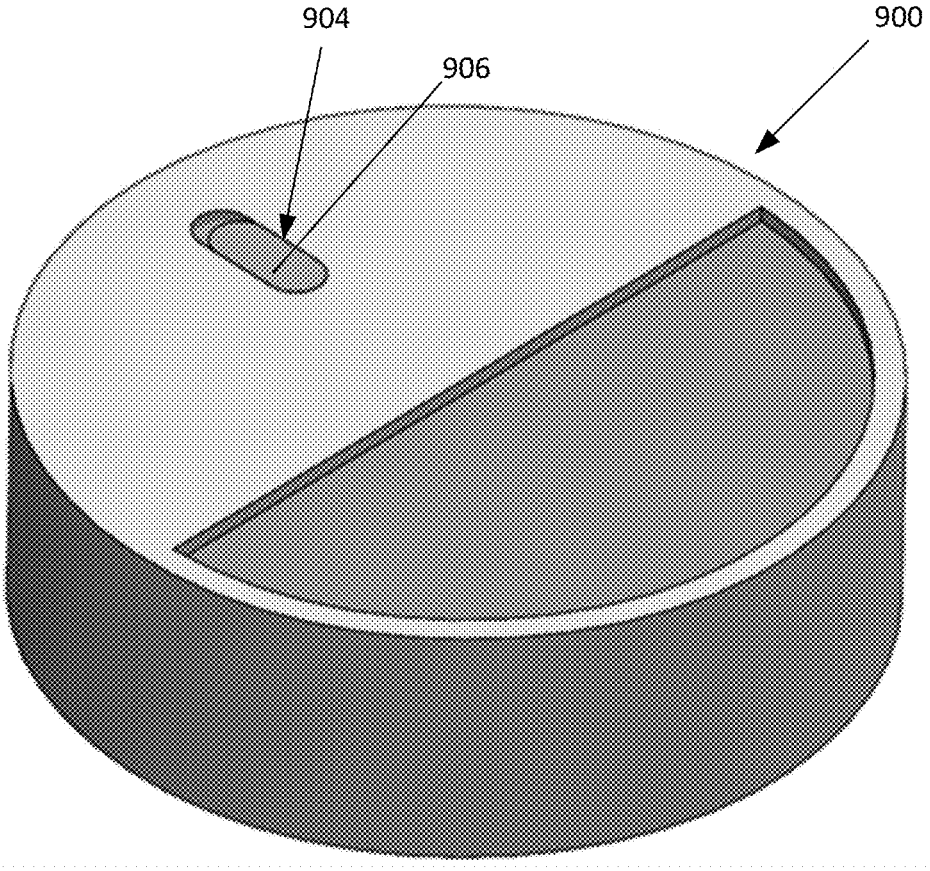
FIG. 9B illustrates a child-resistant can in accordance with one embodiment.
Figure 9C:
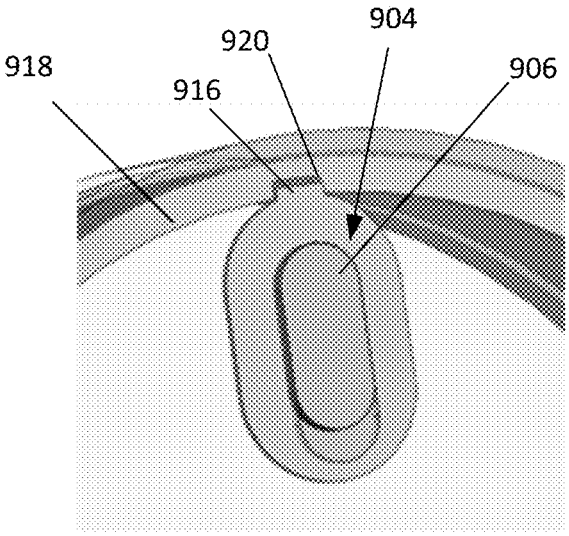
FIG. 9C illustrates a portion of a child-resistant can in accordance with one embodiment.
Figure 9D:
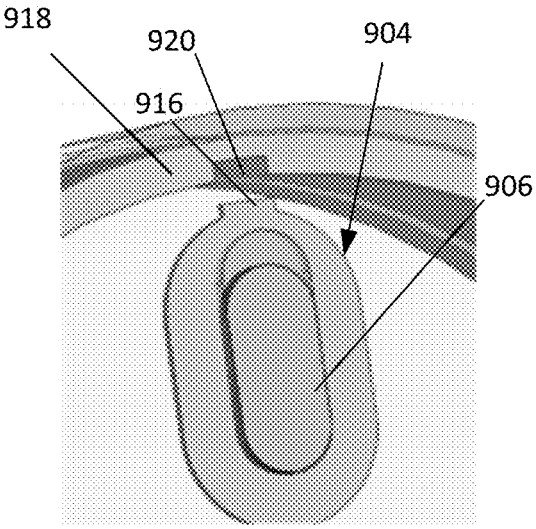
FIG. 9D illustrates a portion of a child-resistant can in accordance with one embodiment.
Figure 9E:
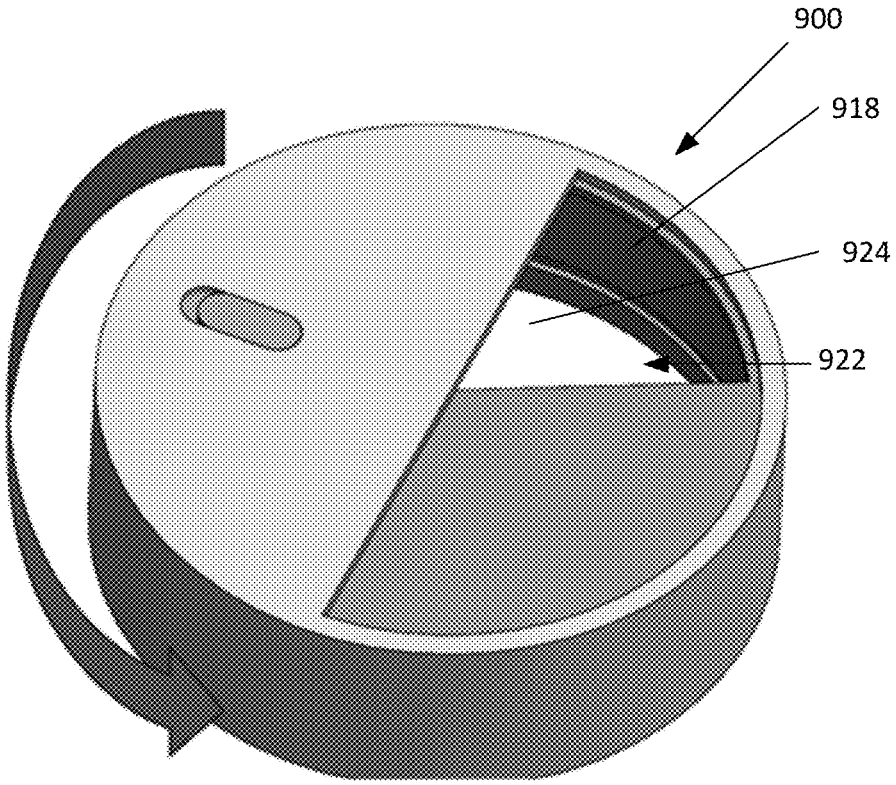
FIG. 9E illustrates a child-resistant can in accordance with one embodiment.
Figure 9F:
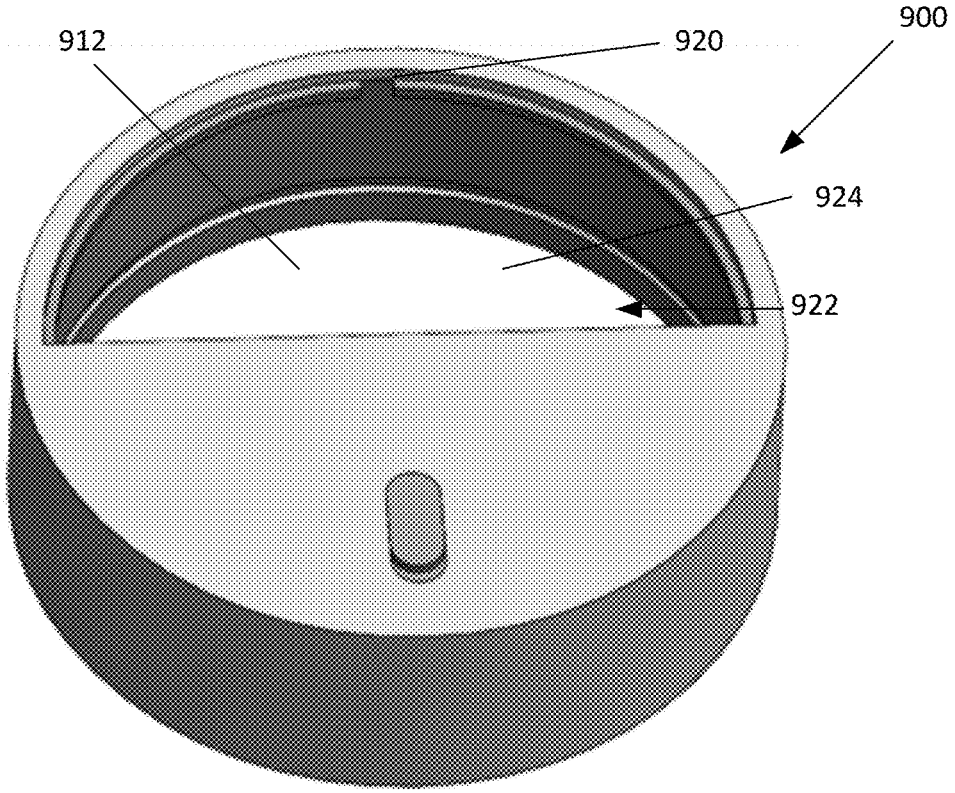
FIG. 9F illustrates a child-resistant can in accordance with one embodiment.
Figure 9G:
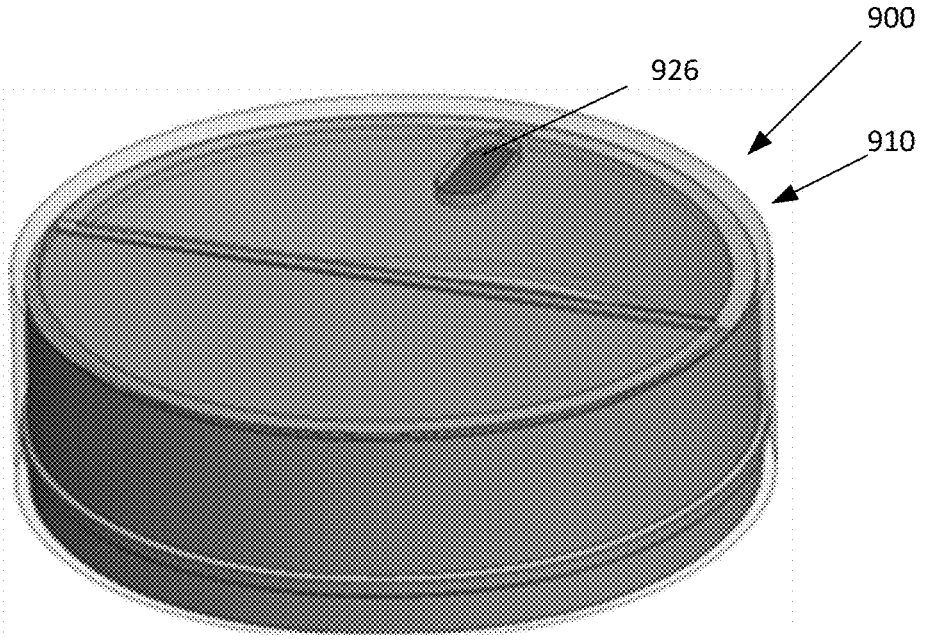
FIG. 9G illustrates a child-resistant can in accordance with one embodiment.
Figure 9H:
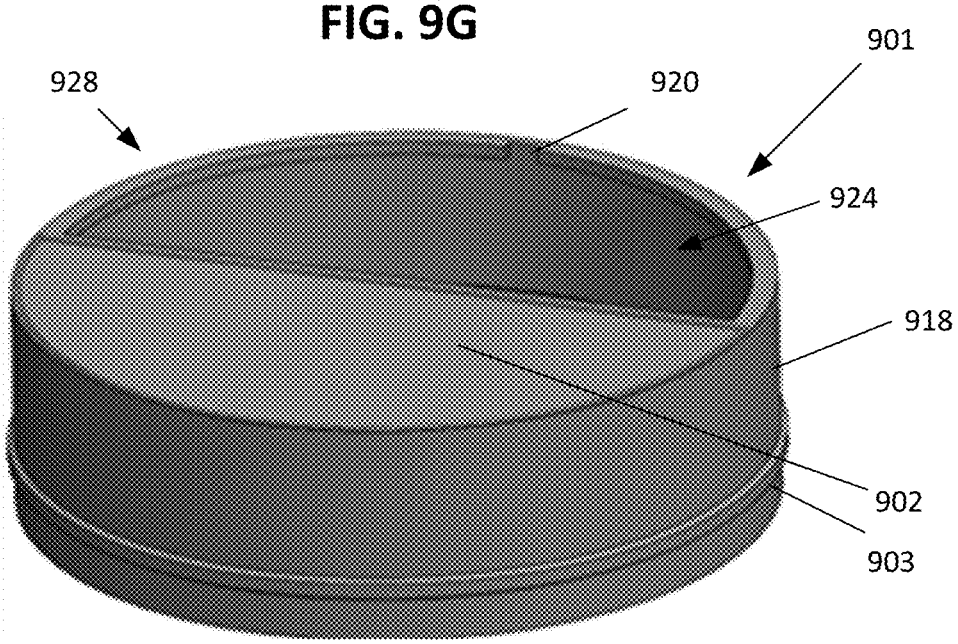
FIG. 9H illustrates a base of a child-resistant can in accordance with one embodiment.
Figure 9I:
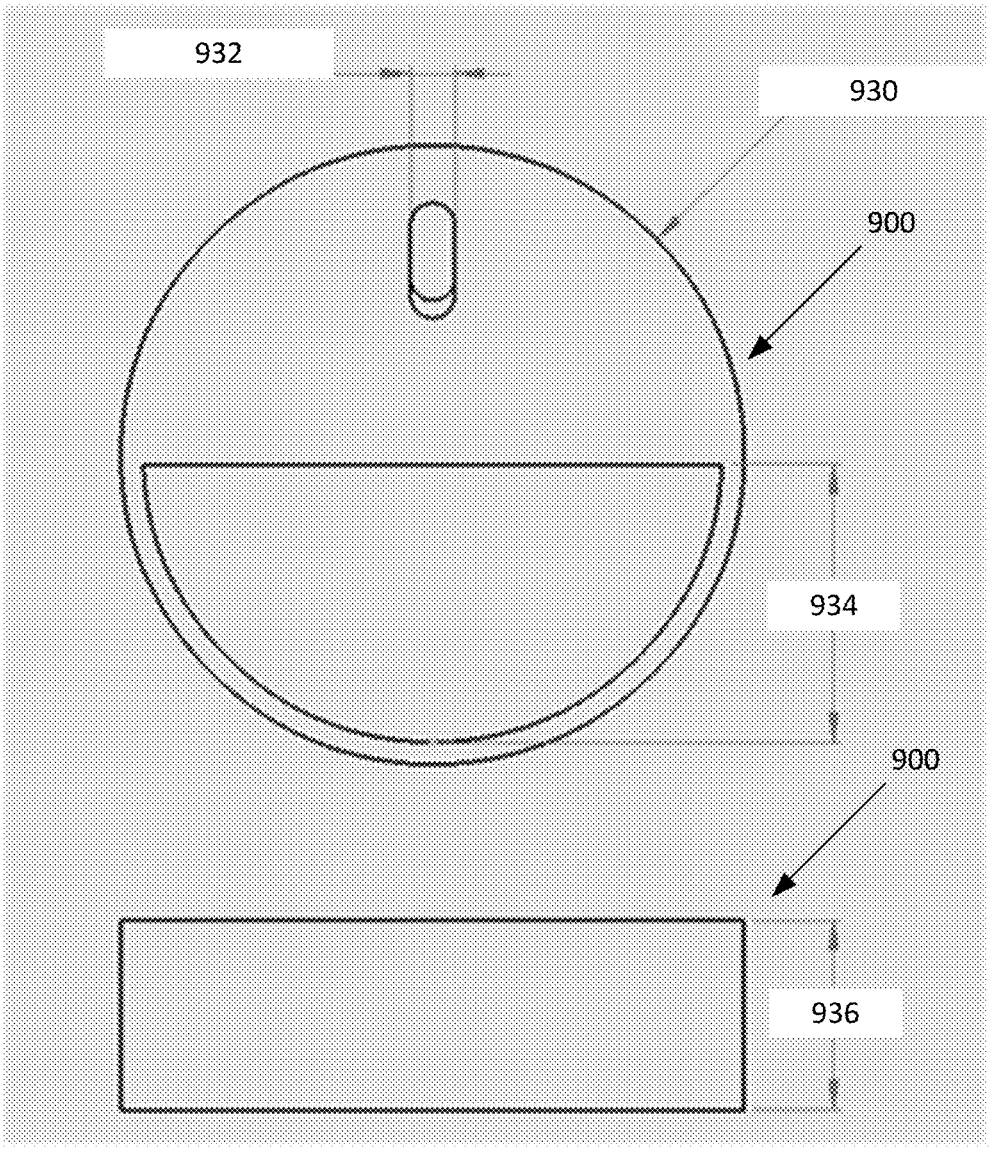
FIG. 9I illustrates a child-resistant can in accordance with one embodiment.
Figure 10A:
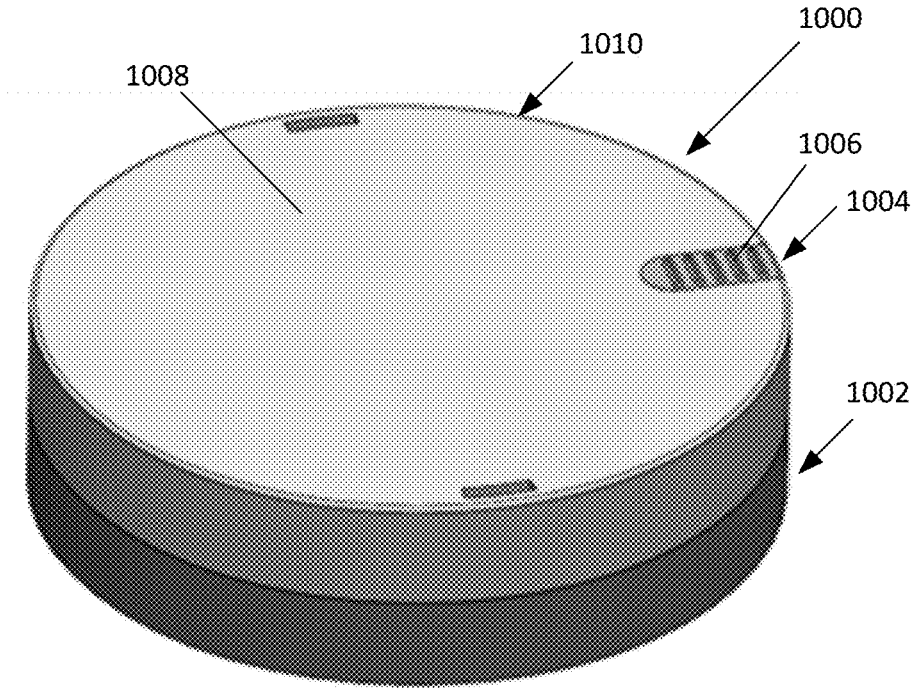
FIG. 10A illustrates a child-resistant can in accordance with one embodiment.
Figure 10B:
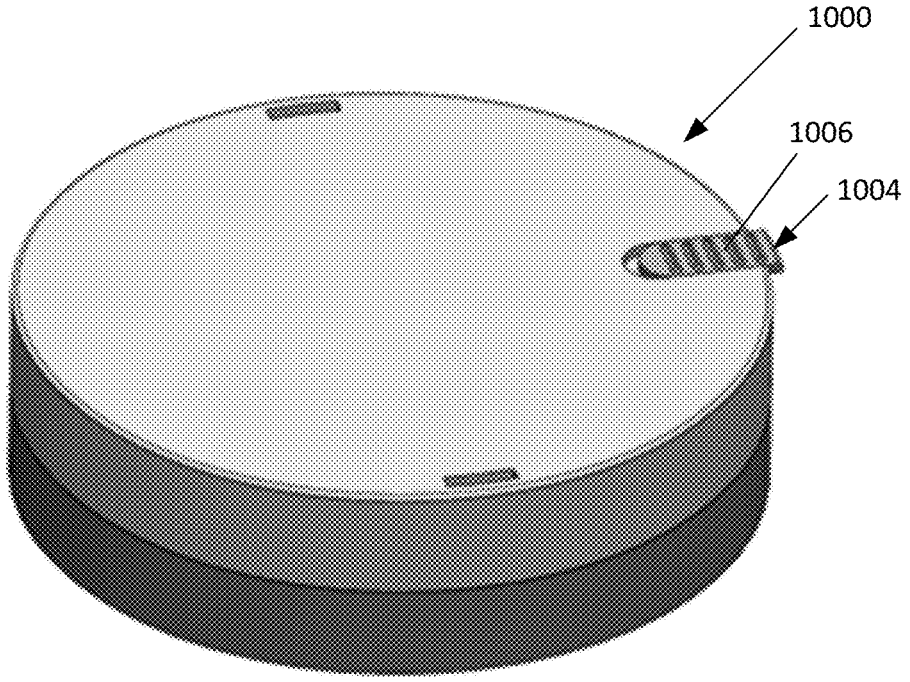
FIG. 10B illustrates a child-resistant can in accordance with one embodiment.
Figure 10C:
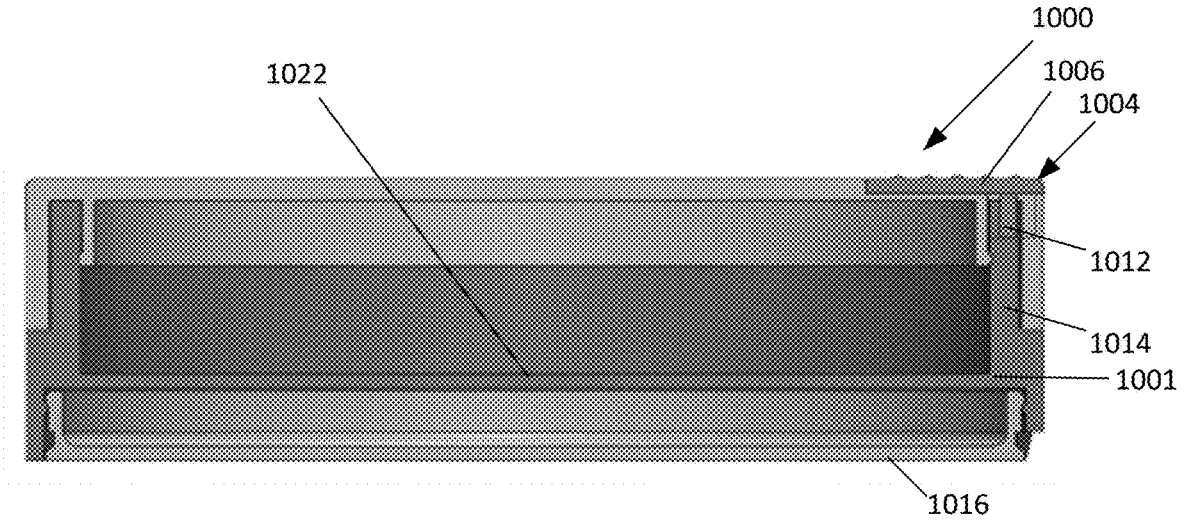
FIG. 10C illustrates a cross-section of a child-resistant can in accordance with one embodiment.
Figure 10D:
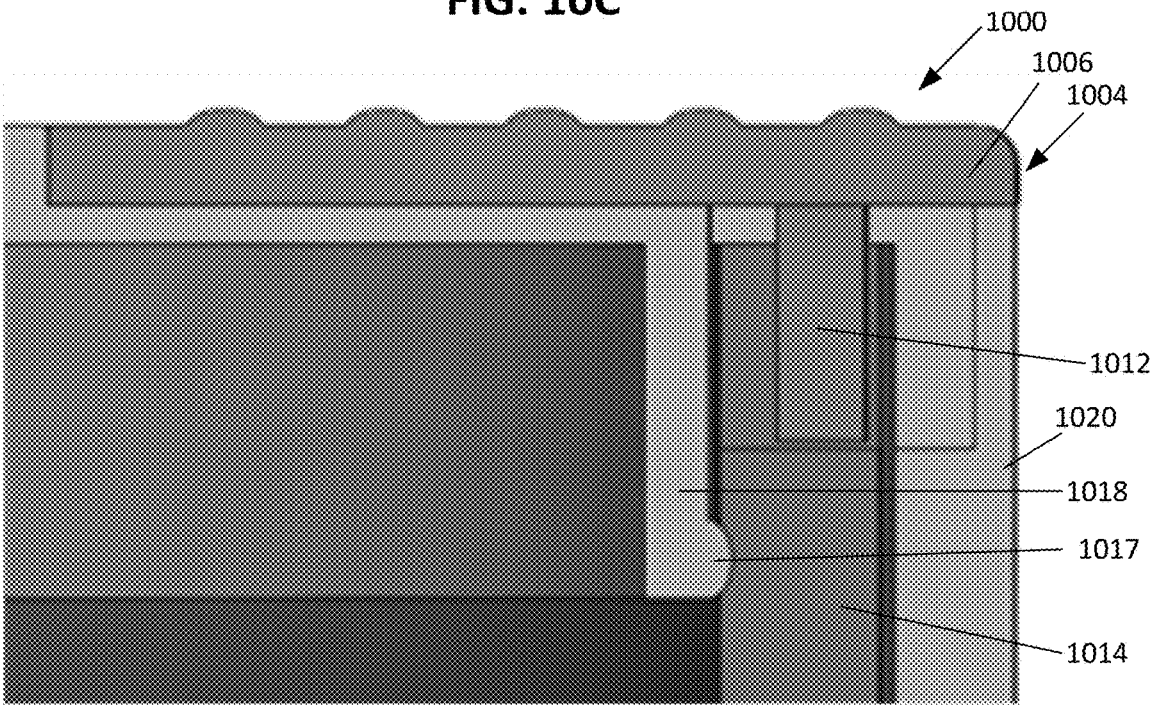
FIG. 10D illustrates a cross-section of a portion of a child-resistant can in accordance with one embodiment.
Figure 10E:
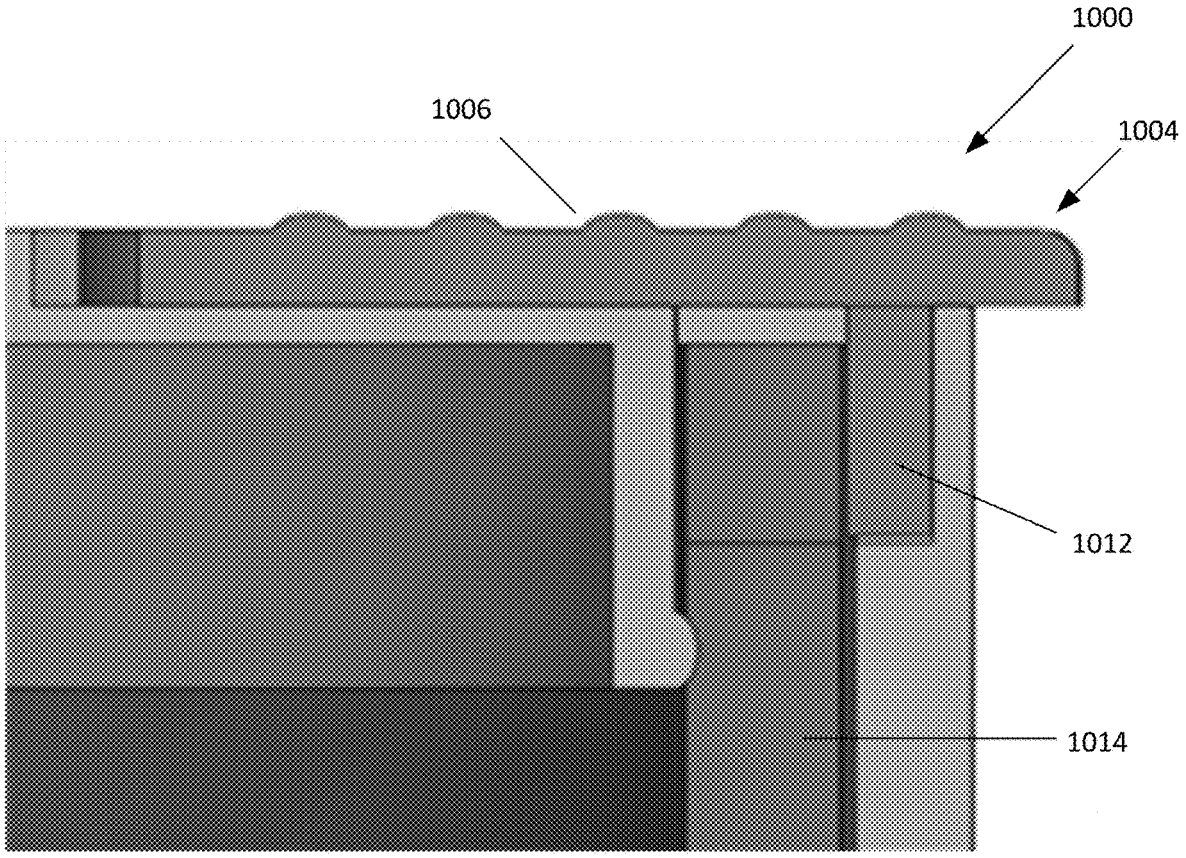
FIG. 10E illustrates a cross-section of a portion of a child-resistant can in accordance with one embodiment.
Figure 10F:
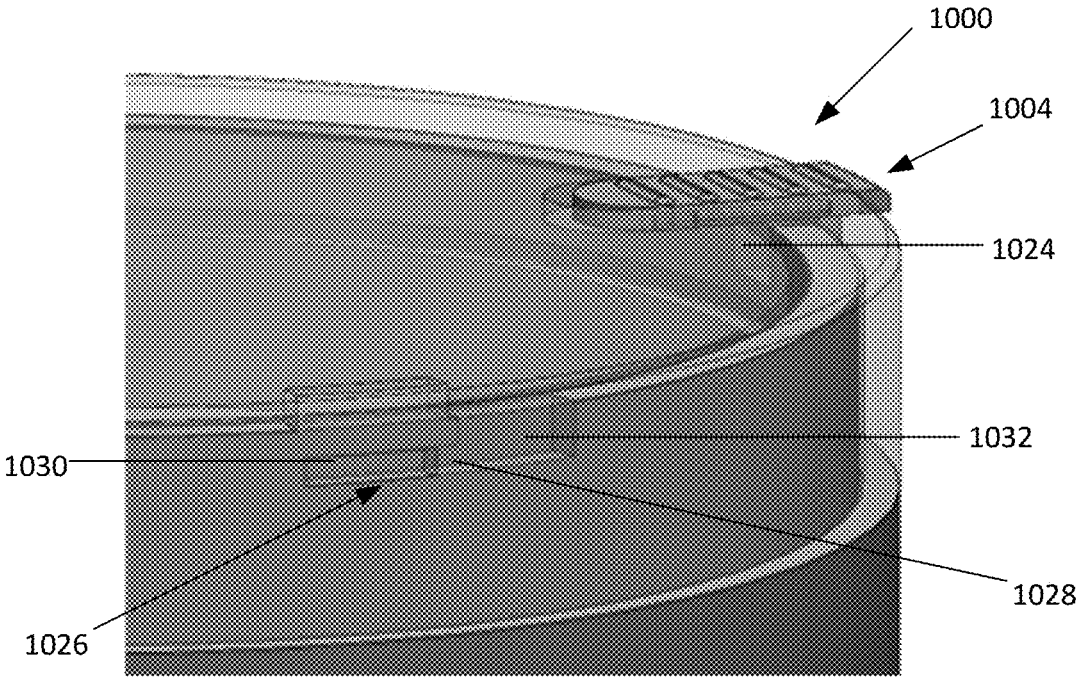
FIG. 10F illustrates a portion of a child-resistant can in accordance with one embodiment.
Figure 10G:
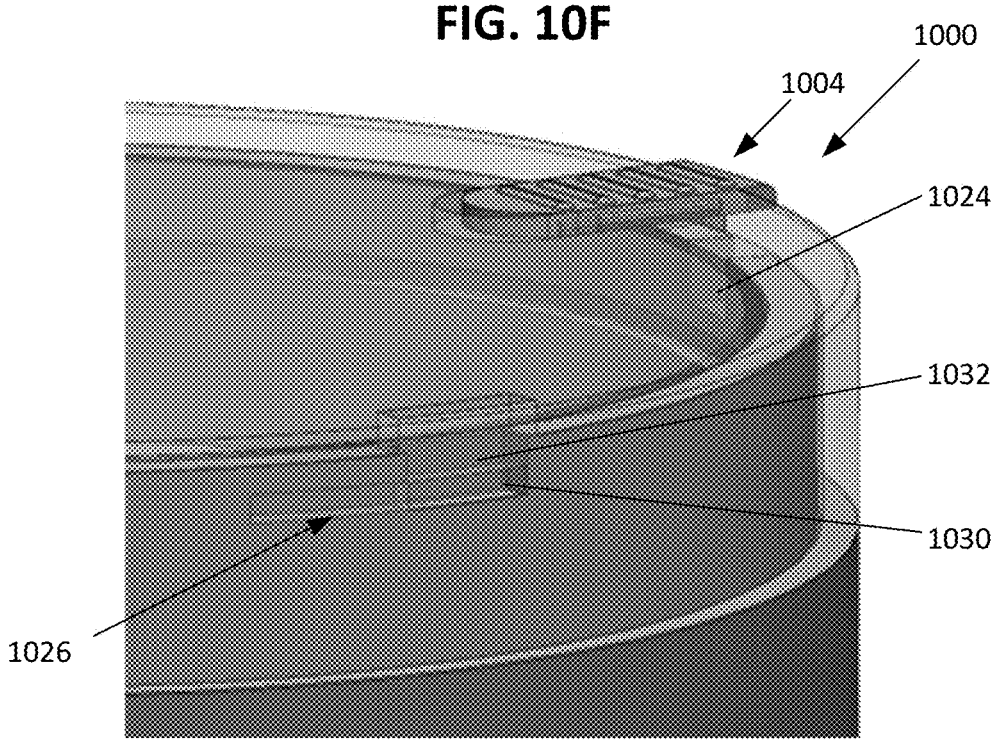
FIG. 10G illustrates a portion of a child-resistant can in accordance with one embodiment.
Figure 10H:
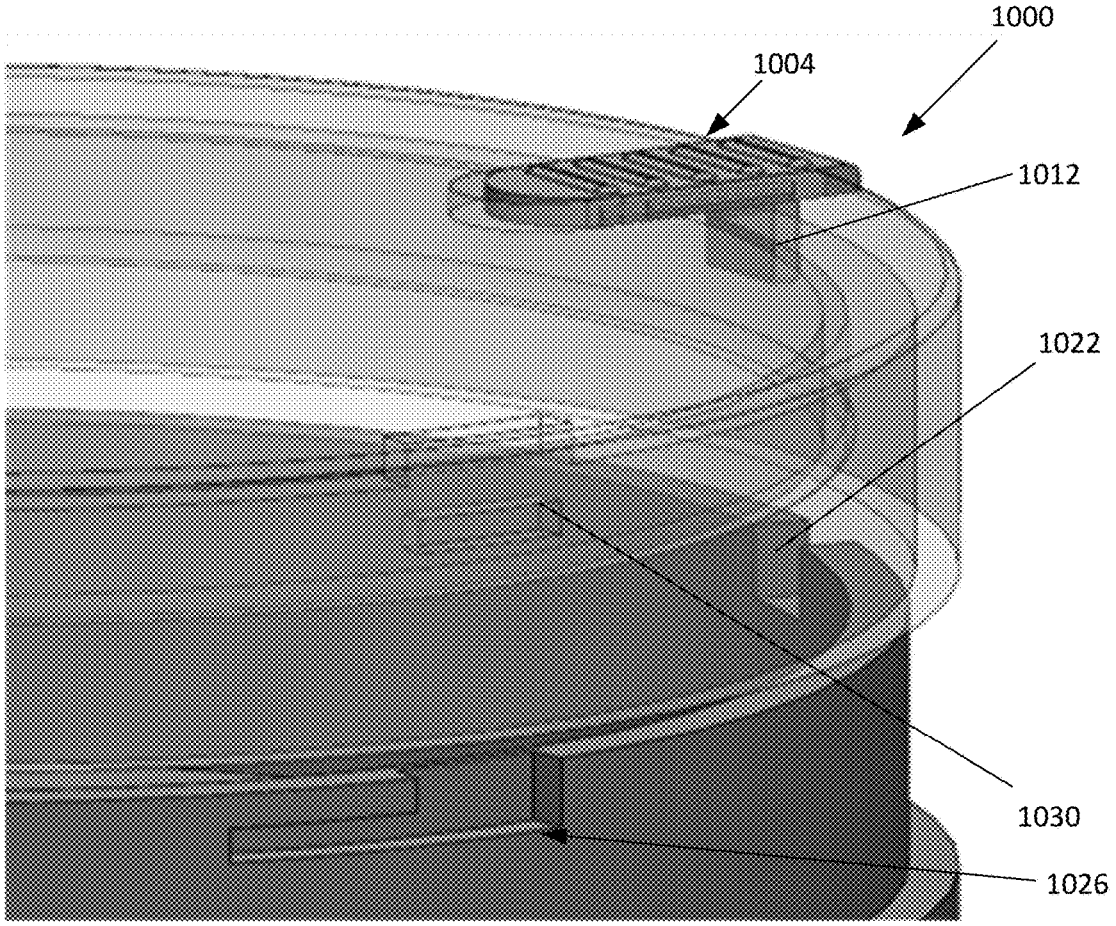
FIG. 10H illustrates a portion of a child-resistant can in accordance with one embodiment.
Figure 10I:
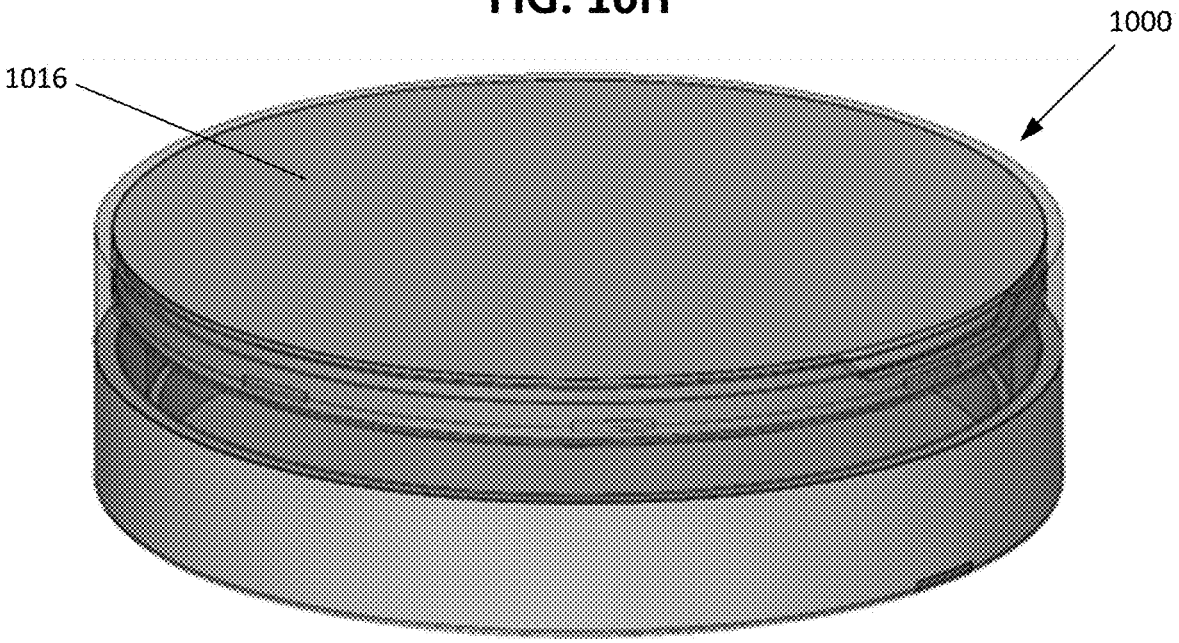
FIG. 10I illustrates a child-resistant can in accordance with one embodiment.
Figure 10J:
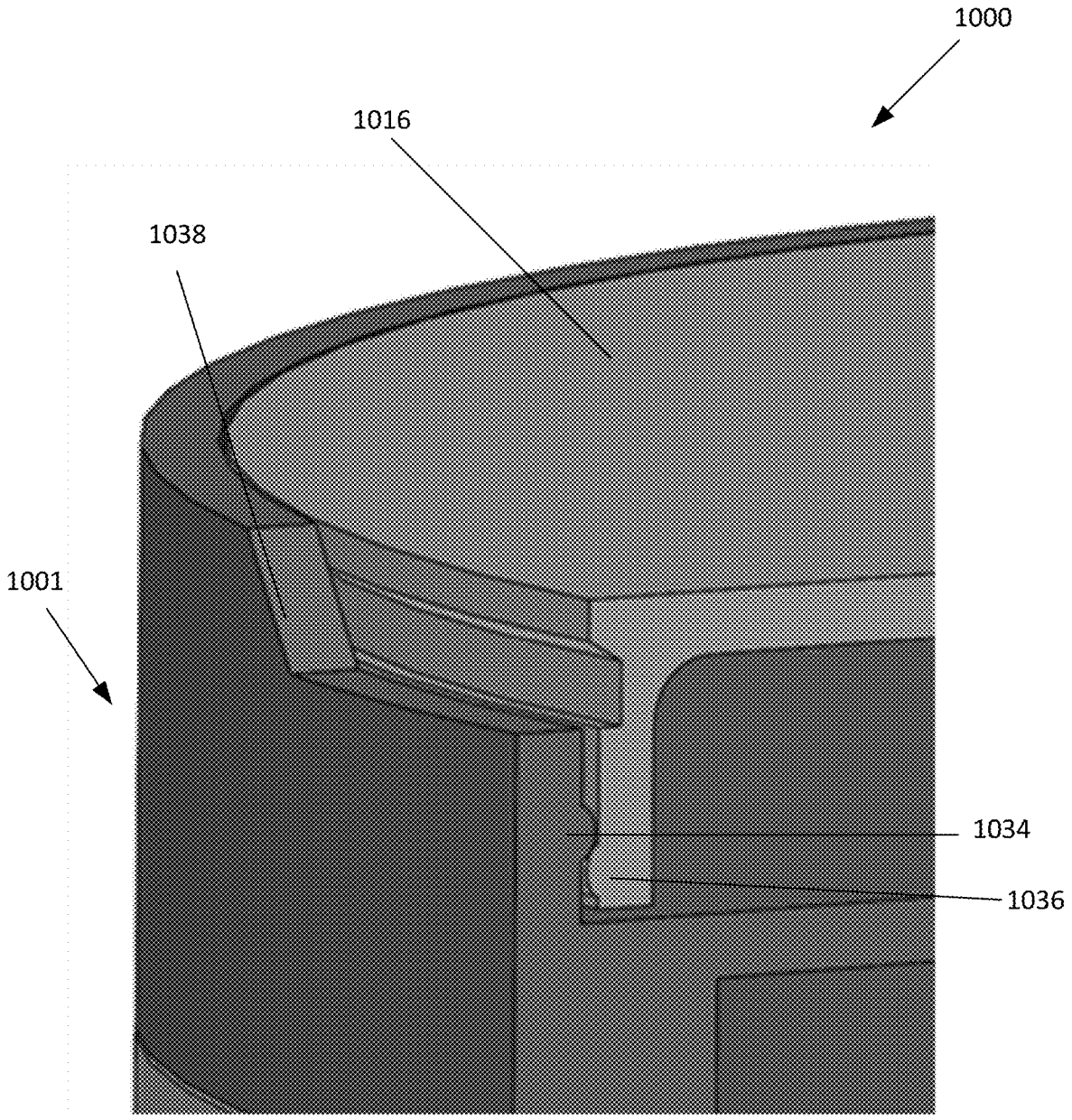
FIG. 10J illustrates a portion of a child-resistant can in accordance with one embodiment.
Figure 10K:
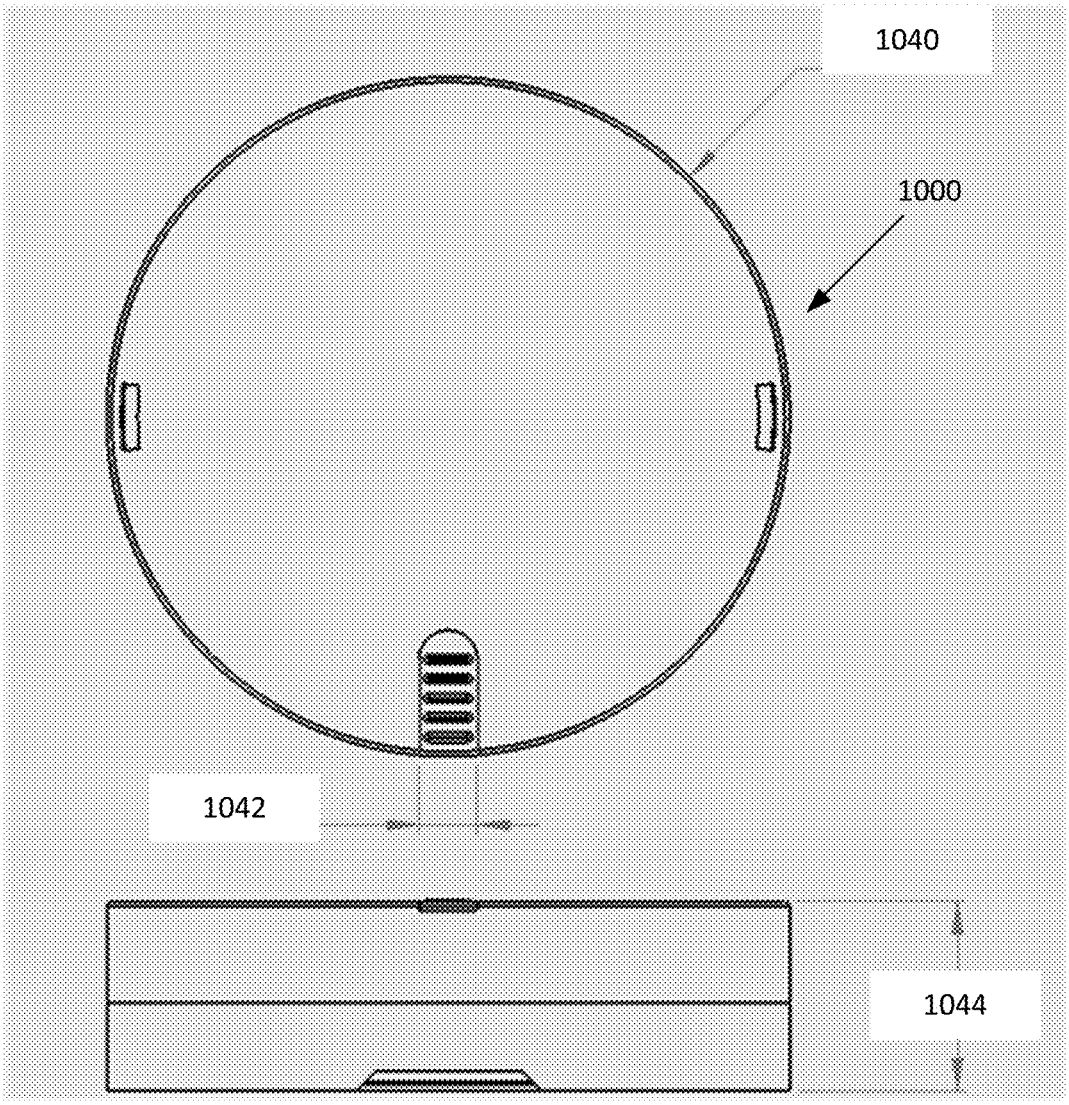
FIG. 10K illustrates a child-resistant can in accordance with one embodiment.

The sealing ring 850 may be configured to sit on the lip 808. In some examples, the sealing ring 850 may be a rubber or silicone sealing ring. In some examples, the sealing ring 850 may be attached to the lip 808. In some examples, the sealing ring 850 may be attached to an edge of the lid circumferential wall 804. The sealing ring 850 may provide a return force to the lid 810 similar to the interior chamfered surface 840. For example, the sealing ring 850 may be compressed downward when the lid 810 is pressed downward, as illustrated in FIG. 8L to FIG. 8M. When the sealing ring 850 is pressed downward, the sealing ring 850 may store potential energy for providing a return force to the lid 810. For example, a user may remove the lid 810 in the same manner as described herein.

When the user desires to recouple the lid 810 to the base 802, the user may first insert the at least one projection 826(*a*), 826(*b*), 826(*c*), 826(*d*), 826(*e*) into the vertical inlet/outlet portion 824(*a*). The user may then rotate the lid 810 such that the at least one projection 826(*a*), 826(*b*), 826(*c*), 826(*d*), 826(*e*) translates along the horizontal portion 822(*a*). Once the at least one projection is aligned with the vertical locking portion 818(*a*), the sealing ring 850 may automatically bias the lid 810 upward (e.g., due to the stored potential energy), thereby causing the at least one projection 826(*a*), 826(*b*), 826(*c*), 826(*d*), 826(*e*) to secure to the snap-fit connector 820(*a*).

In some examples, when the at least one projection 826(*a*), 826(*b*), 826(*c*), 826(*d*), 826(*e*) is secured by the snap-fit connector 820(*a*) an indication may be provided to the user. For example, audible feedback (e.g., a clicking noise from the snap connection between the at least one projection 826(*a*), 826(*b*), 826(*c*), 826(*d*), 826(*e*)) and the snap-fit connector 820(*a*)) and/or tactile feedback (e.g., a vibration caused from the snap connection between the at least one projection 826(*a*), 826(*b*), 826(*c*), 826(*d*), 826(*e*)) may be provided to the user. Further, the user may receive indication that the lid is locked by the silicone or rubber relaxing, rather than it being squeezed out.

While the at least one groove 816(*a*), 816(*b*), 816(*c*), 816(*d*), 816(*e*) is shown as having five grooves, it will be appreciated that any number of grooves and any number of corresponding projections (e.g., at least one projection 826(*a*), 826(*b*), 826(*c*), 826(*d*), 826(*e*)) may be used with the child-resistant can 800.

FIG. 9A to FIG. 9I illustrate an embodiment of a child-resistant can 900. The child-resistant can 900 may include one or more safety mechanisms operable to prevent a child from opening the child-resistant can 900. For example, the child-resistant can 900 may require actuation of a hidden mechanism in order to open the child-resistant can 900. In this manner, children are prevented from opening the child-resistant can 900.

The child-resistant can 900 may include a base 901 and a lid 910. The base may include a bottom plate 903, a base top plate 902, and a base circumferential wall 918. The base circumferential wall 918 may extend from the bottom plate 903. In some examples, the base circumferential wall 918 may extend from the bottom plate 903 to the top plate 902.

In some examples, the base 901 may include an interior surface 922 defined by the bottom plate 903 and the base circumferential wall 918. In some examples, the top plate 902 may extend from the base circumferential wall 918. In some examples, the top plate 902 may extend perpendicular to the base circumferential wall 918. In some examples, the top plate 902 may include a base opening 924. In some examples, the base circumferential wall 918 may include an indent 920. In some examples, the base circumferential wall 918 may include multiple indents.

The lid 910 may be configured to enclose the interior surface 922. The lid 910 may include a lid top plate 908 configured to enclose the base opening 924. The lid top plate 908 may include a lid opening 912. The lid top plate 908 may include a top surface and a bottom surface. The lid top plate 908 may include a moveable switch 904. In some examples, the moveable switch 904 may be disposed in the lid top plate 908. For example, the moveable switch may be coupled to a switch opening 926, such that the moveable switch 904 is disposed in the lid top plate 908. The lid 910 may include a lid circumferential wall 914. The lid circumferential wall 914 may be configured to abut against the base circumferential wall 918.

The moveable switch 904 may include a slider 906 exposed on the top surface of the lid top plate 908. The moveable switch 904 may include a projection 916 extending from the bottom surface of the lid top plate 908. The slider 906 may be configured to control motion of the projection 916. For example, the slider 906 may be operable to cause the projection 916 to translate linearly as the slider 906. For example, as the slider 906 is moved forward or backward within the switch opening 926, the projection 916 may move forward or backward with the slider 906. In some examples, the projection 916 is configured to be received in the indent 920. For example, the projection 916 may be operable to lock into place within the indent 920 such that the lid may only be rotated when the slider 906 is first translated to disengaged the projection form the indent.

In some examples, the moveable switch 904 further includes a return mechanism. The return mechanism may be operable to provide a force to urge the projection 916 towards the base circumferential wall 918. For example, the return mechanism may be operable to bias the slider 906, and thereby the projection 916 outwards (e.g., such that when the projection 916 is aligned with the indent 920 the projection automatically locks into place within the indent 920). In some examples, the return mechanism may include a spring, a snap arm, an elastic mechanism, or another stored energy mechanism.

In some examples, a sealing mechanism may be placed between the lid circumferential wall 914 and the base circumferential wall 918 such that a cavity defined by the interior surface 922, the base circumferential wall 918, and the lid 910 is sealed. In some examples, one or more products may be contained within the cavity and the sealing mechanism may seal the cavity such that the one or more products remain fresh. For example, the sealing mechanism may include an annular ring operable to provide a seal between the base circumferential wall 918 and the lid circumferential wall 914.

In some examples, to open the child-resistant can 900, a user first translates the slider 906 inward (e.g., towards the center of the lid 910), thereby translating the projection 916 inward and disengaging the projection 916 from the indent 920. Then, a user may rotate the lid 910 such that the base opening 924 aligns with the lid opening 912. When the base opening 924 and the lid opening 912 are aligned, the cavity defined by the base circumferential wall 918, the lid 910, and the interior surface 922 is exposed, thereby allowing a user to access the contents of the child-resistant can 900. In other examples, the lid 910 may be lift upwards or otherwise removed from the base 901 when the projection 916 is disengaged from the indent 920.

In some examples, to close the child-resistant can 900, a user rotates the lid 910 until the projection 916 snaps in place within the indent 920. For example, the user may rotate the lid 910 until the projection 916 aligns with the indent 920 and then the return mechanism automatically biases the projection 916 into the indent 920. In some examples, visual, audible, and/or tactile feedback may be provided to the user when the child-resistant can 900 is closed. For example, a clicking noise may be made when the projection 916 snaps into the indent 920. A vibration may be felt when the projection 916 snaps into the indent 920. In some examples, the slider 906 may translate with the projection 916, such that visual feedback in the form of the slider 906 position is provided. In some embodiments, a visual indicator such as a color (e.g. red and green) or a word "locked/unlocked" may show upon moving the slider, showing an indication to the user what state the slider is in.

In some embodiments, the method of manufacturing includes first filling the base of the child resistant can with product, and afterwards capping the filled base by dropping the lid on the base. There may be force required for the lid to snap on the base. In one embodiment, the lid has a groove on the inside wall and meets with an extrusion on the base. Once snapped together, the lid can rotate if the safety slider is deactivated. In another embodiment, the lid has a grove, and the base has a ridge, and when snapped together, the lid can rotate. In another assembly embodiment, the safety mechanism is in a deactivated state and becomes activated when the lid is placed on the base, thereby engaging with 920.

In some examples, the child-resistant can 900 may have a diameter 930. The diameter 930 may be about 50 mm to about 60 mm, about 60 mm to about 70 mm, about 70 mm to about 80 mm, about 80 mm to about 90 mm, or about 90 mm to about 100 mm. In some examples, the child-resistant can 900 may have a height 936. The height 936 may be about 10 mm to about 15 mm, about 15 mm to about 20 mm, about 20 mm to about 25 mm, or about 25 mm to about 30 mm. In some examples, the moveable switch 904 may have a width 932. The width 932 may be about 1 mm to about 10 mm. The width 932 may be about 1 mm to about 5 mm or about 5 mm to about 10 mm. In some examples, the lid opening 912 and/or the base opening 924 may have a radius 934. The radius 934 may be about 20 mm to about 60 mm. The radius 934 may be about 20 mm to about 30 mm, about 30 mm to about 40 mm, about 40 mm to about 50 mm, or about 50 mm to about 60 mm.

FIG. 10A to FIG. 10K illustrate an embodiment of a child-resistant can 1000. The child-resistant can 1000 may include one or more safety mechanisms operable to prevent a child from opening the child-resistant can 1000. For example, the child-resistant can 1000 may require actuation of a hidden mechanism in order to open the child-resistant can 1000. In this manner, children are prevented from opening the child-resistant can 1000.

The child-resistant can 1000 may include a lid 1010 and a base 1002. The base 1002 may include a bottom plate 1001 and a base circumferential wall 1014. The base circumferential wall 1014 may extend from the bottom plate 1001. In some examples, the base circumferential wall 1014 and the bottom plate 1001 may define an interior surface 1022.

The lid 1010 may be configured to enclose the interior surface 1022. The lid 1010 may include a top plate 1008 and a lid circumferential wall 1020. The lid circumferential wall 1020 may extend from the top plate 1008. The lid circumferential wall 1020 may be configured to abut against the base circumferential wall 1014. In some examples, the lid circumferential wall 1020 may include a wall projection 1030 extending inwardly from the lid circumferential wall 1020. In some examples, the lid 1010 may include a moveable switch 1004. The moveable switch 1004 may be disposed in the top plate 1008. In some examples, the moveable switch 1004 may include a slider 1006 disposed on (and exposed from) the top surface of the top plate 1008. The moveable switch 1004 may include a switch projection 1012 extending downward from the slider 1006. In some examples, the switch projection 1012 may extend along and/or within the lid circumferential wall 1020. The slider 1006 may control the motion of the switch projection 1012. For example, translating the slider 1006 may also translate the switch projection 1012.

The base circumferential wall 1014 may include an indent 1024. The indent 1024 may be located at an upper edge of the base circumferential wall 1014. The indent 1024 may be operable to receive the switch projection 1012. For example, the indent 1024 may be operable to receive the switch projection 1012. When the switch projection 1012 is engaged in the indent 1024, rotation of the lid 1010 may be prevented.

The base circumferential wall 1014 may include a groove 1026. The groove 1026 may include at least a horizontal portion 1028 and a vertical inlet/outlet portion 1032. The groove 1026 may be operable to receive the wall projection 1030.

In some examples, the remove the lid 1010 from the base 1002, a user may first translate the slider 1006 outward, thereby causing the switch projection 1012 to translate out of and disengage from the indent 1024. Next, a user may rotate the lid 1010 such that the wall projection 1030 translates along the horizontal portion 1028 of the groove 1026. Finally, a user may lift the lid 1010 upwards, thereby causing the wall projection 1030 to translate upwards within the vertical inlet/outlet portion 1032 of the groove 1026.

In some examples, the moveable switch 1004 may further include a return mechanism. For example, the moveable switch 1004 may include a return mechanism configured to provide a return force to urge the switch projection 1012 towards the base circumferential wall 1014. For example, when the switch projection 1012 is aligned with the indent 1024, the return mechanism may automatically bias the switch projection into the indent 1024, thereby securing the switch projection in the indent 1024.

To recouple the lid 1010 to the base 1002, a user may first align the wall projection 1030 with the vertical inlet/outlet portion 1032. The user may then push the lid 1010 downwards towards the base 1002, thereby translating the wall projection 1030 within the vertical inlet/outlet portion 1032. A user may then rotate the lid 1010 such that the wall projection 1030 translates along the horizontal portion 1028. Once the wall projection reaches the end of the horizontal portion 1028, the return mechanism may automatically bias the switch projection 1012 into the indent 1024, thereby recoupling the lid 1010 to the base 1002.

In some examples, when the lid 1010 is recoupled to the base 1002, an indication may be provided to the user. In some examples, visual, audible, and/or tactile feedback may be provided to the user when the child-resistant can 1000 is closed. For example, a clicking noise may be made when the switch projection 1012 snaps into the indent 1024. A vibration may be felt when the switch projection 1012 snaps into the indent 1024. In some examples, the slider 1006 may translate with the switch projection 1012, such that visual feedback in the form of the slider 1006 position is provided.

In some examples, the child-resistant can 1000 may include a catch lid 1016. The catch lid 1016 may have the same functionality as the other catch lids described herein. For example, the catch lid 1016 may include a projection 1036 configured to engage to a corresponding projection 1034 of the base 1002. When the projection 1036 and the corresponding projection 1034 are engaged, the catch lid 1016 may be coupled to the base 1002. The base 1002 may include an opening 1038 operable to expose a lip of the catch lid 1016. A user may pull on the lip of the catch lid 1016 to disengage the projection 1036 from the corresponding projection 1034, thereby exposing a cavity formed between the base 1002 and the catch lid 1016.

In other examples, the moveable switch 1004 may be disposed on an outer surface of the base circumferential wall 1014 and the indent 1024 may be located on the lid circumferential wall 1020. In other examples, the moveable switch 1004 may move axially along the exterior diameter of the base 1002. In other examples, the moveable switch 1004 may rotate as a dial or a pivoting toggle on the top of the top lid plate 1008.

In some examples, the child-resistant can 1000 may include a sealing mechanism. For example, the lid circumferential wall 1020 may include an inner wall 1018 and an outer wall, defining a cavity to receive the base circumferential wall 1014. The outer wall may include the wall projection 1030. In some examples, the inner wall may include a sealing ring 1017 configured to abut against the base circumferential wall 1014. The sealing ring may be operable to seal the cavity defined by the lid 1010 and the base 1002 such that products stored in the cavity remain fresh.

In some examples, the child-resistant can 1000 may have a diameter 1040. The diameter 1040 may be about 50 mm to about 60 mm, about 60 mm to about 70 mm, about 70 mm to about 80 mm, about 80 mm to about 90 mm, or about 90 mm to about 100 mm. The moveable switch 1004 may have a width 1042. The width 1042 may be about 1 mm to about 5 mm or about 5 mm to about 10 mm. The child-resistant can 1000 may have a height 1044. The height may be about 10 mm to about 15 mm, about 15 mm to about 20 mm, about 20 mm to about 25 mm, or about 25 mm to about 30 mm.

FIG. 11A to FIG. 11F illustrate an embodiment of a child-resistant can 1100. The child-resistant can 1100 may include one or more safety mechanisms operable to prevent a child from opening the child-resistant can 1100. For example, the child-resistant can 1100 may require a user to open the child-resistant can 1100 while there is a distraction (e.g., red herring) mechanism. In this manner, children are prevented from opening the child-resistant can 1100.

The child-resistant can 1100 may include a bistable cap 1102, a shell 1104, and a base 1110. The base 1110 may include a bottom plate 1101 and a base circumferential wall 1112. The base circumferential wall 1112 may extend from the bottom plate 1101. In some examples, the base circumferential wall 1112 may include a spiral groove 1114. In some examples, the base 1110 may include an interior surface 1122 defined by the bottom plate 1101 and the base circumferential wall 1112. In some examples, the base circumferential wall 1112 may include an arm groove 1126.

The shell 1104 may include a shell circumferential wall 1118 configured to abut against a lower portion of the base circumferential wall 1112. The shell 1104 may include a projection 1120 extending inward from the shell circumferential wall 1118. The projection 1120 may be operable to be received within the spiral groove 1114. In some examples, an upper portion of the shell circumferential wall 1118 and an upper portion of the base circumferential wall 1112 may be configured to form a gap 1116 therebetween.

The bistable cap 1102 may include a top plate 1106 and one or more flexing arms 1108. The one or more flexing arms 1108 may be configured to be received in the gap 1116. The one or more flexing arms 1108 may each include a projection 1124. The projection may extend inward from the one or more flexing arms. The projection 1124 may be operable to be received within the arm groove 1126 of the base circumferential wall 1112.

Figure 11A:
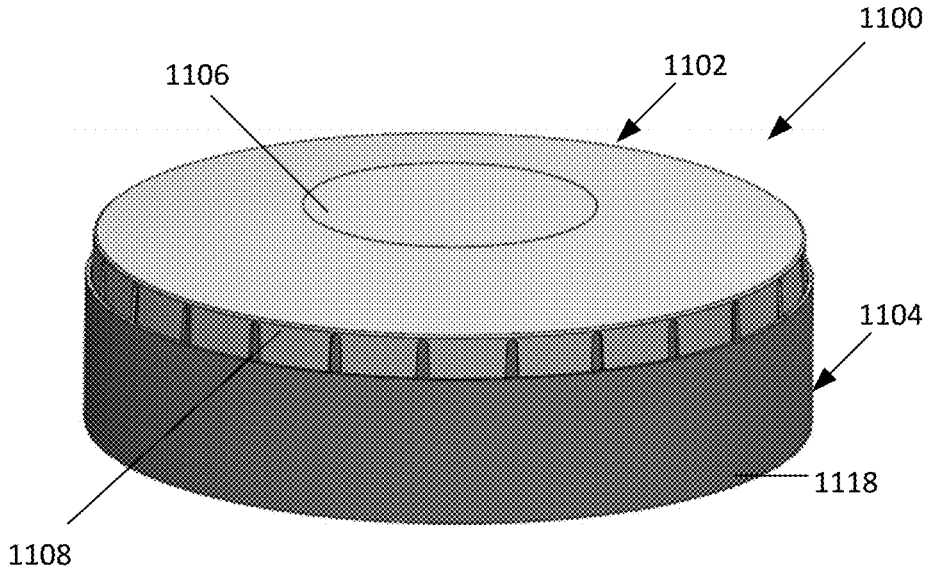
FIG. 11A illustrates a child-resistant can in accordance with one embodiment.
Figure 11B:
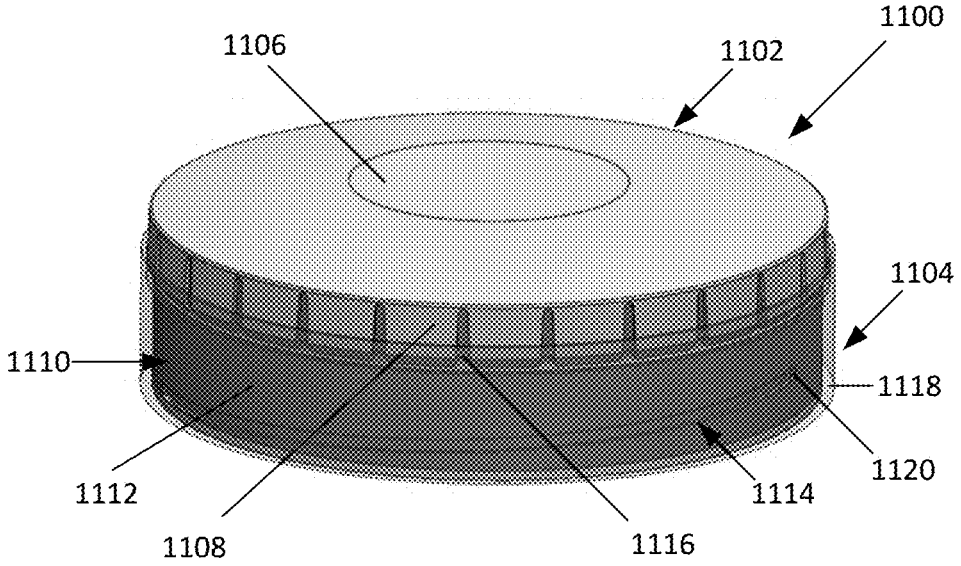
FIG. 11B illustrates a child-resistant can in accordance with one embodiment.
Figure 11C:
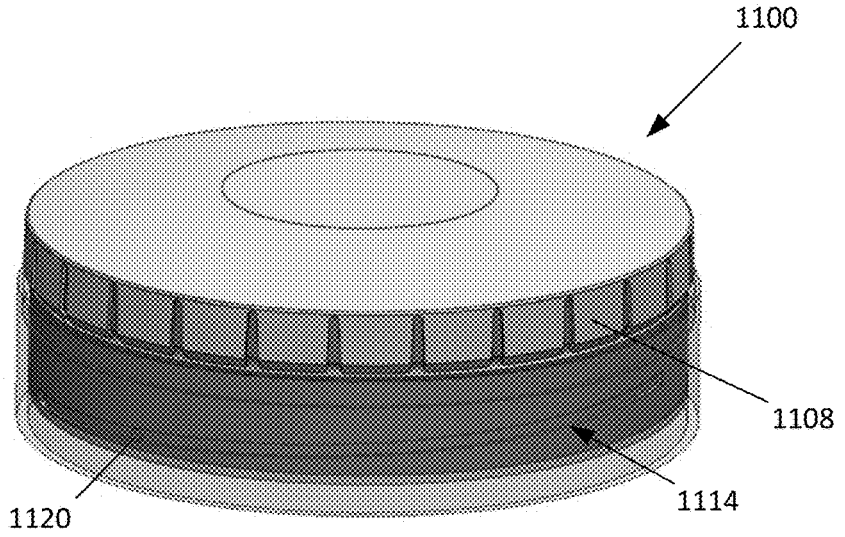
FIG. 11C illustrates a child-resistant can in accordance with one embodiment.
Figure 11D:
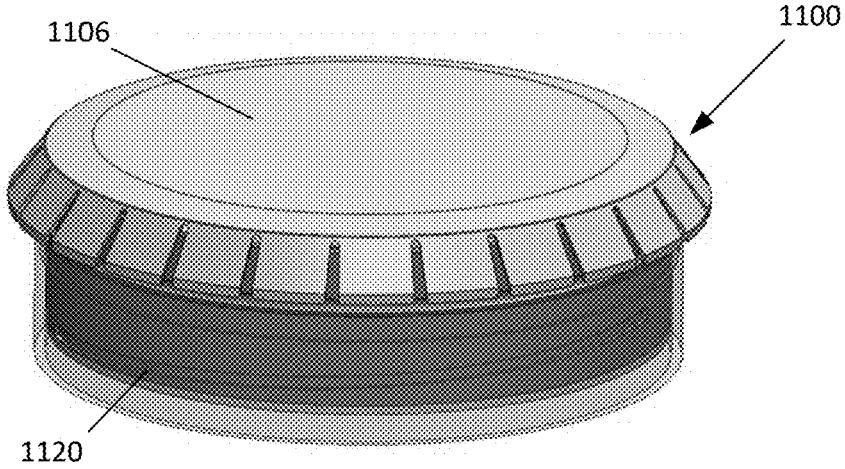
FIG. 11D illustrates a child-resistant can in accordance with one embodiment.
Figure 11E:
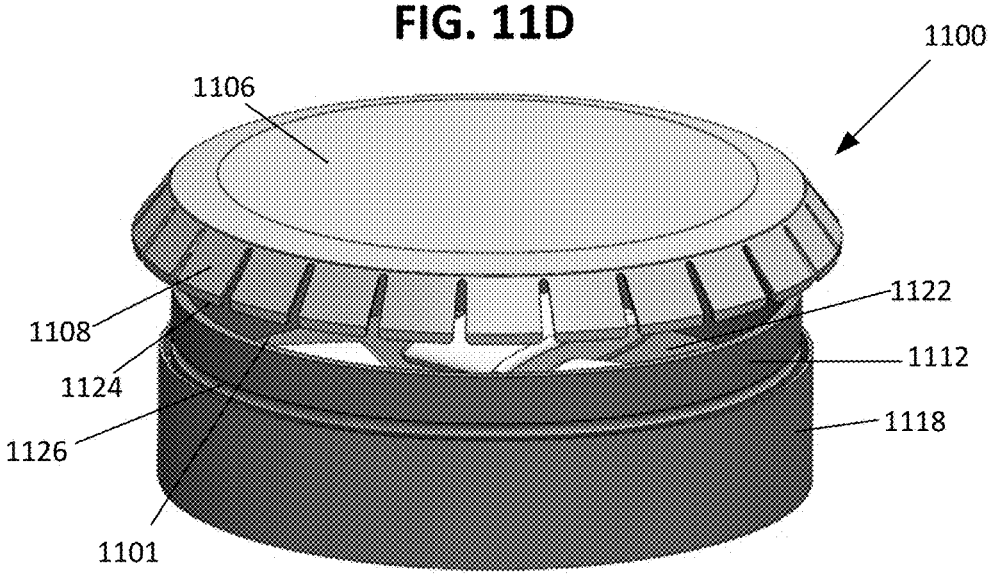
FIG. 11E illustrates a child-resistant can in accordance with one embodiment.

To open the child-resistant can 1100, a user may first rotate the shell 1104 such that the projection 1120 travels along the spiral groove 1114. As the projection 1120 travels along the spiral groove 1114, the shell moves downward with respect to the base 1110. As the shell 1104 moves downward, the one or more flexing arms 1108 may become exposed (e.g., the shell circumferential wall 1118 no longer defines the gap 1116 and therefore does not enclose the one or more flexing arms 1108), as illustrated in FIG. 11C. When the one or more flexing arms 1108 are exposed, a user may press down on the top plate 1106, thereby causing the projection 1124 of the one or more flexing arms 1108 to be released from the arm groove 1126. The bistable cap 1102 may then be lifted away form the base 1110 and the shell 1104, such that an interior cavity defined by the base circumferential wall 1112 and the interior surface 1122 is accessible.

The bistable cap 1102 may be recoupled to the base 1110 and the shell 1104 by engaging the projection 1124 of the one or more flexing arms 1108 to the arm groove 1126. In some examples, the top plate 1106 of the bistable cap 1102 may be placed on a surface. The base circumferential wall 1112 of the base 1110 may then be placed on top of the bistable cap 1102. The weight of the base 1110 and shell 1104 may be sufficient to cause the one or more flexing arms 1108 to flex inward, thereby engaging the projection 1124 of the one or more flexing arms 1108 to the arm groove 1126. The shell 1104 may then be rotated, thereby translating the projection 1120 of the shell circumferential wall 1118 upwards through the spiral groove 1114 such that the gap 1116 is reformed.

In some examples, the child-resistant can 1100 may include any of the sealing rings and/or catch lids described herein.

Figure 11F:
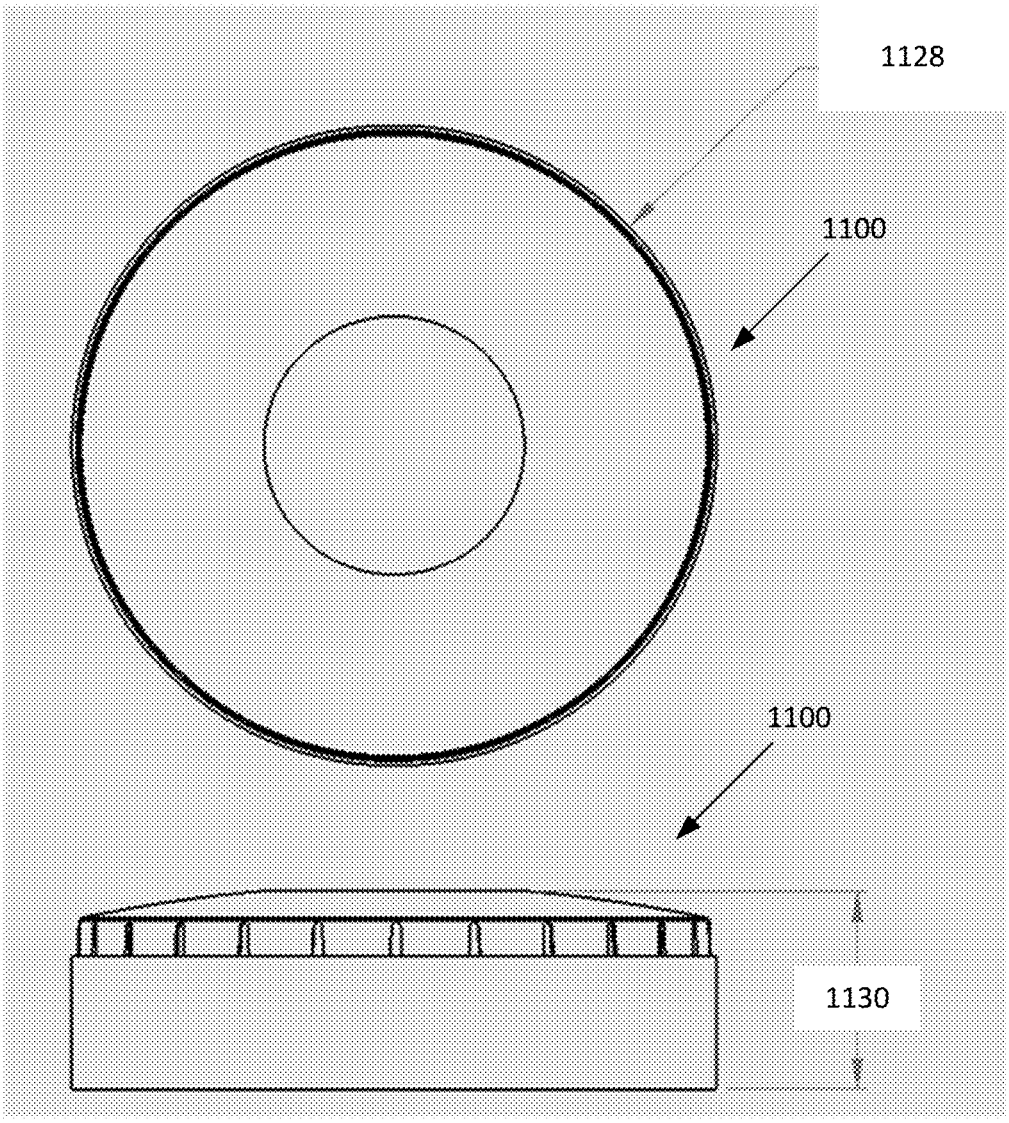
FIG. 11F illustrates a child-resistant can in accordance with one embodiment.

In some examples, as illustrated in FIG. 11F, the child-resistant can 1100 may include a diameter 1128. The diameter 1128 may be about 50 mm to about 60 mm, about 60 mm to about 70 mm, about 70 mm to about 80 mm, about 80 mm to about 90 mm, or about 90 mm to about 100 mm. In some examples, the child-resistant can 1100 may include a height 1130. The height may be about 10 mm to about 15 mm, about 15 mm to about 20 mm, about 20 mm to about 25 mm, or about 25 mm to about 30 mm.

In some embodiments, the disclosed cans may be metal cans. For example, the disclosed cans may include or may be made entirely or largely out of a metal. For example, the can may be at least 80%, at least 90%, at least 95%, or at least 98% by weight metal. The metal may include one or more of aluminum, tinplate (steel with a thin layer of tin), chromed steel (steel with a thin layer of chromium), stainless steel, zinc, copper, or the like. According to some alternative embodiments, the disclosed cans may be entirely or largely out of a plastic. For example, the can may be at least 80%, at least 90%, at least 9%, or at least 98% by weight plastic. The plastic may include one or of polypropylene (PP), polyethylene terephthalate (PET), high-density polyethylene (HDPE), low-density polyethylene (LDPE), polyvinyl chloride (PVC), polystyrene (PS), polylactic acid (PLA), Ethylene Vinyl Alcohol (EVOH), polycarbonate (PC), PCTG, or the like.

In some embodiments, the cans may be designed to be disposable, consistent with conventional cans for oral nicotine dosage forms such as pouches. In such embodiments, as well as in other instances, it may be advantageous for the cans to contain or be entirely made from a cost-effective metal such as aluminum. In some embodiments, it may also be desirable for the cans to contain or be made entirely out of biodegradable or compostable materials. A biodegradable or compostable material may be a material which decomposes in 6 months or less, 1 year or less, 2 years or less, 5 years or less, 10 years or less, 20 years or less, 50 years or less, or 100 years or less when exposed to natural conditions including one or more of moisture, soil, microbes, heat, and the like, or to industrial composting conditions. Such materials may include a biodegradable or compostable plastic. In an embodiment, the plastic may include eco-friendly, biodegradable, or otherwise compostable plastic. In a non-limiting example, such plastic may include a plant-based plastic such as polylactic acid (PLA), polyhydroalkanoates (PHAs), polyhydroxy butyrate (PHB), polyhdroxyvalerate (PHV), polyhydroxy hexanoate (PHH), and the like. In another non-limiting example, such plastic may also include petroleum-based plastics such as polyglycolic acid (PGA), polybutylene succinate (PBS), polycaprolactone (PCL), polybutylene adipate terephthalate (PBAT), Oxo-degradable polypropylene (oxo-PP), and the like.

In some cases, and particularly in embodiments where cans employ biodegradable and/or compostable materials, there may be concern about potential leachables and/or extractables and/or early decomposition of the cans. To mitigate this concern, in some embodiments, the disclosed cans may include an interior coating applied to a portion of or entirely covering the surface of the storage cavity. Such a coating may comprise one or more of epoxy coatings including one or more of AP4, AP6, Epoxy-1, Bisphenal A diglycidyl ether (DBEBA), or BPA-free epoxy coatings; polyethylene; polypropylene; polyvinyl; wax; or aluminum. The composition and thickness of the interior coating may be chosen to prevent leaching, migration, or other loss of known extractables/leachables from the interior of the storage cavity and/or from the dosage forms stored therein. The interior coating may also have additional benefits such as providing a barrier to oxygen, light, moisture, and the like. According to some exemplary embodiments, the interior coating may have a thickness of less than 0.015 mm, between 0.015 mm to 0.03 mm, between 0.03 mm and 0.04 mm, between 0.04 mm and 0.05 mm, and thicker than 0.05 mm. For instance, epoxy coatings can be effective in the range of 0.02 mm to 0.04 mm, whereas polyester coatings may be thinner at 0.015 mm to 0.03 mm. It is important to select an appropriate thickness for the coating, e.g., as disclosed herein, because too small a thickness may be insufficient to protect from leachables or insufficient to satisfy regulatory standards on safety. While thicker coatings protect more thoroughly from potential leachables, they come at an increased cost and may impact the biodegradable/compostable timeline of the material.

According to some embodiments, the disclosed cans may include pieces (e.g., seals, flexible seams) requiring more elasticity than a typical metal or plastic. To the extent feasible, such pieces may also be made of a biodegradable or compostable material, such as one or more of the aforementioned materials, so long as such material can provide the required elasticity. In alternative embodiments, such pieces may include or be formed from silicone, either alone or in combination with one or more of the aforementioned compostable or biodegradable materials.

As described herein, the devices, systems, and methods can provide several significant advantages and benefits over other devices, systems, and methods for child-proofing (or making child-resistant) cans, currently available in the art. However, the recited advantages are not meant to be limiting in any way, as one skilled in the art will appreciate that other advantages may also be realized upon practicing the present disclosure. It will be appreciated, moreover, that other applications for the disclosed cans are also possible and considered to fall within the scope of the present disclosure.

Furthermore, those skilled in the relevant art will recognize that changes can be made to the described embodiments while still obtaining the beneficial results. It will also be apparent that some of the advantages and benefits of the described embodiments can be obtained by selecting some of the features of the embodiments without utilizing other features, and that features from one embodiment may be combined with features from other embodiments in any appropriate combination. For example, any individual or collective features of method embodiments may be applied to apparatus, product or system embodiments, and vice versa. Accordingly, those who work in the art will recognize that many modifications and adaptations to the embodiments described are possible and may even be desirable in certain circumstances, and are a part of the disclosure. Thus, the present disclosure is provided as an illustration of the principles of the embodiments and not in limitation thereof, since the scope of the invention is to be defined by the claims.

What is claimed:

1. A child-resistant can comprising:

a base comprising:

a bottom plate;

a base circumferential wall extending from the bottom plate to an upper edge, the bottom plate and the base circumferential wall defining an interior surface and an opposing exterior surface, the base circumferential wall comprising a groove in the exterior surface, the groove having an inlet portion positioned at the upper edge, a first portion, a second portion, a third portion, and an outlet portion positioned at the upper edge, the inlet portion being connected to the first portion, the first portion being connected to the second portion at a first angle, and the second portion being connected to the third portion at a second angle, and the outlet portion being connected to the third portion; and a lid configured to enclose the interior surface, the lid comprising:

a top plate; and a lid circumferential wall extending from the top plate and configured to abut against the exterior surface of the base circumferential wall, the lid circumferential wall comprising a projection configured to be received within the groove, wherein the lid is configured to be removed from the base by translating the projection within the groove along the first portion, the second portion, the third portion, and the outlet portion, and wherein the first portion comprises a lip configured to provide resistance to translation of the projection along the first portion.

2. The child-resistant can of claim 1, wherein the first angle and the second angle are each within a range of 80 degrees to 100 degrees.

3. The child-resistant can of claim 1, wherein the first angle and the second angle are each about 90 degrees.

4. The child-resistant can of claim 1, wherein the first portion extends horizontally along the exterior surface of the base circumferential wall, the second portion extends vertically along the exterior surface of the base circumferential wall, and the third portion extends horizontally along the exterior surface of the base circumferential wall.

5. The child-resistant can of claim 1, wherein the inlet portion includes a snap-fit mechanism configured to prevent removal of the projection from the groove via the inlet portion.

6. The child-resistant can of claim 5, wherein the inlet portion comprises a chamfered surface configured to guide the projection along the inlet portion and over the snap-fit mechanism.

7. The child-resistant can of claim 1, wherein the inlet portion extends vertically along the exterior surface of the base circumferential wall.

8. The child-resistant can of claim 1, wherein the outlet portion extends vertically along the exterior surface of the base circumferential wall.

9. The child-resistant can of claim 1, wherein the outlet portion comprises a chamfered surface configured to aid in removal of the projection from the outlet portion and prevent insertion of the projection into the outlet portion.

10. The child-resistant can of claim 1, wherein a depth of the first, second, and third portions is within a range of about 0.8 mm to about 5 mm.

11. The child-resistant can of claim 10, wherein the depth is within a range of about 1 mm to about 3 mm.

12. The child-resistant can of claim 1, wherein a width of the first, second, and third portions is within a range of about 1 mm to about 5 mm.

13. The child-resistant can of claim 12, wherein the width is within a range of about 2 mm to about 3 mm.

14. The child-resistant can of claim 1, wherein a diameter of the can is within a range of about 50 mm to about 100 mm.

15. The child-resistant can of claim 1, wherein a height of the can is within a range of about 10 mm to about 30 mm.

16. A method of closing the child-resistant can of claim 1, comprising:

positioning the lid above the base;

aligning the projection with the inlet portion;

translating the lid downwards so that the projection enters the inlet portion, passes through the inlet portion, and is subsequently received in the first portion.

17. A method of opening the child-resistant can of claim 1, comprising:

rotating the lid such that the projection slides along the first portion;

lifting the lid such that the projection slides along the second portion;

rotating the lid such that the projection slides along the third portion; and lifting the lid such that the projection slides through the outlet portion to disengage from the groove.

18. A child-resistant can comprising:

a base comprising:

a bottom plate;

a base circumferential wall extending from the bottom plate, the bottom plate and the base circumferential wall defining an interior surface and an opposing exterior surface, the base circumferential wall comprising a groove in the exterior surface, the groove having an inlet portion, a first portion, a second portion, a third portion, and an outlet portion, the inlet portion being connected to the first portion, the first portion being connected to the second portion at a first angle, and the second portion being connected to the third portion at a second angle, and the outlet portion being connected to the third portion; and a lid configured to enclose the interior surface, the lid comprising:

a top plate; and a lid circumferential wall extending from the top plate and configured to abut against the exterior surface of the base circumferential wall, the lid circumferential wall comprising a projection configured to be received within the groove, wherein the lid is configured to be removed from the base by translating the projection within the groove along the first portion, the second portion, the third portion, and the outlet portion, and wherein the outlet portion has a chamfered surface configured to prevent insertion of the projection into the outlet portion.

19. A child-resistant can comprising:

a base comprising:

a bottom plate;

a base circumferential wall extending from the bottom plate, the bottom plate and the base circumferential wall defining an interior surface and an opposing exterior surface, the base circumferential wall comprising a groove in the exterior surface, the groove having an inlet portion, a first portion, a second portion, a third portion, and an outlet portion, the inlet portion being connected to the first portion, the first portion being connected to the second portion at a first angle, and the second portion being connected to the third portion at a second angle, and the outlet portion being connected to the third portion; and a lid configured to enclose the interior surface, the lid comprising:

a top plate; and a lid circumferential wall extending from the top plate and configured to abut against the exterior surface of the base circumferential wall, the lid circumferential wall comprising a projection configured to be received within the groove, wherein the lid is configured to be removed from the base by translating the projection within the groove along the first portion, the second portion, the third portion, and the outlet portion, and wherein the first portion comprises a lip configured to provide resistance to translation of the projection along the first portion.

* * * * *